US007303851B2

(12) United States Patent
Hirano et al.

(10) Patent No.: US 7,303,851 B2
(45) Date of Patent: Dec. 4, 2007

(54) SILVER HALIDE PHOTOGRAPHIC LIGHT-SENSITIVE MATERIAL

(75) Inventors: Mitsunori Hirano, Minami-ashigara (JP); Kunio Ishigaki, Minami-ashigara (JP); Tokuju Oikawa, Minami-ashigara (JP)

(73) Assignee: Fujifilm Corporation, Tokyo (JP)

( * ) Notice: Subject to any disclaimer, the term of this patent is extended or adjusted under 35 U.S.C. 154(b) by 251 days.

(21) Appl. No.: 10/671,939

(22) Filed: Sep. 29, 2003

(65) Prior Publication Data

US 2004/0126721 A1 Jul. 1, 2004

(30) Foreign Application Priority Data

Sep. 30, 2002 (JP) ..... 2002-287243

(51) Int. Cl.
*G03C 1/06* (2006.01)

(52) U.S. Cl. ..... 430/264; 430/613; 430/614; 430/615; 430/570; 430/576; 430/577; 430/551; 430/598; 430/502; 430/503; 430/581; 430/582; 430/583; 430/584; 430/585

(58) Field of Classification Search ..... 430/264, 430/613–615, 570, 576–577, 581–585, 551, 430/502, 503, 598
See application file for complete search history.

(56) References Cited

U.S. PATENT DOCUMENTS

| | | | | |
|---|---|---|---|---|
| 5,571,660 | A | 11/1996 | Ito et al. | |
| 5,578,414 | A | 11/1996 | Yamamoto et al. | |
| 6,114,081 | A * | 9/2000 | Oikawa | 430/264 |
| 2004/0209204 | A1 * | 10/2004 | Hirano et al. | 430/567 |

FOREIGN PATENT DOCUMENTS

| | | | |
|---|---|---|---|
| EP | 0 735 416 | A1 | 10/1996 |
| JP | 4-57046 | A | 2/1992 |
| JP | 5-224330 | A | 3/1993 |
| JP | 6-194771 | A | 7/1994 |
| JP | 7-287338 | A | 10/1995 |
| JP | 2926453 | B2 | 5/1999 |

* cited by examiner

*Primary Examiner*—Geraldina Visconti
(74) *Attorney, Agent, or Firm*—Birch, Stewart, Kolasch & Birch, LLP

(57) ABSTRACT

Disclosed is a silver halide photographic light-sensitive material wherein a silver halide emulsion layer and/or a hydrophilic colloid layer contains at least one hydrazine derivative, and a silver halide emulsion is spectrally sensitized with a particular dye, and which contains a benzotriazol compound. There is provided a silver halide photographic light-sensitive material that exhibits superior residual color property and can provide stable photographic performance even after a long term running with a reduced silver amount.

19 Claims, No Drawings

SILVER HALIDE PHOTOGRAPHIC LIGHT-SENSITIVE MATERIAL

TECHNICAL FIELD

The present invention relates to a silver halide photographic light-sensitive material. In particular, the present invention relates to an ultrahigh contrast silver halide photographic light-sensitive material which is processed by using an image setter and automatic developing machine used in a photomechanical process.

RELATED ART

As one of light exposure methods for photographic light-sensitive materials, the so-called scanner type image-forming method is known, in which an original is scanned, and light exposure is performed on a silver halide photographic light-sensitive material based on the image signals obtained by the scanning to form a negative or positive image corresponding to the original image. As light sources of light exposure apparatuses for this method, HeNe laser (633 nm), red semiconductor laser (670 nm to 680 nm) and LED (660 nm to 680 nm) are widely used. Further, when an image is directly printed on a printing plate without any reversal process after the image is outputted on a film from a scanner, or for a scanner light source having a soft beam profile, light-sensitive materials for scanners having a ultrahigh contrast property are desired. Furthermore, highly sensitive light-sensitive materials are required in the scanning process in order to shorten the process, obtain high resolution and prolong the lifetime of the light source.

Meanwhile, various patent documents have been published so far for sensitizing dyes exhibiting high sensitivity and little residual color when they are used with a HeNe light source or the like. Examples of such dyes include, for example, trinucleus cyanines (see, for example, Japanese Patent Laid-open Publication (KOKAI, hence force referred to as "JP-A") No. 62-157057, JP-A-1-47449, JP-A-3-259135, JP-A-2-161424 and JP-A-4-318542), trinucleus melocyanines (see, for example, JP-A-3-171135 and JP-A-5-224330), trimethine cyanines (see, for example, JP-A-2-297541 and JP-A-4-57046) and tetramethinemelocyanines (see, for example, JP-A-7-287338). Further, light-sensitive materials utilizing the aforementioned sensitizing dyes and a hydrazine derivative in combination have also been disclosed (see, for example, JP-A-7-287338, JP-A-6-194771, Japanese Patent No. 2926453 and Japanese Patent No. 3086983).

In the development of the aforementioned light-sensitive materials, it has become frequent to use an automatic developing machine in view of quick operation, simplicity and handling. In recent years, smaller replenishing amount, quicker operation and lower silver content of light-sensitive materials are increasingly strongly desired, and one of means for satisfying these requirements is increase of activity of developer. In the processing of monochrome light-sensitive materials, the activity can be increased by using a higher concentration of developing agent. However, degradation of the developer due to air oxidation becomes marked. Further, use of smaller thickness of light-sensitive material (for example, use of thinner protective layer) is also effective for realizing quicker processing. However, if a light-sensitive material of a low silver content is quickly processed, there are caused a problem of residual color and a problem that fluctuations of photographic properties (dot % fluctuation, decrease of density etc.) become significant.

Therefore, an object of the present invention is to provide a silver halide photographic light-sensitive material suitable for use with a scanner and image setter utilizing a HeNe laser, red semiconductor laser or LED as a light source, which can show superior residual color property and provide stable photograph performance even after a long term running with a smaller silver amount.

SUMMARY OF THE INVENTION

It was found that the aforementioned object could be achieve by a silver halide photographic light-sensitive material comprising at least one silver halide emulsion layer and at least one hydrophilic colloid layer on a support, wherein the silver halide emulsion layer and/or the hydrophilic colloid layer contains at least one hydrazine derivative, a silver halide emulsion in the silver halide photographic light-sensitive material is spectrally sensitized with at least one dye selected from dyes represented by any one of the following formulas (I) to (IV), and further the silver halide photographic light-sensitive material contains a benzotriazol compound:

Formula I

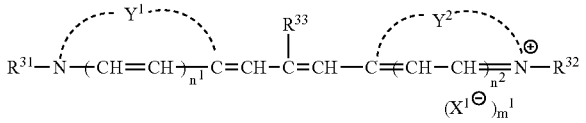

wherein, in the formula (I), $Y^1$ and $Y^2$ each independently represent a nonmetallic atom group required to form benzothiazole ring, benzoselenazole ring, naphthothiazole ring, naphthoselenazole ring or quinoline ring, where these heterocyclic rings may be substituted with a lower alkyl group, an alkoxyl group, an aryl group, hydroxyl group, an alkoxycarbonyl group or a halogen atom, $R^{31}$ and $R^{32}$ each independently represent a lower alkyl group or an alkyl group having sulfo group or carboxyl group, $R^{33}$ represents methyl group, ethyl group or propyl group, $X^1$ represents an anion, $n^1$ and $n^2$ each independently represent 0 or 1, $m^1$ represents 1 or 2, and $m^1$ is 0 when an intramolecular salt is formed;

Formula II

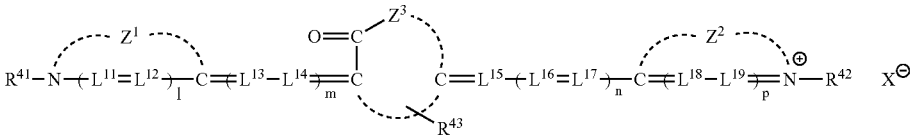

wherein, in the formula (II), $Z^1$ and $Z^2$ each independently represent an atomic group required to form a 5- or 6-membered heterocyclic ring, $Z^3$ represents an atomic group required to form a 5- or 6-membered nitrogen-containing heterocyclic ring, which has a substituent ($R^{43}$) on a nitrogen atom in $Z^3$, $R^{41}$ and $R^{42}$ each independently represent an alkyl group, an alkenyl group, an aralkyl group or an aryl group, $R^{43}$ represents a substituent having the same meaning as that of $R^{41}$ or $R^{42}$, a substituted amino group, amido group, imino group, an alkoxyl group or a heterocyclic group, where at least one of $R^{41}$, $R^{42}$ and $R^{43}$ represents a water-soluble group, $L^{11}$ to $L^{19}$ each independently represent a methine group, m and n each independently represent 0, 1 or 2, p represents 0 or 1, and X represents a counter ion;

Formula III

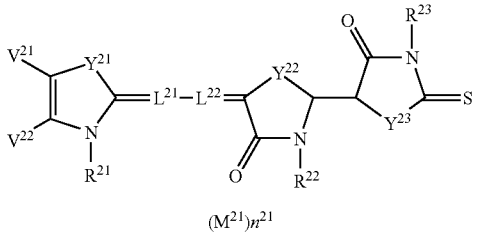

$(M^{21})n^{21}$ wherein, in the formula (III), $Y^{21}$, $Y^{22}$ and $Y^{23}$ each independently represent a —N($R^{24}$)-group, oxygen atom, sulfur atom or selenium atom, $R^{21}$ represents an aliphatic group having 10 or less carbon atoms and a water-solubilizing group, $R^{22}$, $R^{23}$ and $R^{24}$ each independently represent an aliphatic group, an aryl group or a heterocyclic group, where at least two of $R^{22}$, $R^{23}$ and $R^{24}$ have a water-solubilizing group, $V^{21}$ and $V^{22}$ each independently represent hydrogen atom, an alkyl group, an alkoxyl group or an aryl group, or $V^{21}$ and $V^{22}$ bind together to represent a group forming a condensed ring with the azole ring, $L^{21}$ and $L^{22}$ each independently represent a substituted or unsubstituted methine group, $M^{21}$ represents an ion required to offset the total intramolecular charge, and $n^{21}$ represents the number of ion required to offset the total intramolecular charge;

$R^3$, $R^4$ and $R^5$ have a water-solubilizing group, W represents oxygen atom, sulfur atom or =C($E^1$)-($E^2$) where $E^1$ and $E^2$ each independently represent an electron-withdrawing group, and $E^1$ and $E^2$ may bind together to form a keto ring or an acidic heterocyclic ring, $L^1$ and $L^2$ each independently represent a substituted or unsubstituted methine group, 1 represents 0 or 1, $M^1$ represents an ion required to offset the total intramolecular charge, $n^1$ represents the number of ion required to offset the total intramolecular charge.

In the silver halide photographic light-sensitive material of the present invention, the hydrazine derivative is preferably contained in an amount of $1.0\times10^{-4}$ mol/mol Ag or more, and the dye for spectral sensitization is preferably dissolved in water at a concentration of 0.05 weight % or more, and the silver halide photographic light-sensitive material preferably has a gelatin layer between the silver halide emulsion layer and the support. Further, it is also preferred that coated silver amount in the silver halide photographic light-sensitive material is 3.0 g/$m^2$ or less.

BEST MODE FOR CARRYING OUT THE INVENTION

The silver halide photographic light-sensitive material of the present invention will be explained in detail hereafter. In the present specification, ranges indicated with "to" mean ranges including the numerical values before and after "to" as the minimum and maximum values, respectively.

The silver halide photographic light-sensitive material of the present invention is partly characterized in that a silver halide emulsion is spectrally sensitized with at least one dye selected from those represented by any one of the formulas (I) to (IV).

The general formula (I) will be explained in detail. In the formula (I), $Y^1$ and $Y^2$ each independently represent a nonmetallic atom group required to form benzothiazole ring, benzoselenazole ring, naphthothiazole ring, naphthoselenazole ring or quinoline ring, and these heterocyclic rings may be substituted with a lower alkyl group, an alkoxyl group, an aryl group, hydroxyl group, an alkoxycarbonyl group or a halogen atom. $R^{31}$ and $R^{32}$ each independently represent a lower alkyl group or an alkyl group having sulfo group or carboxyl group. $R^{33}$ represents methyl group, ethyl group or Formula IV

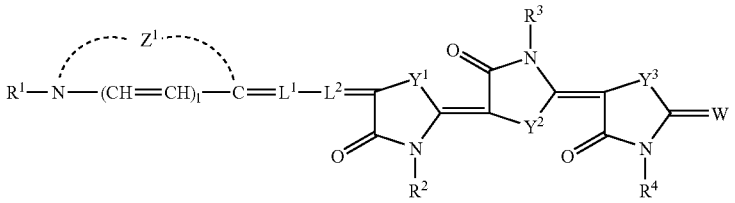

$(M^1)n^1$ wherein, in the formula (IV), $Y^1$, $Y^2$ and $Y^3$ each independently represent —N($R^5$)—, oxygen atom, sulfur atom, selenium atom or tellurium atom, $Z^1$ represents a nonmetallic atom group required to form a 5- or 6-membered nitrogen-containing heterocyclic group, which may form a condensed ring, $R^1$ represents an aliphatic group having 8 or less carbon atoms and a water-solubilizing group, $R^2$, $R^3$, $R^4$ and $R^5$ each independently represent an aliphatic group, an aryl group or a heterocyclic group, where at least two of $R^2$, propyl group. $X^1$ represents an anion. $n^1$ and $n^2$ each independently represent 0 or 1. $m^1$ represents 1 or 2, and $m^1$ is 0 when an intramolecular salt is formed.

Hereafter, the formula (I) will be explained in more detail.

In the formula (I), $Y^1$ and $Y^2$ each independently represent a nonmetallic atom group required to form benzothiazole ring, benzoselenazole ring, naphthothiazole ring, naphthoselenazole ring or quinoline ring. These heterocyclic rings may be substituted with a lower alkyl group (e.g., methyl group, ethyl group etc.), an alkoxyl group (e.g., methoxy group, ethoxy group etc.), hydroxyl group, an aryl group (e.g., phenyl group), an alkoxycarbonyl group (e.g., methoxycarbonyl group), a halogen atom (e.g., chlorine atom, bromine atom etc.) or the like. $R^{31}$ and $R^{32}$ represent a lower alkyl group (e.g., methyl group, ethyl group, propyl group, butyl group etc.), an alkyl group having sulfo group (e.g., β-sulfoethyl group, γ-sulfopropyl group, γ-sulfobutyl group, d-sulfobutyl group, a sulfoalkoxyalkyl group [e.g., sulfoethoxyethyl group, sulfopropoxyethyl group etc.]), or an alkyl group having carboxyl group (e.g., β-carboxylethyl group, γ-carboxypropyl group, γ-carboxybutyl group, d-carboxybutyl group). $R^{33}$ represents methyl group, ethyl group or propyl group. $X^1$ represents an anion usually used for cyanine dyes (e.g., a halogen ion, benzenesulfonate ion, p-toluenesulfonate ion etc.). $m^1$ represents 1 or 0, and $m^1$ is 0 when an intramolecular salt is formed.

Specific examples of the compounds represented by the formula (I) are listed below. However, the compounds that can be used for the present invention are not limited to the following compounds.

I-1

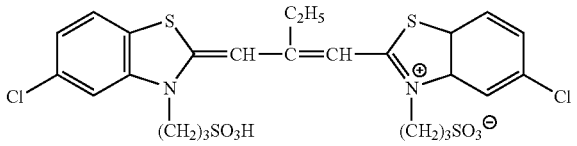

I-2

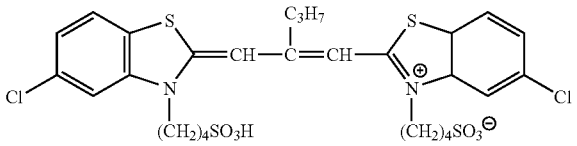

I-3

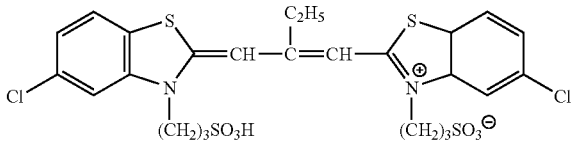

I-4

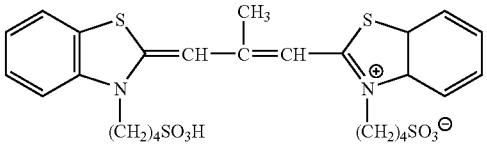

I-5

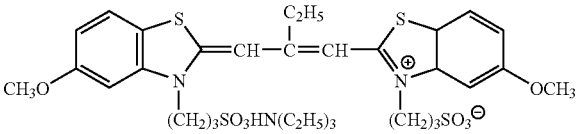

I-6

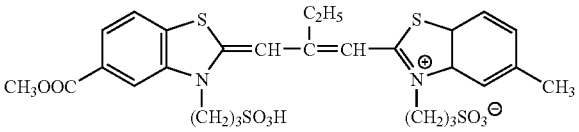

-continued

I-7

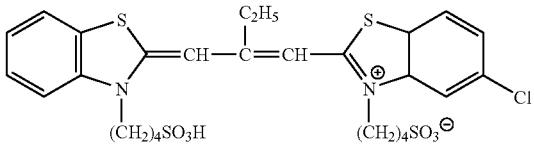

I-8

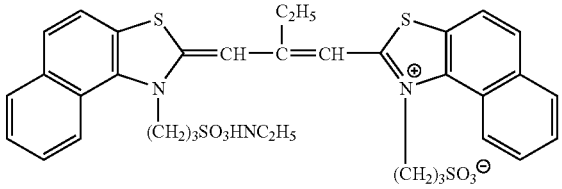

I-9

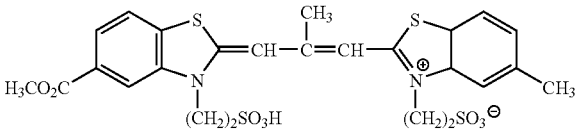

I-10

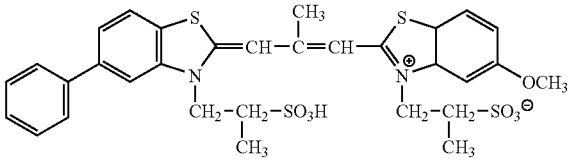

I-11

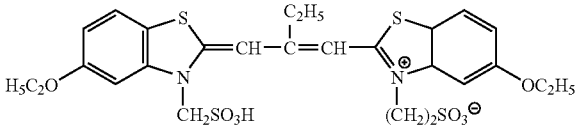

I-12

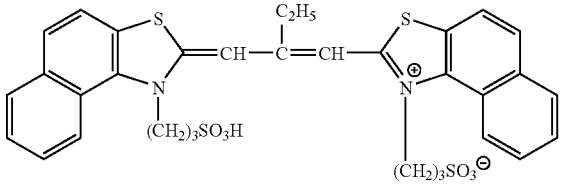

I-13

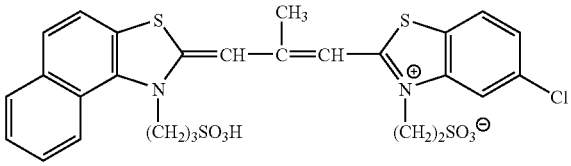

I-14

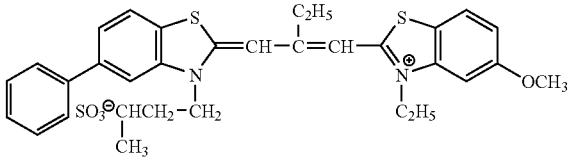

-continued
I-15
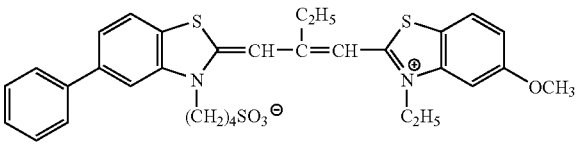
I-16
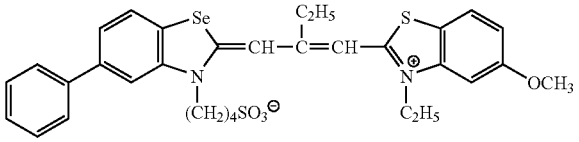
I-17
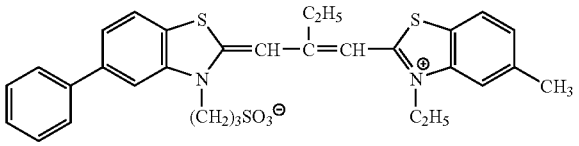
I-18
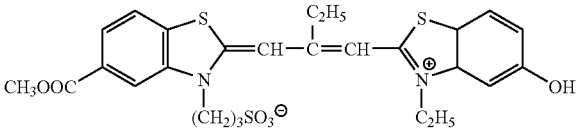
I-19
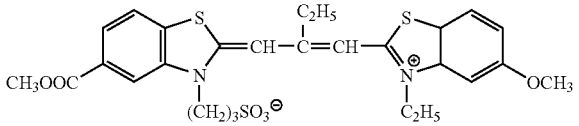
I-20
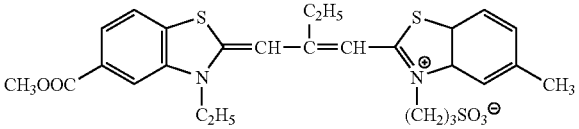
I-21
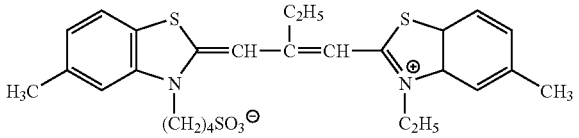
I-22
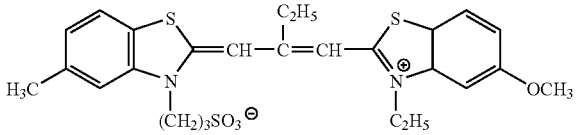
I-23
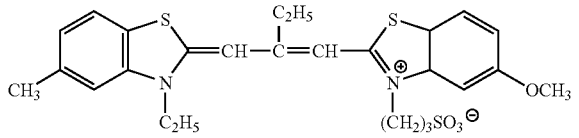
-continued
I-24
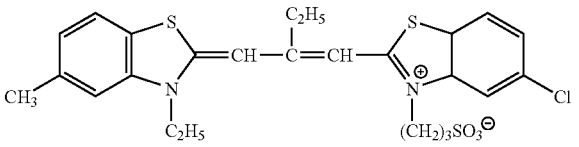
I-25
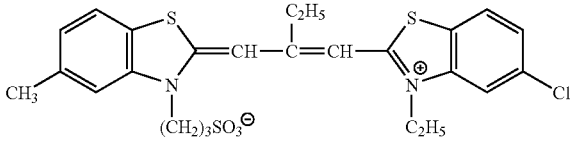
I-26
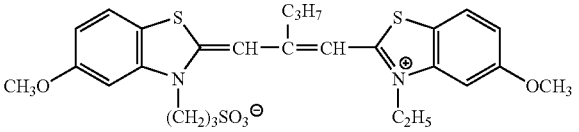
I-27
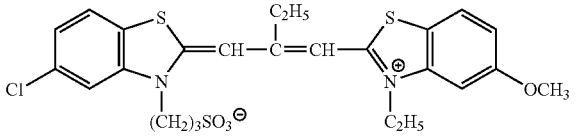
I-28
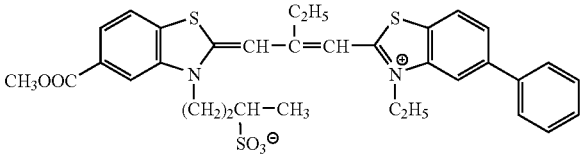
I-29
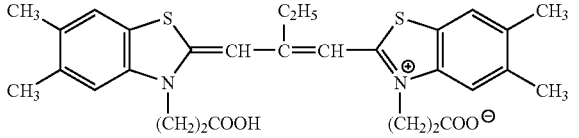
I-30
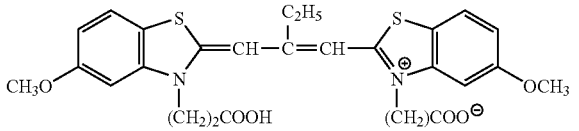
I-31
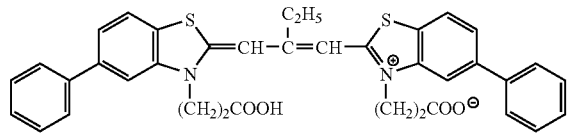
I-32
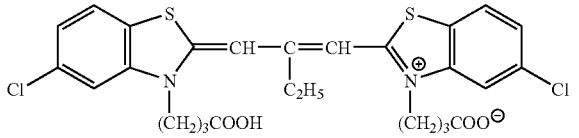

-continued

I-33

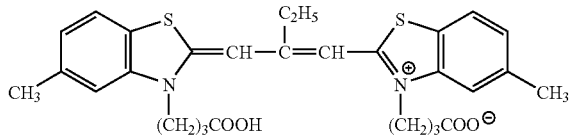

I-34

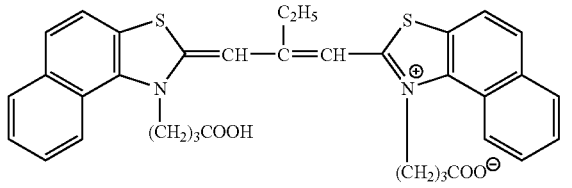

I-35

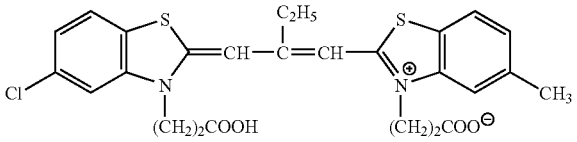

I-36

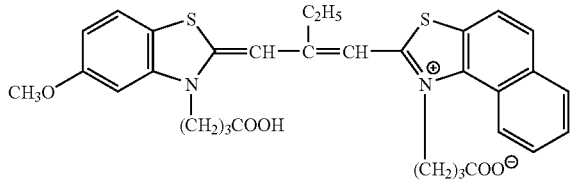

I-37

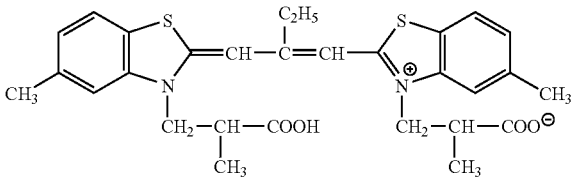

Hereafter, the formula (II) will be explained in detail. In the formula (II), $Z^1$ and $Z^2$ each independently represent an atomic group required to complete a heterocyclic ring, $Z^3$ represents an atomic group required to form a nitrogen-containing heterocyclic ring, which has a substituent ($R^{43}$) on a nitrogen atom in $Z^3$. $R^{41}$ and $R^{42}$ each independently represent an alkyl group, an alkenyl group, an aralkyl group or an aryl group. $R^{43}$ represents a substituent having the same meaning as that of $R^{41}$ or $R^{42}$, a substituted amino group, amido group, imino group, an alkoxyl group or a heterocyclic group. At least one of $R^{41}$, $R^{42}$ and $R^{43}$ represents a water-soluble group.

$L^{11}$ to $L^{19}$ each independently represent a methine group, m and n each independently represent 0, 1 or 2, and 1 and p each independently represent 0 or 1. X represents a counter ion.

Examples of the heterocyclic ring constituted by $Z^1$ or $Z^2$ in the aforementioned formula (II) include, for example, rings of oxazoline, oxazole, benzoxazole, benzisoxazole, naphthoxazole, thiazoline, thiazole, benzothiazole, naphthothiazole, selenazoline, selenazole, benzoselenazole, naphthoselenazole, tellurazole, benzotellurazole, pyridine, quinoline, benzoquinoline, indolenine, benzoindolenine, benzimidazole, pyrroline and so forth.

These heterocyclic rings may be substituted with a known substituent such as an alkyl, an alkoxy, an aryl, hydroxy, carboxy, an alkoxycarbonyl and a halogen.

Preferred examples of the 5- or 6-membered nitrogen-containing heterocyclic ring formed by $Z^3$ are those formed by removing oxo group or thioxo group from hydantoin, 2- or 4-thiohydantoin, 2-oxazolin-5-one, 2-thioxazoline-2,4-dione, thiazolidine-2,4-dione, rhodanine, thiazolidine-2,4-dithione, barbituric acid and 2-thiobarbituric acid, more preferred are those formed by removing oxo group or thioxo group from hydantoin, 2- or 4-thiohydantoin, 2-oxazolin-5-one, rhodanine, barbituric acid and 2-thiobarbituric acid, and the most preferred are those formed by removing oxo group or thioxo group from 2- or 4-thiohydantoin, 2-oxazolin-5-one and rhodanine.

The alkyl group represented by $R^{41}$, $R^{12}$ or $R^{43}$ in the aforementioned formula (II) is preferably an alkyl group having 1 to 6 carbon atoms, and it may be a linear, branched or cyclic alkyl group. The alkyl group may have a substituent such as methyl, ethyl, isopropyl, cyclohexyl, allyl, trifluoromethyl, β-hydroxyethyl, acetoxymethyl, carboxymethyl, ethoxycarbonylmethyl, β-methoxyethyl, γ-methoxypropyl, β-benzoyloxyethyl, γ-sulfopropyl, and d-sulfobutyl.

Examples of the alkenyl group include allyl group etc., examples of the aralkyl group include benzyl, phenethyl, sulfobenzyl etc., and examples of the aryl group include phenyl, tolyl, chlorophenyl, sulfophenyl etc.

Examples of the group binding to a nitrogen atom as $R^{43}$ include, for example, an alkyl, an alkenyl, an aralkyl, an aryl, an acyl, an alkylsulfonyl, a heterocyclic ring etc., which may be bound via a double bond and may form a ring. Examples of $R^{43}$ include, for example, dimethylamino, diethylamino, N-methylanilino, 1-piperidino, 1-morpholino, N-methyl-2-pyridinoamino, benzylideneimino, dibenzylamino, N-acetylmethylamino, benzylamino, acetamino, N-methylsulfonylamino, N-methylureido, 3-methylbenzothiazolideneimino and so forth, and examples of the alkoxyl group include methoxy group, ethoxy group and so forth.

However, at least one of $R^{41}$, $R^{42}$ and $R^{43}$ has at least one water-soluble group. The water-soluble group referred to herein means a substituent containing sulfo group (or a salt thereof), carboxyl group (or a salt thereof), hydroxyl group, mercapto group, amino group, ammonio group, sulfonamido group, an acylsulfamoyl group, sulfonylsulfamoyl group, an active methine group or a group containing any of these groups, preferably sulfo group (or a salt thereof), carboxyl group (or a salt thereof), hydroxyl group, amino group or the like.

As for the counter ion represented by X, when an intramolecular salt can be formed, X does not exist, when two acidic groups (sulfo, sulfate, carboxyl etc.) exist in the molecule, it represents a cation such as those of an alkali metal atom, organic ammonium etc. $L^{11}$ to $L^{19}$ each independently represent a methine group, which may be substituted with an alkyl, an aryl, an alkoxy or the like.

Specific examples of the compounds represented by the formula (II) are listed below. However, the compounds that can be used for the present invention are not limited to these.

II-1
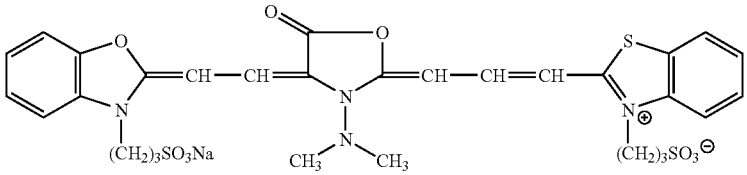
II-2
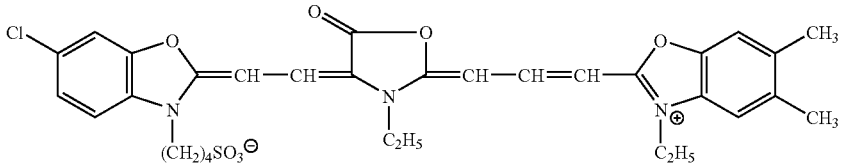
II-3
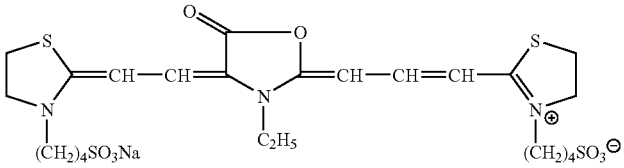
II-4
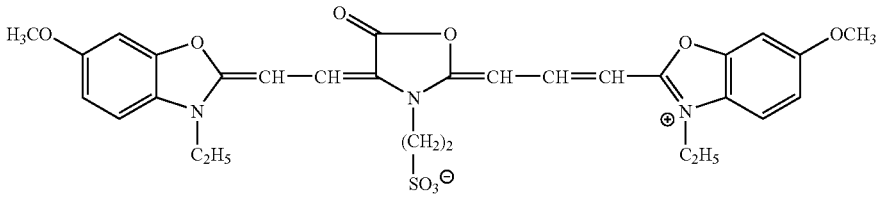
II-5
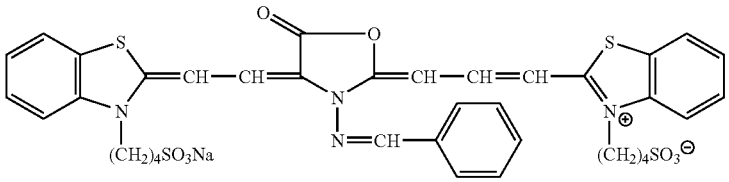
II-6
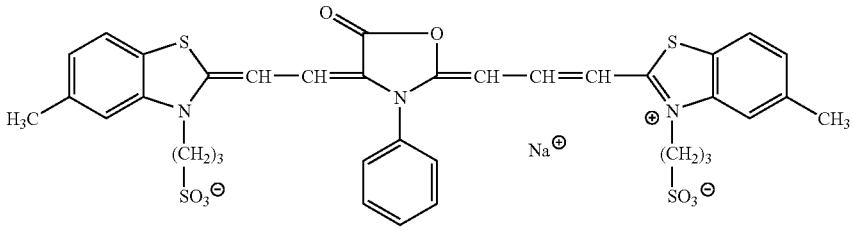
II-7
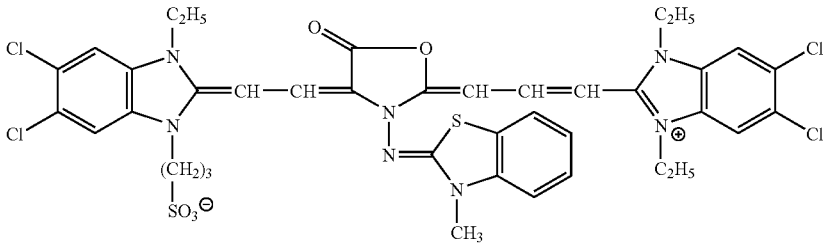

-continued
II-8
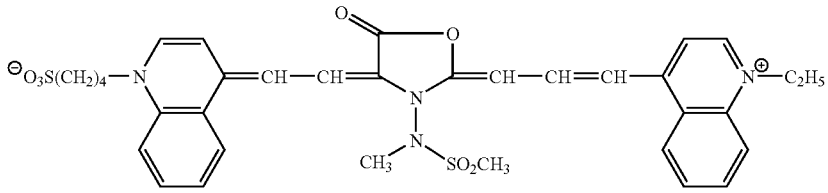
II-9
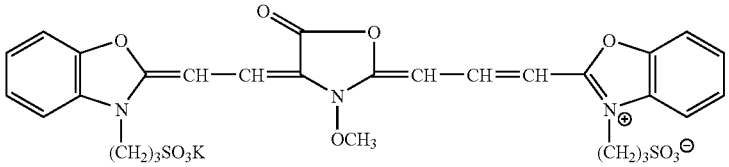
II-10
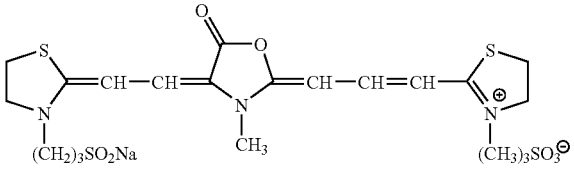
II-11
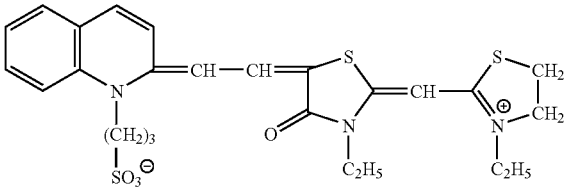
II-12
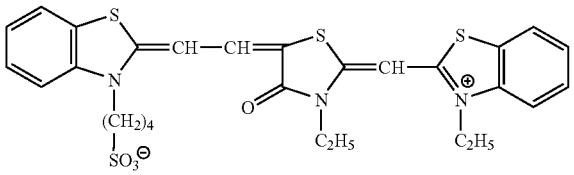
II-13
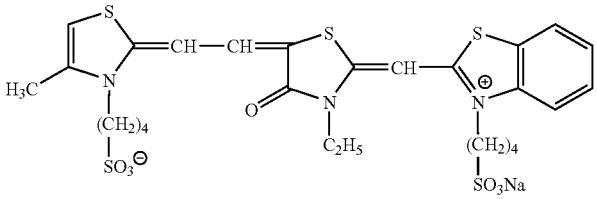
II-14
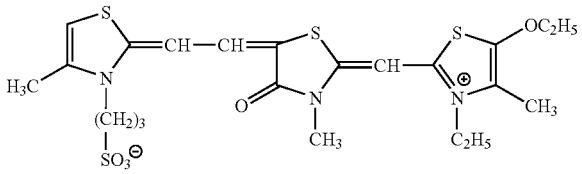
II-15
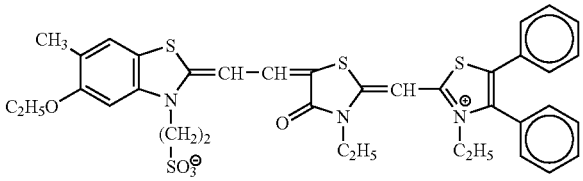
II-16
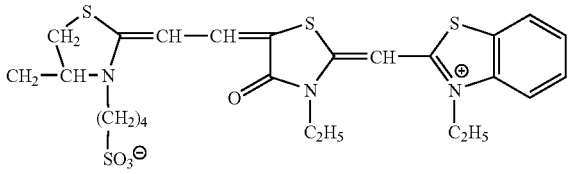
II-17
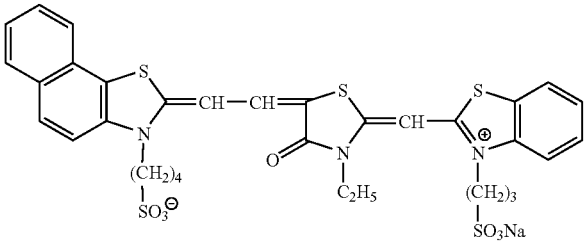
II-18
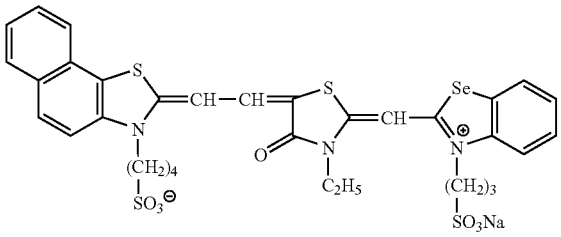
II-19
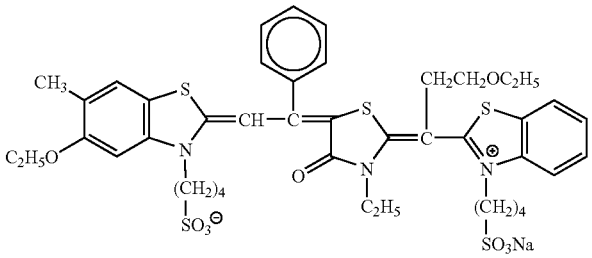

-continued

II-20

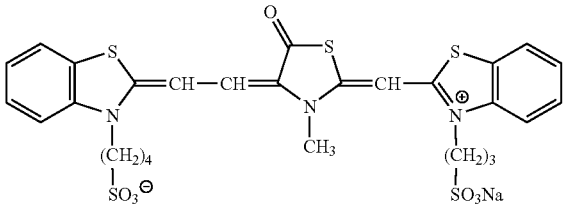

II-21

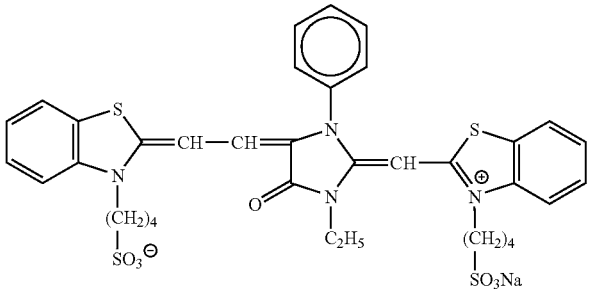

The compounds represented by the aforementioned formula (I) or (II) can be synthesized by the methods described in F. M. Hamer, "Heterocyclic Compounds—Cyanine Dyes and Related Compounds" (John Wiley & Sons, New York, London, published on 1964; D. M. Sturmer, "Heterocyclic Compounds—Special Topics in Heterocyclic Chemistry—", Chapter 18, Section 14, pages 482-515, John Wiley & Sons, New York, London, published on 1977; "Rodd's Chemistry of Carbon Compounds" 2nd Ed., Vol. IV, Part B, published on 1977, Chapter 15, pages 369-422 and 2nd Ed., vol. IV, Part B, published on 1985, Chapter 15, pages 267-296, published by Elsevier Science Publishing Company Inc., New York, etc.

Hereafter, the sensitizing dyes represented by the formula (III) will be explained in detail. In the formula (III), $Y^{21}$, $Y^{22}$ and $Y^{23}$ each independently represent a —N($R^{24}$)-group, oxygen atom, sulfur atom or selenium atom.

Examples of the water-solubilizing group substituting on $R^{21}$, $R^{22}$ or $R^{23}$ include, for example, an acidic group such as sulfo group, carboxyl group, phosphono group, sulfato group and sulfino group.

Examples of the aliphatic group represented by $R^{21}$, $R^{22}$ or $R^{23}$ include, for example, a linear or branched alkyl group having 1 to 10 carbon atoms (e.g., methyl, ethyl, n-propyl, n-pentyl, isobutyl etc.), an alkenyl groups having 3 to 10 carbon atoms (e.g., 3-butenyl, 2-propenyl etc.) and an aralkyl group having 3 to 10 carbon atoms (e.g., benzyl, phenethyl etc.).

Examples of the aryl group represented by $R^{22}$, $R^{23}$ or $R^{24}$ include, for example, phenyl group, and examples of the heterocyclic group represented by $R^{22}$, $R^{23}$ or $R^{24}$ include, for example, a pyridyl group (2-, 4-), a furyl group (2-), a thienyl group (2-), a sulfolanyl group, a tetrahydrofuryl group, a piperidinyl group and so forth.

Each of the groups of $R^{21}$, $R^{22}$ and $R^{23}$ may be substituted with a substituent such as a halogen atom (e.g., fluorine atom, chlorine atom, bromine atom etc.), an alkoxyl group (e.g., methoxy group, ethoxy group etc.), an aryloxy group (e.g., phenoxy group, p-tolyloxy group etc.), cyano group, a carbamoyl groups (e.g., carbamoyl group, N-methylcarbamoyl group, N,N-tetramethylenecarbamoyl group etc.), a sulfamoyl group (e.g., sulfamoyl group, N,N-3-oxapentamethyleneaminosulfonyl group etc.), methanesulfonyl group, an alkoxycarbonyl group (e.g., ethoxycarbonyl group, butoxycarbonyl group etc.), an aryl group (e.g., phenyl group, carboxyphenyl group etc.) and an acyl group (e.g., acetyl group, benzoyl group etc.).

Specific examples of the aliphatic group substituted with a water-solubilizing group include carboxymethyl, sulfoethyl, sulfopropyl, sulfobutyl, sulfopentyl, 3-sulfobutyl, 6-sulfo-3-oxahexyl, ω-sulfopropoxyaminocarbonylmethyl, ω-sulfopropylaminocarbonylmethyl, 3-sulfinobutyl, 3-phosphonopropyl, 4-sulfo-3-butenyl, 2-carboxy-2-propenyl, o-sulfobenzyl, p-sulfophenethyl, p-carboxybenzyl etc., specific examples of the aryl group substituted with a water-solubilizing group include p-sulfophenyl group, p-carboxyphenyl group etc., and specific examples of the heterocyclic group substituted with a water-solubilizing group include 4-sulfothienyl group, 5-carboxypyridyl group etc.

Examples of the alkyl group represented by $V^{21}$ or $V^{22}$ include a linear or branched alkyl group (e.g., methyl, ethyl, isopropyl, tert-butyl, isobutyl, tert-pentyl, hexyl etc.). Examples of the alkoxyl group represented by $V^{21}$ or $V^{22}$ include, for example, methoxy, ethoxy, propoxy etc.

The aryl group represented by $V^{21}$ or $V^{22}$ may have a substituent at an arbitrary position, and examples include, for example, phenyl, p-tolyl, p-hydroxyphenyl, p-methoxyphenyl etc. Examples of the condensed ring formed by $V^{21}$ and $V^{22}$ binding to each other together with the azole ring include, for example, condensed rings of benzoxazole, 4,5,6,7-tetrahydrobenzoxazole, naphtho[1,2-d]oxazole, naphtho[2,3-d]oxazole, benzothiazole, 4,5,6,7-tetrahydrobenzothiazole, naphtho[1,2-d]thiazole, naphtho[2,3-d]thiazole, benzoselenazole, naphtho[1,2-d]selenazole and so forth.

The aforementioned substituents represented by $V^{21}$ or $V^{22}$ and the condensed rings formed with $V^{21}$ or $V^{22}$ may have a substituent at an arbitrary position, and examples of the substituent include arbitrary groups including, for example, a halogen atom (fluorine atom, chlorine atom, bromine atom, iodine atom), trifluoromethyl group, an alkoxyl group (e.g., an unsubstituted alkoxyl group such as methoxy, ethoxy and butoxy, and a substituted alkoxy group such as 2-methoxyethoxy and benzyloxy), hydroxyl group, cyano group, an aryloxy group (e.g., a substituted or unsubstituted aryloxy group such as phenoxy and tolyloxy), an aryl group (e.g., a substituted or unsubstituted aryl group such as phenyl and p-chlorophenyl), stilyl group, a heterocyclic group (e.g., furyl, thienyl etc.), a carbamoyl group (e.g., carbamoyl, N-ethylcarbamoyl etc.), a sulfamoyl group (e.g., sulfamoyl, N,N-dimethylsulfamoyl etc.), an acylamino group (e.g., acetylamino, propionylamino, benzoylamino etc.), an acyl group (e.g., acetyl, benzoyl etc.), an alkoxycarbonyl group (e.g., ethoxycarbonyl etc.), a sulfonamido group (e.g., methanesulfonylamido, benzenesulfonamido etc.), a sulfonyl group (e.g., methanesulfonyl, p-toluenesulfonyl etc.), carboxyl group and so forth.

Examples of the group substituting on the carbon atom of the methine group represented by $L^{21}$or $L^{22}$ include, for example, a lower alkyl group (e.g., methyl, ethyl etc.), a phenyl group (e.g., phenyl, carboxyphenyl etc.), an alkoxyl group (e.g., methoxy, ethoxy etc.), an aralkyl group (e.g., benzyl etc.) and so forth.

$M^{21}$ represents a cation or an acid anion. Examples of the cation include proton, an organic ammonium ion (e.g., triethylammonium, triethanolammonium etc.) and an inorganic cation (e.g., those of lithium, sodium, calcium etc.), and examples of the acid anion include, for example, a halogen ion (e.g., chloride ion, bromide ion, iodide ion etc.), p-toluenesulfonate ion, perchlorate ion, 4-fluoroboron ion etc. When an intramolecular salt is formed and the total intramolecular charge is offset, $n^{21}$ is 0.

In the formula (III), it is preferred that $R^{21}$ is an alkyl group substituted with sulfo group, and at least two of $R^{22}$, $R^{23}$ and $R^{24}$ represent carboxymethyl.

Specific examples of the sensitizing dyes represented by the formula (III) will be listed below. However, the compounds that can be used for the present invention are not limited to these compounds.

III-1

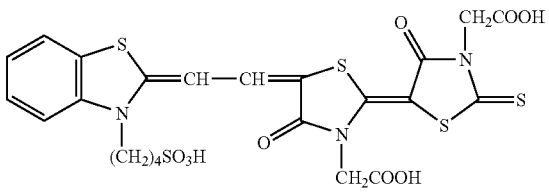

$[N(C_2H_5)_3]_2$

III-2

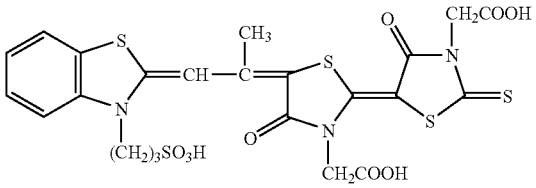

$N(C_2H_5)_3$

III-3

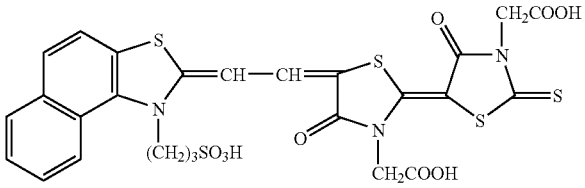

$N(C_2H_5)_3$

III-4

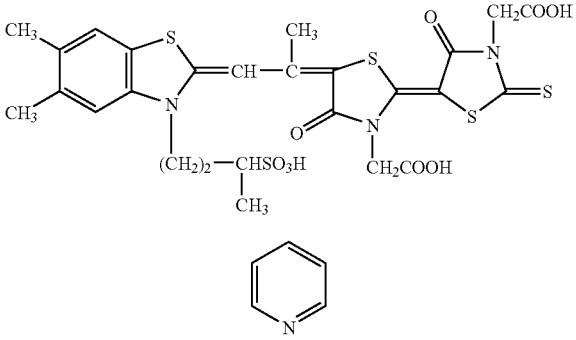

-continued

III-5

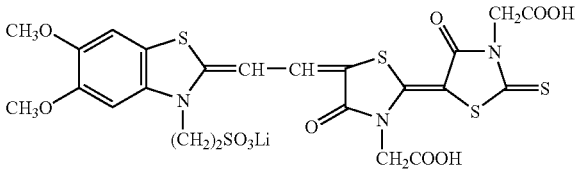

III-6

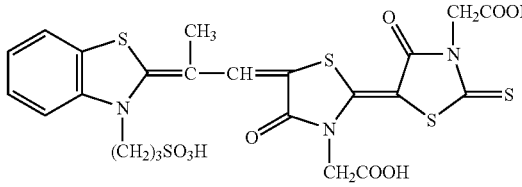

$[N(C_2H_5)_3]_3$

III-7

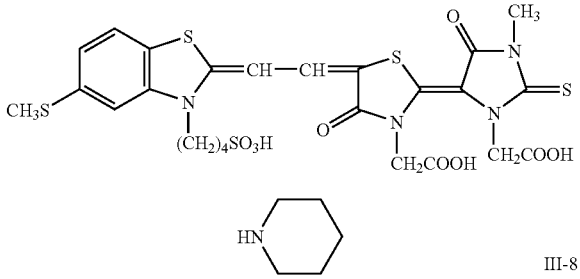

III-8

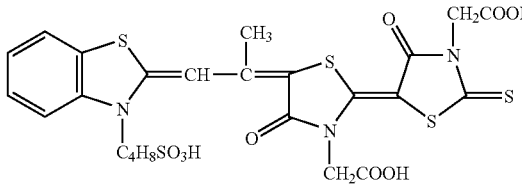

III-9

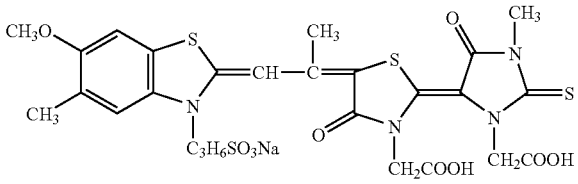

III-10

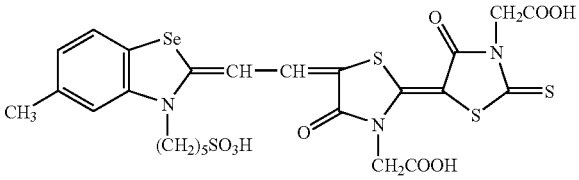

III-11

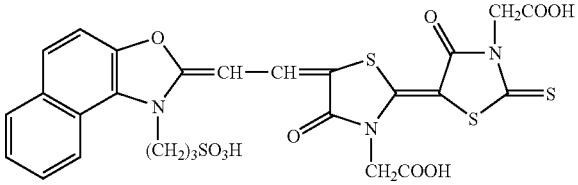

$N(C_2H_5)_3$

-continued
III-12
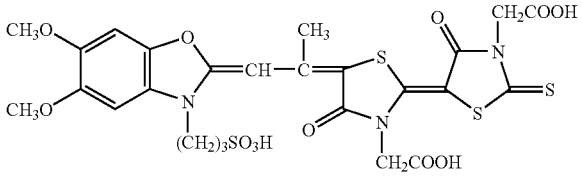
$N(C_2H_5)_3$
III-13
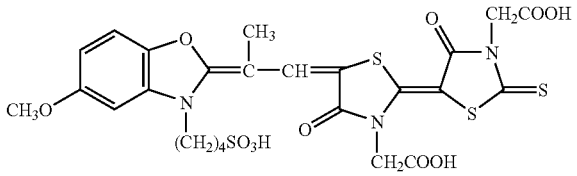
III-14
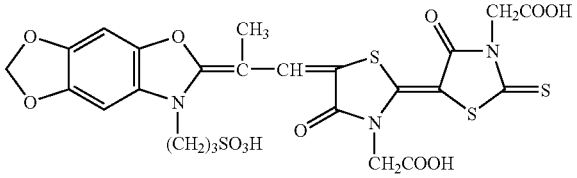
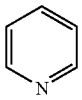
III-15
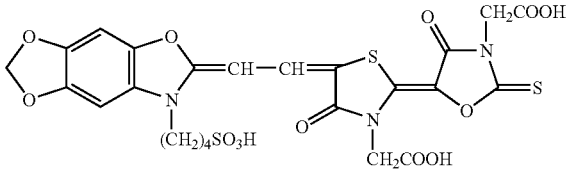
$[N(C_2H_5)_3]_3$
III-16
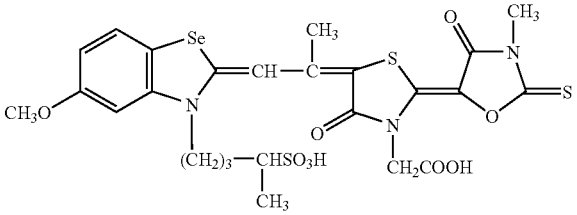
$N(C_2H_5)_3$
III-17
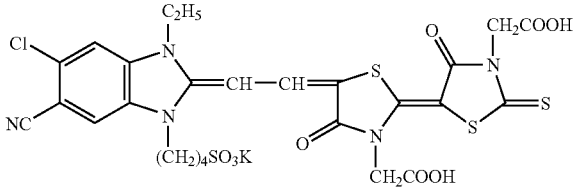
-continued
III-18
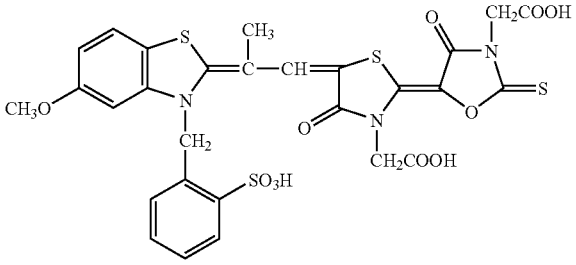
$N(CH_2CH_2OH)_3$
III-19
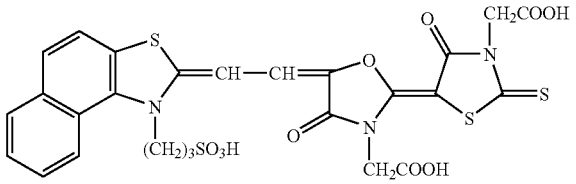
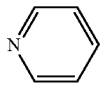
III-20
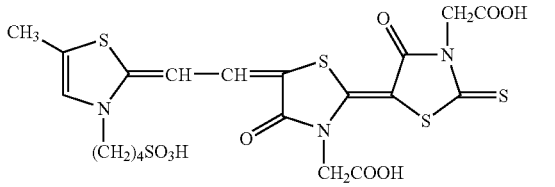
$N(C_2H_5)_3$
III-21
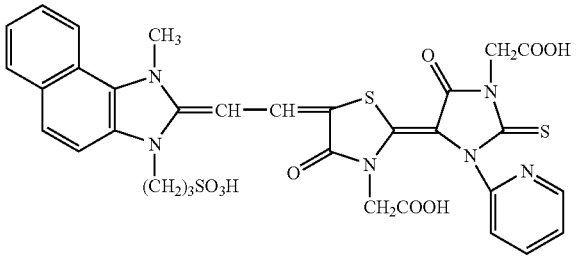
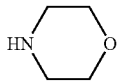
III-22
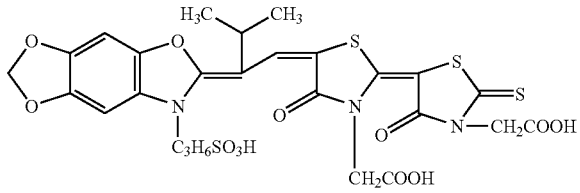
$3N(C_2H_5)_3$ -continued
III-23
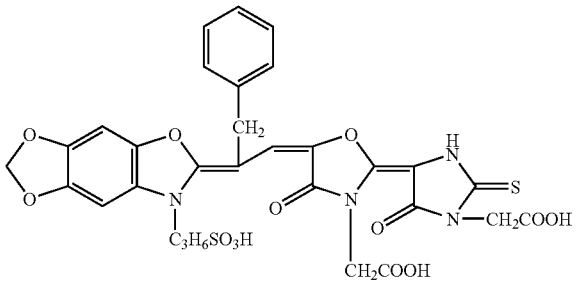
$3N(C_2H_5)_3$
III-24
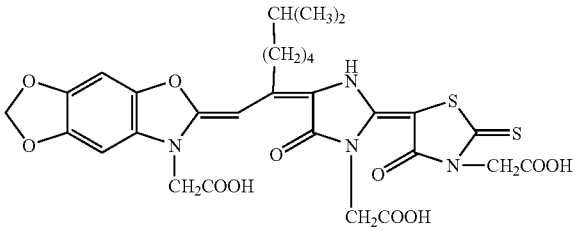
$3N(C_2H_5)_3$
III-25
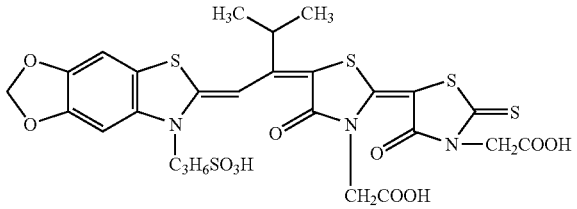
$3N(C_2H_5)_3$
III-26
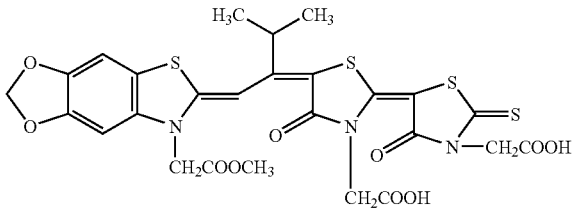
$3N(C_2H_5)_3$
III-27
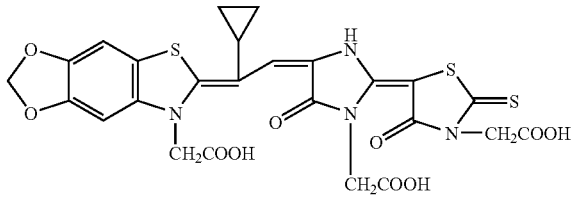
$3N(C_2H_5)_3$
-continued
III-28
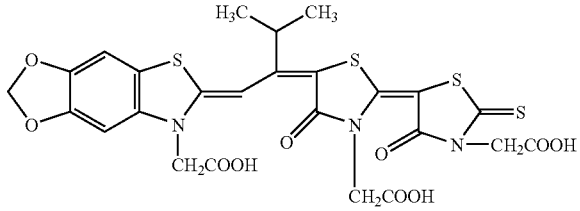
$3N(C_2H_5)_3$
III-29
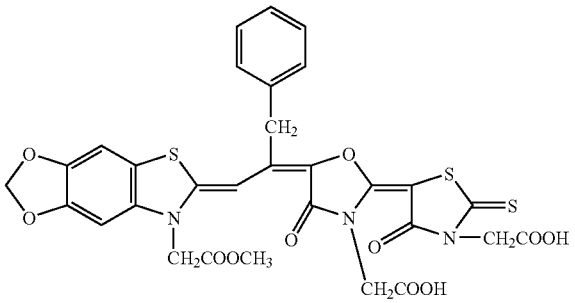
$3N(C_2H_5)_3$
III-30
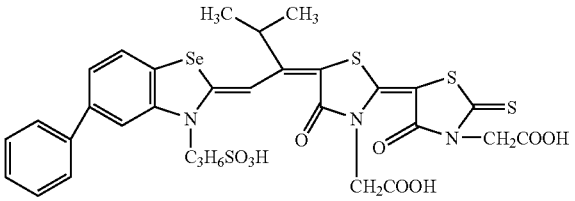
$3N(C_2H_5)_3$
III-31
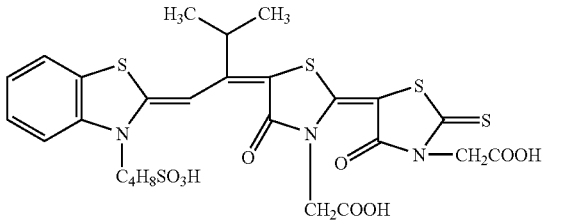
$3N(C_2H_5)_3$
III-32
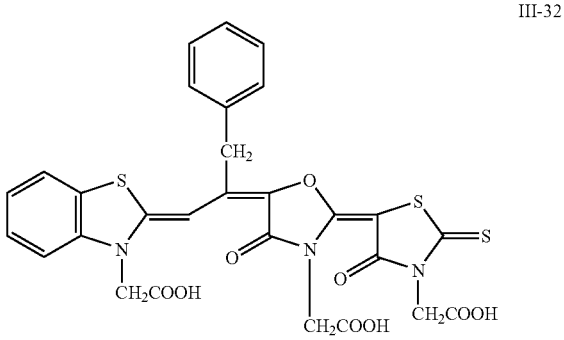
$3N(C_2H_5)_3$ -continued
III-33
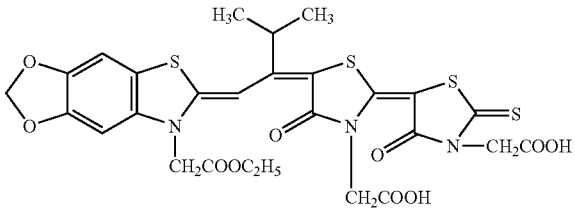
$3N(C_2H_5)_3$
III-34
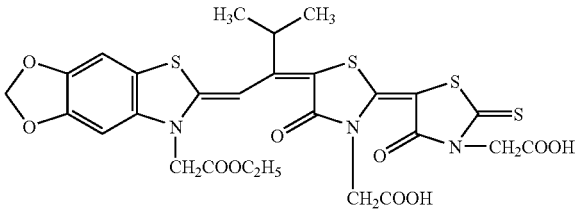
$3N(C_2H_5)_3$
III-35
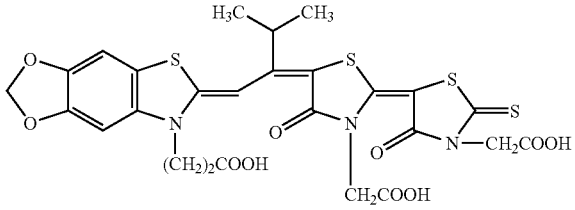
$3N(C_2H_5)_3$
III-36
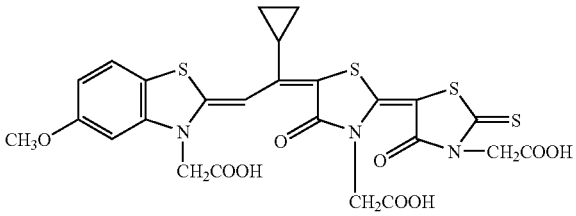
$3N(C_2H_5)_3$
III-37
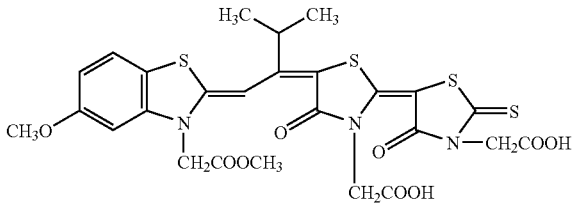
$3N(C_2H_5)_3$
-continued
III-38
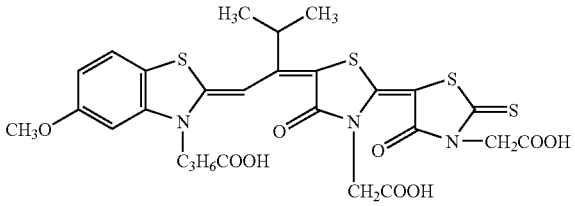
$3N(C_2H_5)_3$
III-39
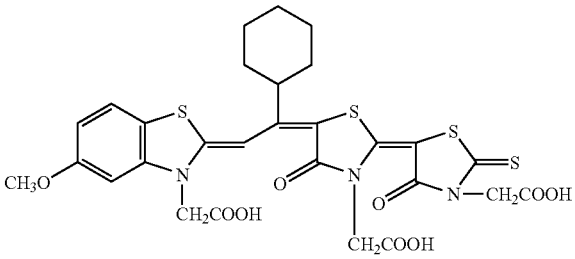
$3N(C_2H_5)_3$
III-40
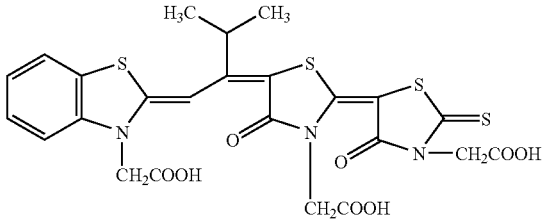
$3N(C_2H_5)_3$
III-41
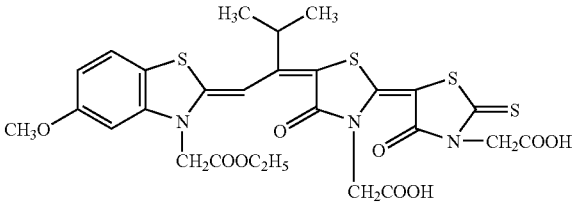
$3N(C_2H_5)_3$
III-42
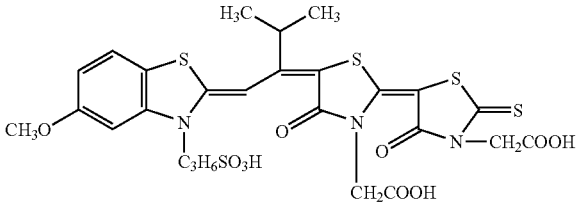
$3N(C_2H_5)_3$ -continued

III-43

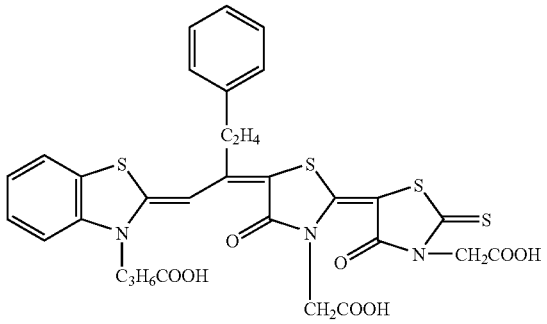

$3N(C_2H_5)_3$

III-44

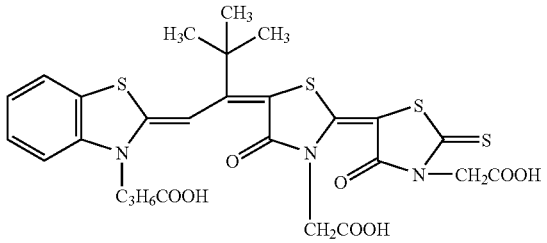

$3N(C_2H_5)_3$

III-45

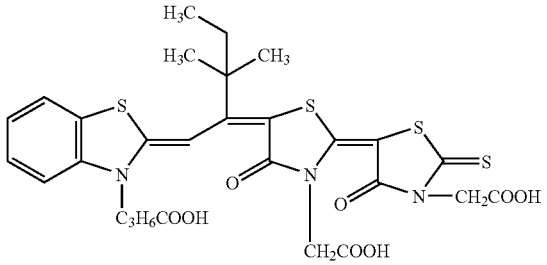

$3N(C_2H_5)_3$

III-46

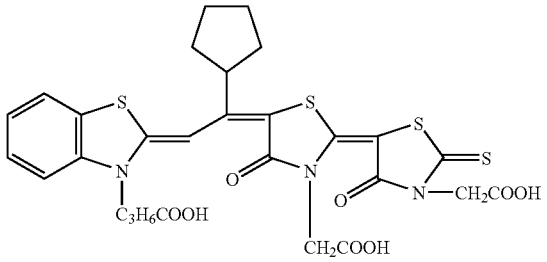

$3N(C_2H_5)_3$

The sensitizing dyes represented by the formula (III) can be readily synthesized by referring to the known methods described in, for example, F. M. Hamer, "Cyanine Dyes and Related Compounds" (published by Interscience Publishers, 1964), U.S. Pat. Nos. 2,454,629, 2,493,748, JP-A-10-219125 and so forth.

Further, in the formula (IV), examples of the aliphatic group represented by $R^1$, $R^2$, $R^3$ or $R^5$ include, for example, a linear or branched alkyl group having 1 to 10 carbon atoms (e.g., methyl, ethyl, n-propyl, n-pentyl, isobutyl etc.), an alkenyl group having 3 to 10 carbon atoms (e.g., 3-butenyl, 2-propenyl etc.), an aralkyl group having 3 to 10 carbon atoms (e.g., benzyl, phenethyl etc.) and so forth.

Examples of the aryl group represented by $R^1$, $R^2$, $R^3$ or $R^5$ include, for example, a phenyl group, and examples of the heterocyclic group represented by $R^1$, $R^2$, $R^3$ or $R^5$ include, for example, a pyridyl group (2-, 4-), a furyl group (2-), a thienyl group (2-), a sulfolanyl group, a tetrahydrofuryl group, a piperidinyl group and so forth. Each of the groups of $R^1$, $R^2$, $R^3$and $R^5$ may be substituted with a substituent such as a halogen atom (e.g., fluorine atom, chlorine atom, bromine atom etc.), an alkoxyl group (e.g., methoxy group, ethoxy group etc.), an aryloxy group (e.g., phenoxy group, p-tolyloxy group etc.), cyano group, a carbamoyl group (e.g., carbamoyl group, N-methylcarbamoyl group, N,N-tetramethylenecarbamoyl group etc.), a sulfamoyl group (e.g., sulfamoyl group, N,N-3-oxapentamethyleneaminosulfonyl group etc.), methanesulfonyl group, an alkoxycarbonyl group (e.g., ethoxycarbonyl group, butoxycarbonyl group etc.), an aryl group (e.g., phenyl group, carboxyphenyl group etc.) and an acyl group (e.g., acetyl group, benzoyl group etc.).

Examples of the a water-solubilizing group substituting on $R^1$, $R^2$, $R^3$, $R^4$ or $R^5$ include an acidic group such as sulfo group, carboxyl group, phosphono group, a sulfite group ($—SO(OR)_2$ where two of R may be the same or different and represent a group imparting water-solubility such as hydrogen atom or an alkali metal atom) and sulfino group.

Specific examples of the aliphatic group substituted with the water-solubilizing group include carboxymethyl, sulfoethyl, sulfopropyl, sulfobutyl, sulfopentyl, 3-sulfobutyl, 6-sulfo-3-oxahexyl, ω-sulfopropoxycarbonylmethyl, ω-sulfopropylaminocarbonylmethyl, 3-sulfinobutyl, 3-phosphonopropyl, 4-sulfo-3-butenyl, 2-carboxy-2-propenyl, o-sulfobenzyl, p-sulfophenethyl, p-carboxybenzyl etc., specific examples of the aryl group substituted with the water-solubilizing group include p-sulfophenyl group, p-carboxyphenyl group etc., and specific examples of the heterocyclic group substituted with the water-solubilizing group include 4-sulfothienyl group, 5-carboxypyridyl group etc.

In the formula (IV), it is preferred that $R^1$ is an alkyl group substituted with sulfo group, and any two of $R^2$, $R^3$ and $R^5$ represent carboxymethyl group.

The 5- or 6-membered nitrogen-containing heterocyclic ring and the condensed ring of the 5- or 6-membered nitrogen-containing heterocyclic ring which may have a condensed ring represented by $Z^1$ may have a substituent at an arbitrary position, and examples of the substituent include arbitrary groups such as a halogen atom (fluorine atom, chlorine atom, bromine atom, iodine atom), trifluoromethyl group, an alkoxyl group (e.g., an unsubstituted alkoxyl group such as methoxy, ethoxy and butoxy, and a substituted alkoxyl group such as 2-methoxyethoxy and benzyloxy), hydroxyl group, cyano group, an aryloxy group (e.g., a substituted or unsubstituted aryloxy group such as phenoxy and tolyloxy), an aryl group (e.g., a substituted or unsubstituted aryl group such as phenyl and p-chlorophenyl), stilyl group, a heterocyclic group (e.g., furyl, thienyl etc.), a carbamoyl group (e.g., carbamoyl, N-ethylcarbamoyl etc.), a sulfamoyl group (e.g., sulfamoyl, N,N-dimethylsulfamoyl etc.), an acylamino group (e.g., acetylamino, propionylamino, benzoylamino etc.), an acyl group (e.g., acetyl, benzoyl etc.), an alkoxycarbonyl group (e.g., ethoxycarbonyl etc.), a sulfonamido group (e.g., methanesulfonylamido, benzenesulfonamido etc.), a sulfonyl group (e.g., methanesulfonyl, p-toluenesulfonyl etc.) and carboxyl group.

Examples of the group substituting on the methine group represented by $L^1$ or $L^2$ include, for example, groups including a lower alkyl group (e.g., methyl, ethyl etc.), a phenyl group (e.g., phenyl, carboxyphenyl etc.), an alkoxyl group (e.g., methoxy, ethoxy etc.), an aralkyl group (e.g., benzyl etc.) and so forth.

When either one of the carbon atoms of the methine groups represented by $L^1$ and $L^2$ is substituted, the sensitizing dyes represented by the formula (IV) generally show high spectral sensitivity and a characteristic that they are likely to be breached in a processing bath and exhibit a preferred effect of reduced staining with residual color.

$M^1$ represents a cation or an acid anion. Examples of the cation include proton, an organic ammonium ion (e.g., triethylammonium, triethanolammonium etc.) and an inorganic cation (e.g., those of lithium, sodium, calcium etc.), and examples of the acid anion include, for example, a halogen ion (e.g., chloride ion, bromide ion, iodide ion etc.), p-toluenesulfonate ion, perchlorate ion, 4-fluoroboron ion etc. When an intramolecular salt is formed and the total intramolecular charge is offset, $n^1$ is 0.

The electron-withdrawing group represented by $E^1$ or $E^2$ is chosen from groups having a Hammett's sp value of 0.3 or larger. Specific examples include cyano group, a carbamoyl group (e.g., carbamoyl group, morpholinocarbonyl group, N-methylcarbamoyl group etc.), an alkoxycarbonyl group (e.g., methoxycarbonyl group, ethoxycarbonyl group etc.), a sulfamoyl group (e.g., sulfamoyl group, morpholinosulfonyl group, N,N-dimethylsulfamoyl group etc.), an acyl group (e.g., acetyl group, benzoyl group etc.), a sulfonyl group (e.g., methanesulfonyl group, ethanesulfonyl group, benzenesulfonyl group, toluenesulfonyl group etc.) and so forth.

The Hammett's sp value is a substituent constant obtained by Hammett et al. from electronic effect of substituent exerted on hydrolysis of benzoic acid ester, and is detailed in Journal of Organic Chemistry, vol.23, pp.420-427 (1958); Jikken Kagaku Koza (Lecture of Experimental Chemistry), vol. 14 (Maruzen Shuppan); Physical Organic Chemistry (McGraw Hill Book, 1940); Drug Design, vol. VII (Academic Press, New York, 1976); Yakubutsu no Kozo Kassei Sokan (Relationship of Structural Activities of Drugs (Nankodo, 1979) and so forth.

Examples of the $=C(E^1)-(E^2)$ group in which $E^1$ and $E^2$ bind to each other to form a keto ring or acidic heterocyclic ring group include, for example, the groups shown below.

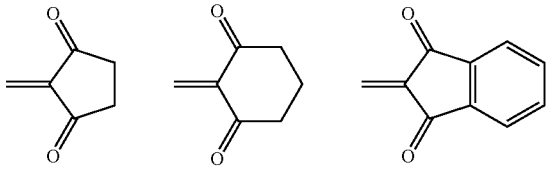

-continued

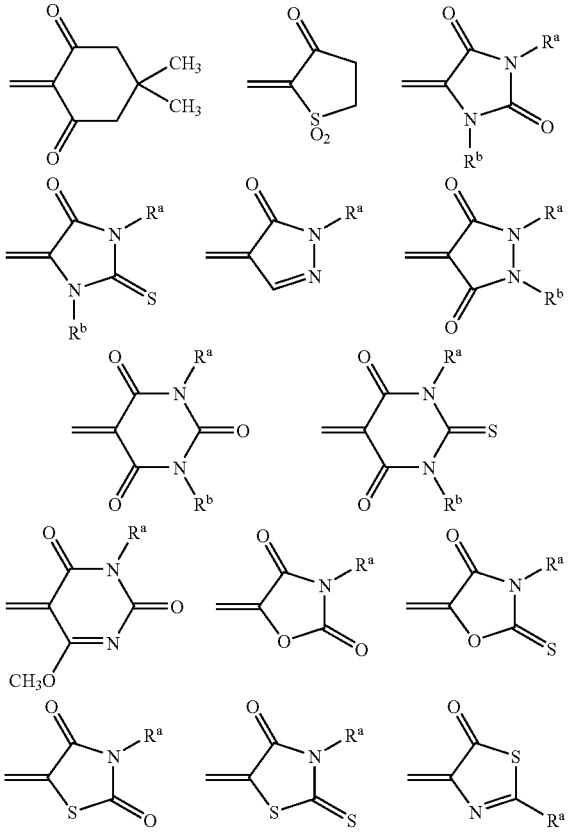

In the aforementioned groups, $R^a$ and $R^b$ each independently represent a lower alkyl group, an aryl group or a heterocyclic group, and specific examples of the lower alkyl group include substituted or unsubstituted groups such as methyl, ethyl, propyl, 2-hydroxyethyl, 2-methoxyethyl, trifluoroethyl, allyl, carboxymethyl, carboxyethyl, 2-sulfoethyl and benzyl. Examples of the aforementioned aryl group and heterocyclic group include, for example, those mentioned for $R^1$ to $R^5$.

$M^1$ represents a cation or an acid anion. Examples of the cation include proton, an organic ammonium ion (e.g., triethylammonium, triethanolammonium etc.) and an inorganic cation (e.g., those of lithium, sodium, potassium etc.), and examples of the acid anion include, for example, a halogen ion (e.g., chloride ion, bromide ion, iodide ion etc.), p-toluenesulfonate ion, perchlorate ion, 4-fluoroboron ion etc. When an intramolecular salt is formed and the total intramolecular charge is offset, $n^1$ is 0.

Specific examples of the sensitizing dyes represented by the formula (IV) will be listed below. However, the present invention is not limited to these.

IV-1

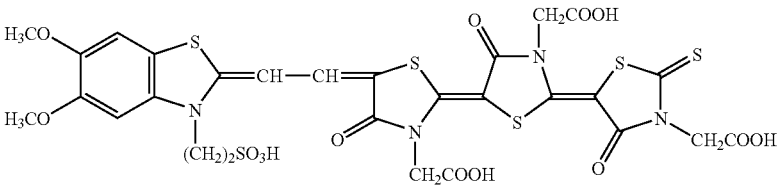

-continued
IV-2
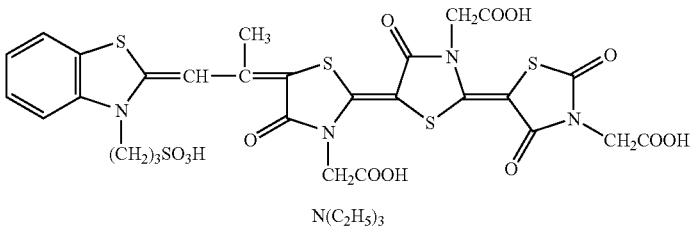
IV-3
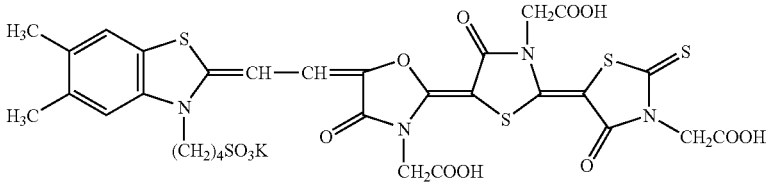
IV-4
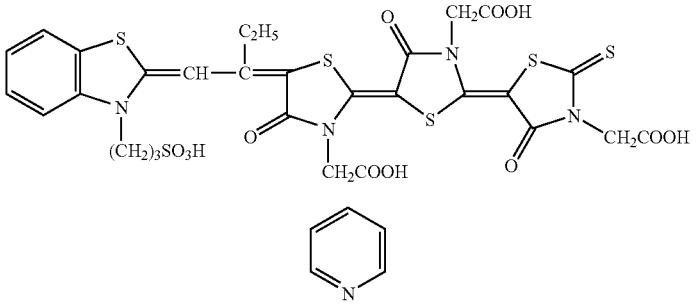
IV-5
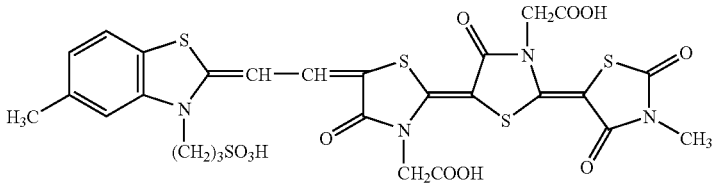
IV-6
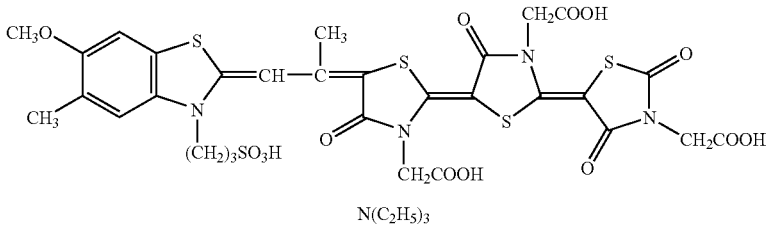
IV-7
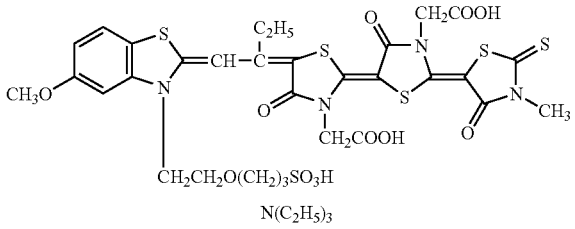
IV-8
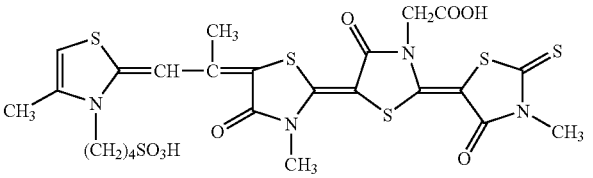

-continued
IV-9
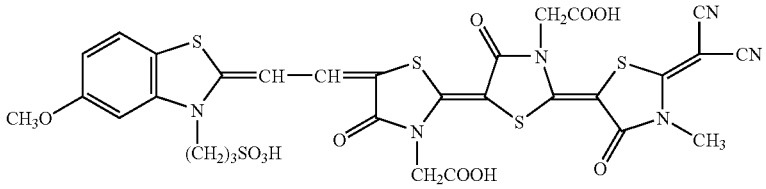
$N(C_2H_5)_3$
IV-10
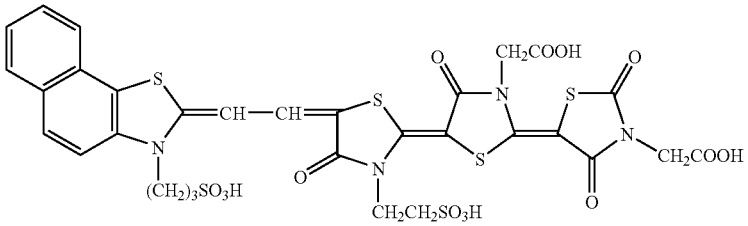
$[N(C_2H_5)_3]_2$
IV-11
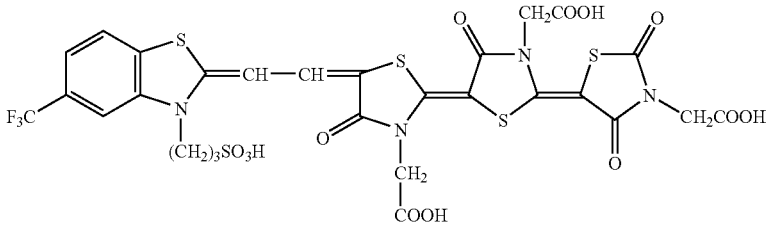
$N(C_2H_5)_3$
IV-12
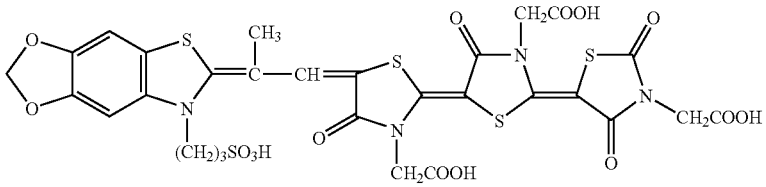
$[N(C_2H_5)_3]_2$
IV-13
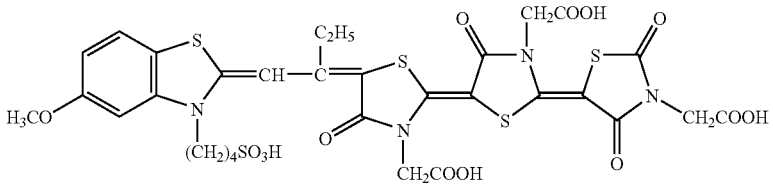
$[N(C_2H_5)_3]_2$
IV-14
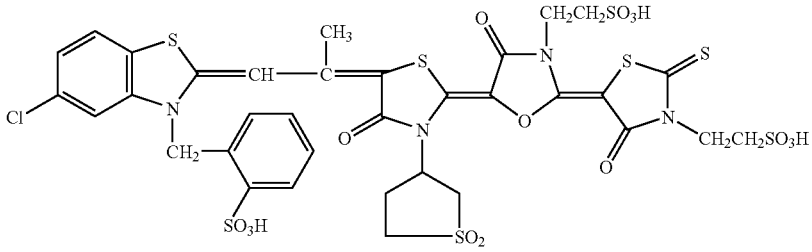
$[N(C_2H_5)_3]_2$ -continued
IV-15
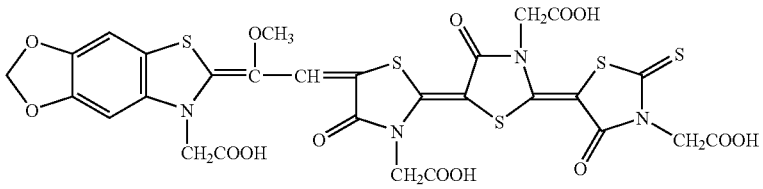
$[N(C_2H_5)_3]_2$
IV-16
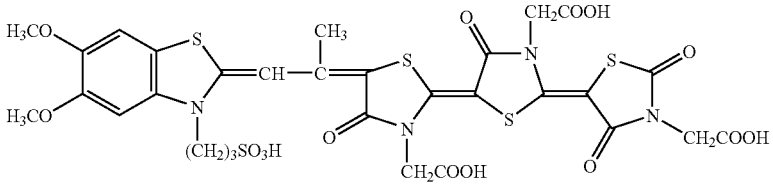
$[N(C_2H_5)_3]_2$
IV-17
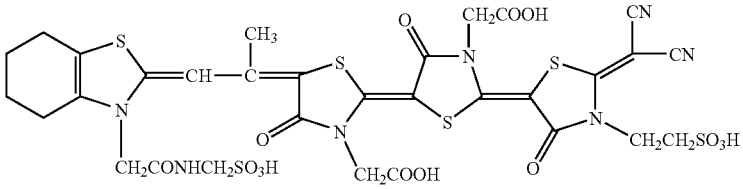
$N(C_2H_5)_3$
IV-18
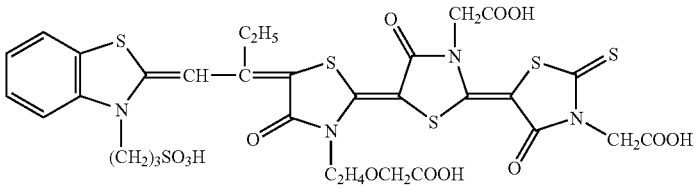
$N(C_2H_5)_3$
IV-19
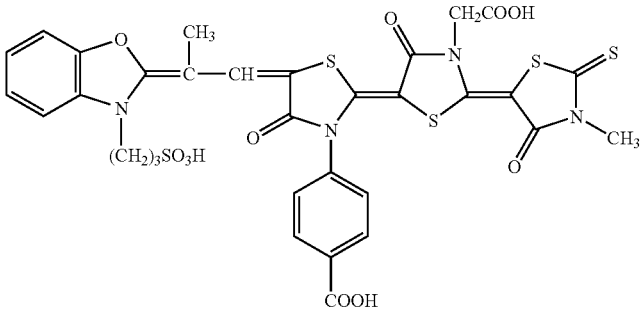
IV-20
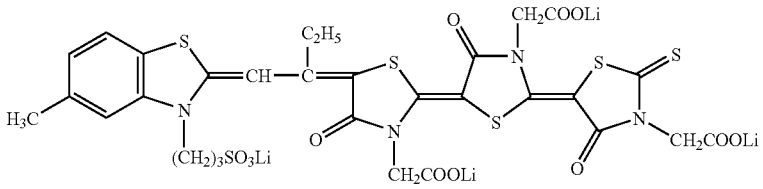

-continued
IV-21
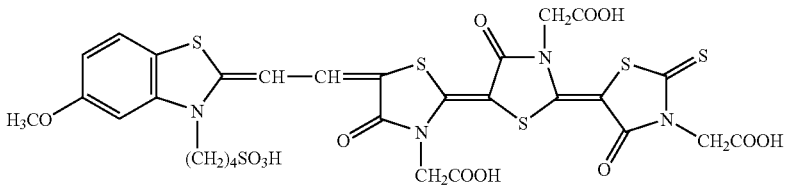
$N(C_2H_5)_3$
IV-22
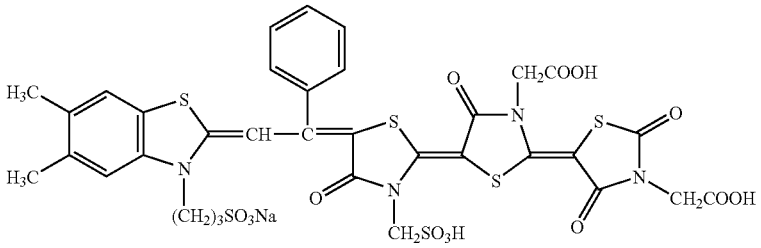
$[N(C_2H_5)_3]_2$
IV-23
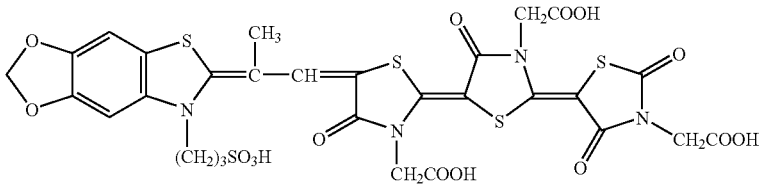
$[N(C_2H_5)_3]_2$
IV-24
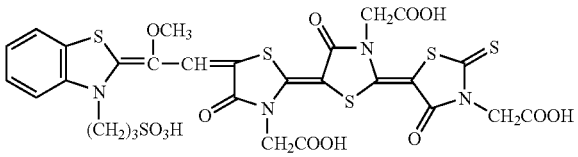
$N(C_2H_5)_3$
IV-25
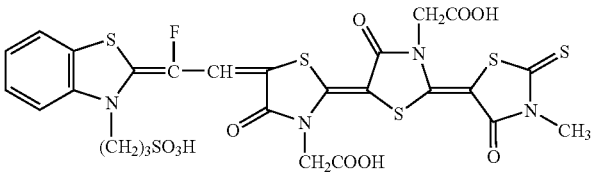
$[N(C_2H_5)_3]_2$
IV-26
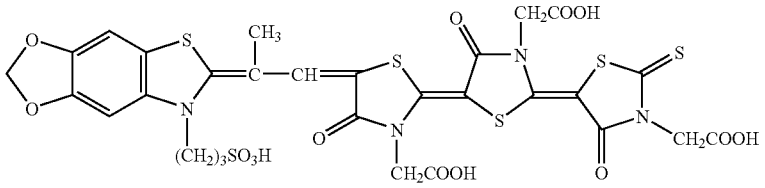
$[N(C_2H_5)_3]_2$
IV-27
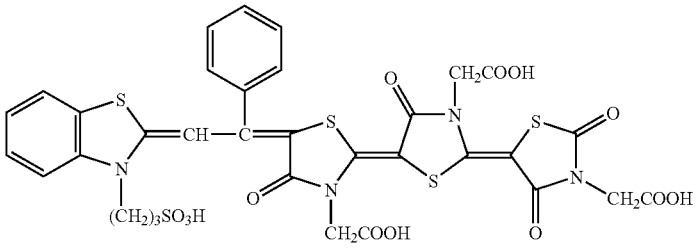
$[N(C_2H_5)_3]_2$ -continued
IV-28
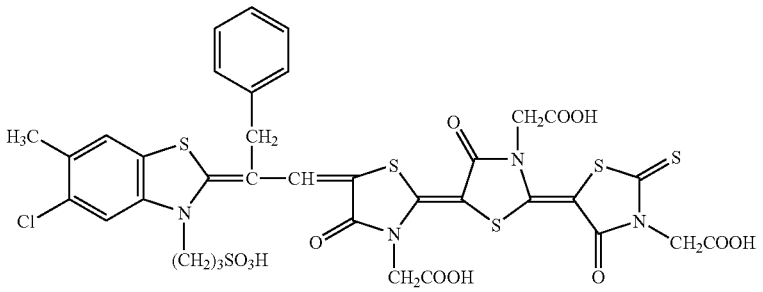
IV-29
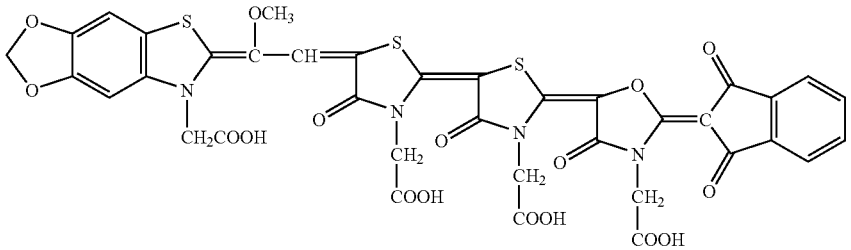
IV-30
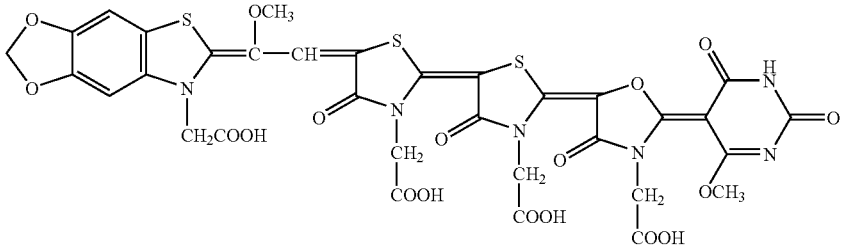
IV-31
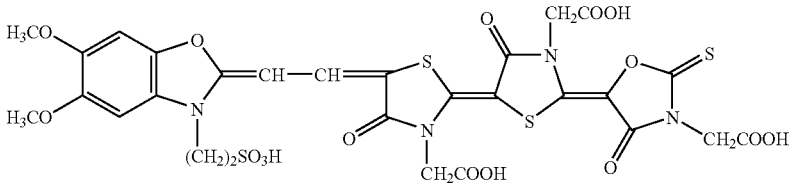
IV-32
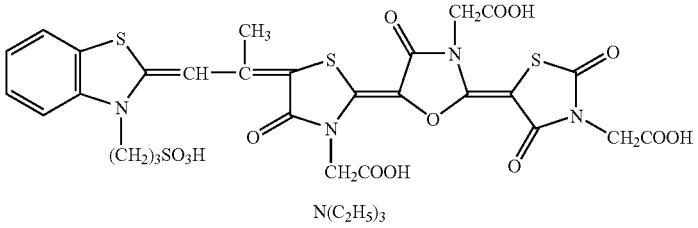
IV-33
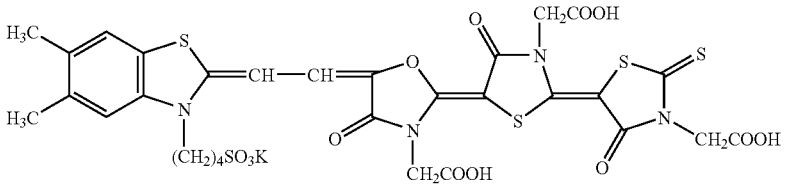

-continued
IV-34
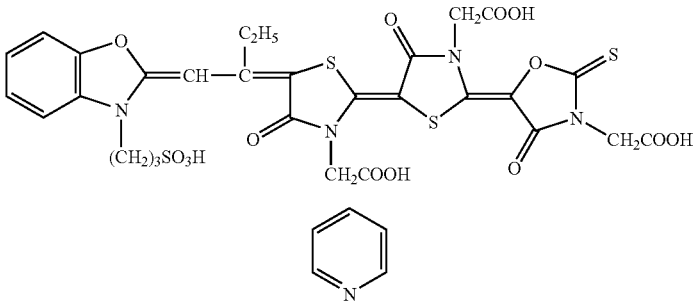
IV-35
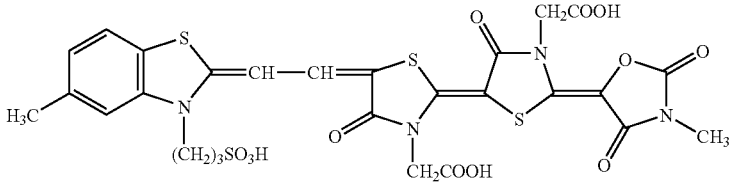
$N(C_2H_5)_3$
IV-36
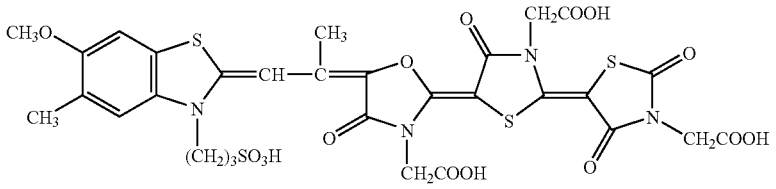
$N(C_2H_5)_3$
IV-37
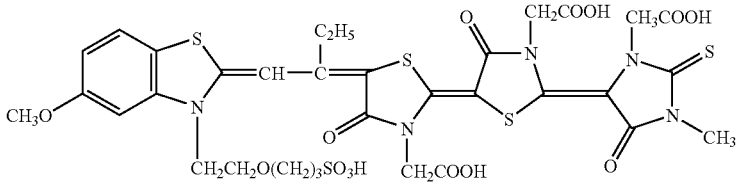
$N(C_2H_5)_3$
IV-38
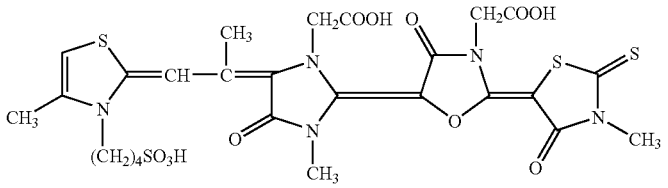
IV-39
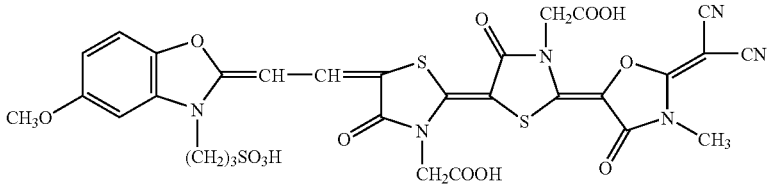
$N(C_2H_5)_3$ -continued
IV-40
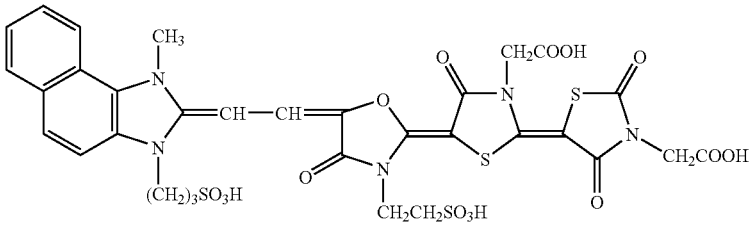
$[N(C_2H_5)_3]_2$
IV-41
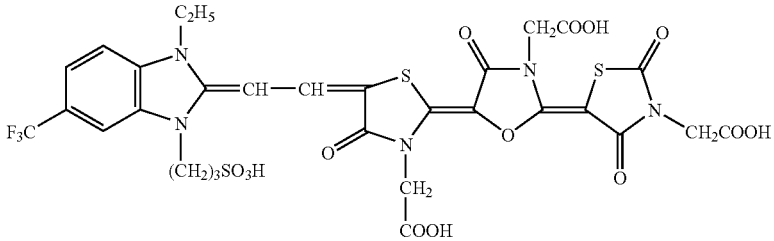
$N(C_2H_5)_3$
IV-42
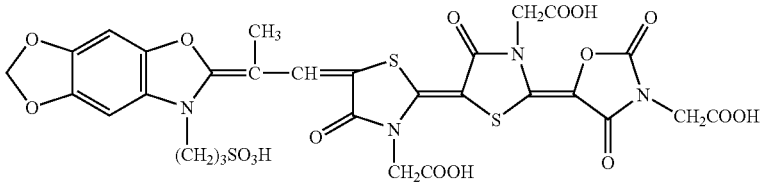
$[N(C_2H_5)_3]_2$
IV-43
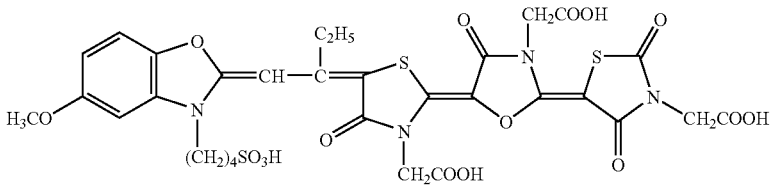
$[N(C_2H_5)_3]_2$
IV-44
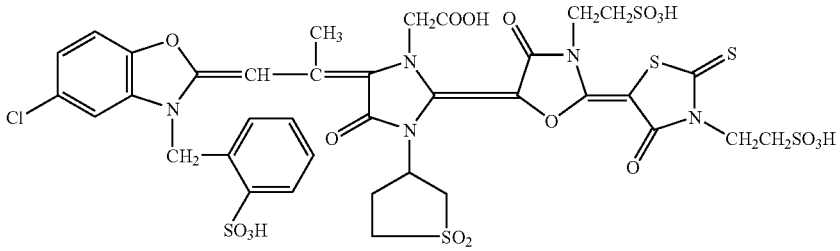
$[N(C_2H_5)_3]_2$
IV-45
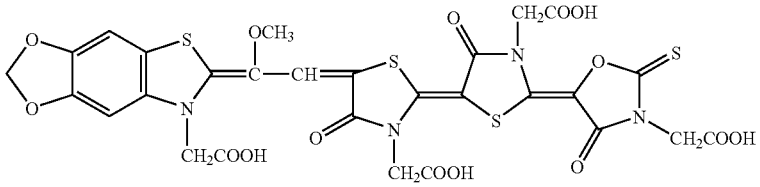
$[N(C_2H_5)_3]_2$ -continued
IV-46
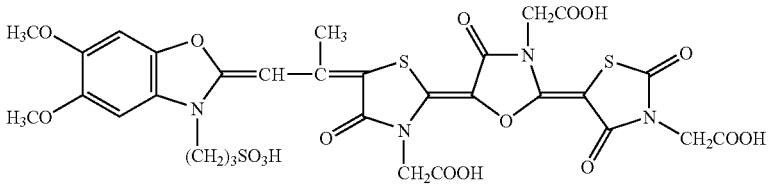
$[N(C_2H_5)_3]_2$
IV-47
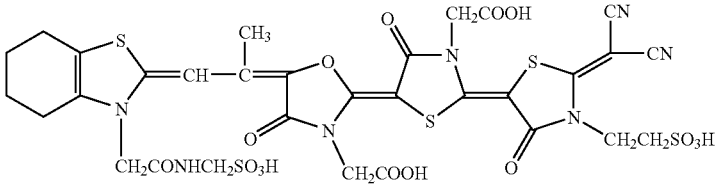
$N(C_2H_5)_3$
IV-48
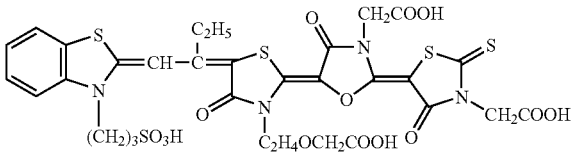
$N(C_2H_5)_3$
IV-49
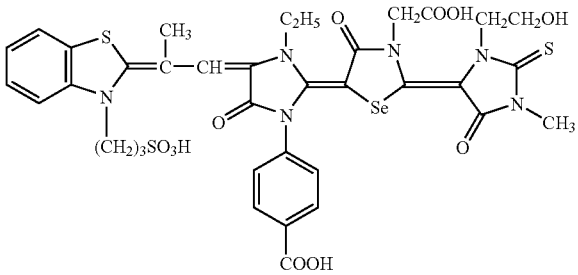
IV-50
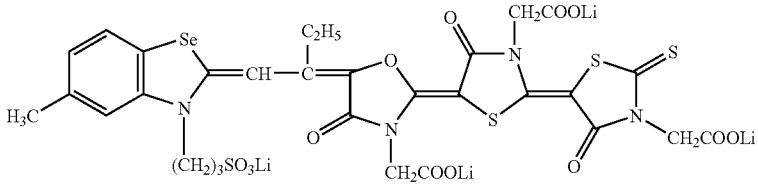
IV-51
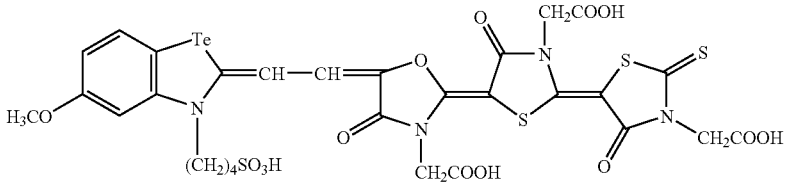
$N(C_2H_5)_3$
IV-52
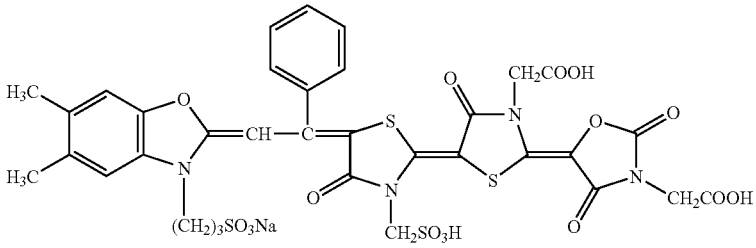
$[N(C_2H_5)_3]_2$ -continued
IV-53
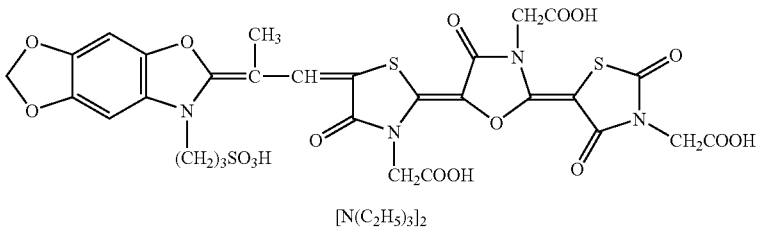
$[N(C_2H_5)_3]_2$
IV-54
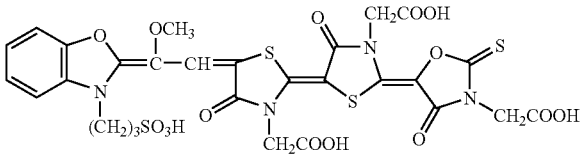
$N(C_2H_5)_3$
IV-55
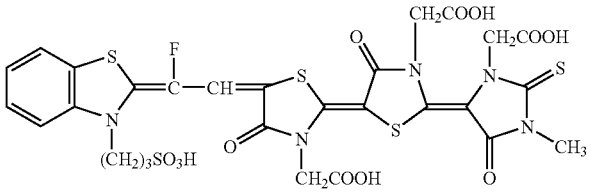
$[N(C_2H_5)_3]_2$
IV-56
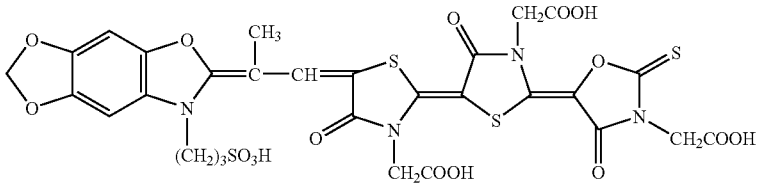
$[N(C_2H_5)_3]_2$
IV-57
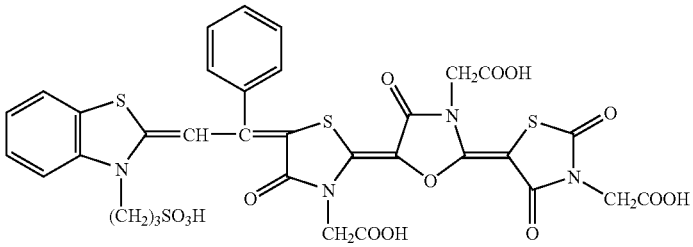
$[N(C_2H_5)_3]_2$
IV-58
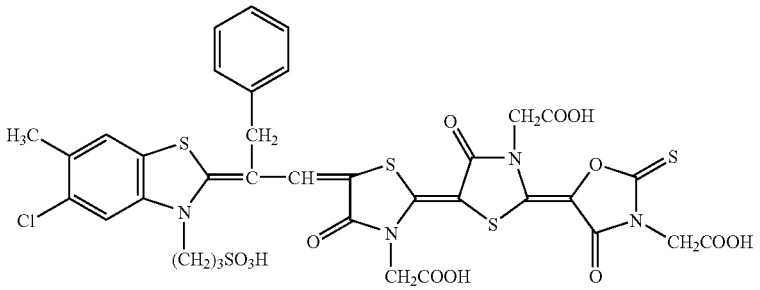
$[N(C_2H_5)_3]_2$
The aforementioned compounds can be readily synthesized by referring to the known methods described in, for example, F. M. Hamer, "Cyanine Dyes and Related Compounds" (published by Interscience Publishers, 1964), U.S. Pat. Nos. 2,454,629, 2,493,748, British Patent No. 489,335, European Patent No. 730,008 and so forth.

These sensitizing dyes may be used individually or in combination, and a combination of sensitizing dyes is often used for the purpose of, in particular, supersensitization. In combination with a sensitizing dye, a dye which itself has no spectral sensitization effect, or a material that absorbs substantially no visible light, but exhibits supersensitization may be incorporated into the emulsion.

Useful sensitizing dyes, combinations of dyes that exhibit supersensitization, and materials that show supersensitization are described in, for example, Research Disclosure, Vol. 176, 17643, page 23, Item IV-J (December 1978); Japanese Patent Publication (KOKOKU, henceforth referred to as "JP-B") No. 49-25500, JP-B-43-4933, JP-A-59-19032, JP-A-59-192242 and so forth.

The sensitizing dyes used for the present invention are characterized by being dissolved in water in an amount of 0.5 weight % or more. The sensitizing dyes used for the present invention may be used in a combination of two or more of them. The sensitizing dye may be added to a silver halide emulsion by dispersing it directly in the emulsion, or by dissolving it in a sole or mixed solvent of such solvents as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol or N,N-dimethylformamide, and then adding the solution to the emulsion.

Alternatively, the sensitizing dye may be added to the emulsion by the method disclosed in U.S. Pat. No. 3,469,987, in which a dye is dissolved in a volatile organic solvent, the solution is dispersed in water or a hydrophilic colloid, and the dispersion is added to the emulsion; a method disclosed in JP-B-44-23389, JP-B-44-27555, JP-B-57-22091 or the like, in which a dye is dissolved in an acid and the solution is added to the emulsion, or a dye is made into an aqueous solution in the presence of an acid or base and the solution is added to the emulsion; a method disclosed in U.S. Pat. Nos. 3,822,135, 4,006,025 or the like, in which a dye is made into an aqueous solution or a colloid dispersion in the presence of a surfactant, and the solution or dispersion is added to the emulsion; the method disclosed in JP-A-53-102733 and JP-A-58-105141, in which a dye is directly dispersed in a hydrophilic colloid and the dispersion is added to the emulsion; or the method disclosed in JP-A-51-74624, in which a dye is dissolved by using a compound capable of causing red-shift and the solution is added to the emulsion. Ultrasonic waves may also be used for the preparation of the solution.

The sensitizing dye used for the present invention may be added to a silver halide emulsion at any step known to be useful during the preparation of the emulsion. For example, the dye may be added at a step of formation of silver halide grains and/or in a period before desalting or at a step of desilverization, and/or in a period after desalting and before initiation of chemical ripening, as disclosed in, for example, U.S. Pat. Nos. 2,735,766, 3,628,960, 4,183,756, 4,225,666, JP-A-58-184142, JP-A-60-196749 etc., or the dye may be added in any period or at any step before coating of the emulsion, such as immediately before or during chemical ripening, or in a period after chemical ripening but before coating, as disclosed in JP-A-58-113920 or the like. Further, a sole kind of compound alone or compounds different in structure in combination may be added as divided portions, for example, a part is added during grain formation, and the remaining during chemical ripening or after completion of the chemical ripening, or a part is added before or during chemical ripening and the remaining after completion of the chemical ripening, as disclosed in U.S. Pat. No. 4,225,666, JP-A-58-7629 or the like. The kind of compound or the kind of the combination of compounds added as divided portions may be changed.

The addition amount of the sensitizing dye used for the present invention varies depending on the shape, size, halogen composition of silver halide grains, method and degree of chemical sensitization, kind of antifoggant and so forth, but the addition amount may be $4\times10^{-6}$ to $8\times10^{-3}$ mol per mol of silver halide. For example, when the silver halide grain size is 0.2 to 1.3 μm, the addition amount is preferably $2\times10^{-7}$ to $3.5\times10^{-6}$, more preferably $6.5\times10^{-7}$ to $2.0\times10^{-6}$ mol, per $m^2$ of the surface area of silver halide grains.

Silver halide of the silver halide emulsion used for the silver halide photographic light-sensitive material of the present invention is not particularly limited as for silver halide, and any combination of silver halides may be used. However, silver halides having a silver chloride content of 20 to 90 mol % are preferred and, in particular, silver chlorobromide and silver chloroiodobromide having a silver chloride content of 20 to 90mol % are preferred. More preferred silver chloride content is 20 to 75 mol %. The form of silver halide grain may be any of a cubic, tetradecahedral, octahedral, variable and tabular forms, but a cubic form is preferred. The silver halide preferably has a mean grain size of 0.1 to 0.7 μm, more preferably 0.1 to 0.5 μm, and preferably has a narrow grain size distribution in terms of a variation coefficient, which is represented as {(Standard deviation of grain size)/(mean grain size)}×100, of preferably 15% or less, more preferably 10% or less.

The silver halide grains may have uniform or different phases for the inside and the surface layer. Further, they may have a localized layer having a different halogen composition inside the grains or as surface layers of the grains.

The photographic emulsion used for the present invention can be prepared using the methods described in P. Glafkides, Chimie et Physique Photographique, Paul Montel (1967); G. F. Duffin, Photographic Emulsion Chemistry, The Focal Press (1966); V. L. Zelikman et al, Making and Coating Photographic Emulsion, The Focal Press (1964) and so forth.

Specifically, any of the acidic process and the neutral process may be used. In addition, a soluble silver salt may be reacted with a soluble halogen salt by any of the single jet method, double jet method and a combination thereof. A method of forming grains in the presence of excessive silver ions (so-called reverse mixing method) may also be used.

As one kind of the double jet method, a method of maintaining the pAg constant in the liquid phase where silver halide is produced, that is, the so-called controlled double jet method may also be used. Further, it is preferable to form grains using the so-called silver halide solvent such as ammonia, thioether or tetra-substituted thiourea, more preferably using a tetra-substituted thiourea compound as described in JP-A-53-82408 and JP-A-55-77737. Preferred examples of the thiourea compound include tetramethylthiourea and 1,3-dimethyl-2-imidazolidinethione. While the amount of the silver halide solvent to be added may vary depending on the kind of the silver halide solvent used, the desired grain size and halide composition of silver halide to be desired, $10^{-5}$ to $10^{-2}$ mol per mol of silver halide is preferred.

According to the controlled double jet method or the method of forming grains using a silver halide solvent, a silver halide emulsion comprising regular crystal form grains and having a narrow grain size distribution can be easily prepared, and these methods are useful for preparing the silver halide emulsion used for the present invention.

Further, in order to achieve a uniform grain size, it is preferable to rapidly grow grains within the range of not exceeding the critical saturation degree by using a method of changing the addition rate of silver nitrate or alkali halide according to the grain growth rate as described in British Patent No. 1,535,016, JP-B-48-36890 and JP-B-52-16364, or a method of changing the concentration of the aqueous solution as described in U.S. Pat. No. 4,242,445 and JP-A-55-158124.

The silver halide emulsion used for the present invention may contain a metal belonging to Group VIII. In particular, it is preferable to add a rhodium compound, iridium compound or ruthenium compound in order to achieve high contrast and low fog. Further, to attain higher sensitivity, it is effective to dope a hexacyanide metal complex such as $K_4[Fe(CN)_6]$, $K_4[Ru(CN)_6]$ and $K_3[Cr(CN)_6]$.

As the rhodium compound used for the present invention, a water-soluble rhodium compound can be used. Examples thereof include rhodium (III) halide compounds and rhodium complex salts having a halogen, amine, oxalato, aquo or the like as a ligand, such as hexachlororhodium(III) complex salt, pentachloroaquorhodium complex salt, tetrachlorodiaquorhodium complex salt, hexabromorhodium(III) complex salt, hexaaminerhodium(III) complex salt and trioxalatorhodium(III) complex salt. The rhodium compound is dissolved in water or an appropriate solvent prior to use, and a method commonly used for stabilizing the rhodium compound solution, that is, a method of adding an aqueous solution of hydrogen halide (e.g., hydrochloric acid, hydrobromic acid or hydrofluoric acid) or an alkali halide (e.g., KCl, NaCl, KBr, NaBr etc.) may be used. In place of using a water-soluble rhodium, separate silver halide grains that have been previously doped with rhodium may be added and dissolved at the time of preparation of silver halide.

The rhenium, ruthenium or osmium compound used for the present invention is added in the form of a water-soluble complex salt described in JP-A-63-2042, JP-A-1-285941, JP-A-2-20852, JP-A-2-20855 and so forth. Particularly preferred examples are six-coordinate complex salts represented by the following formula:

$$[ML_6]^{n-}$$

In the formula, M represents Ru, Re or Os, L represents a ligand, and n represents 0, 1, 2, 3 or 4. In this case, the counter ion plays no important role, and an ammonium or alkali metal ion may be used. Preferred examples of the ligand include a halide ligand, cyanide ligand, cyan oxide ligand, nitrosyl ligand, thionitrosyl ligand and so forth. Specific examples of the complex that can be used for the present invention are shown below. However, the complexes usable in the present invention are not limited to these.

| | |
|---|---|
| $[ReCl_6]^{3-}$ | $[ReBr_6]^{3-}$ |
| $[ReCl_5(NO)]^{2-}$ | $[Re(NS)Br_5]^{2-}$ |
| $[Re(NO)(CN)_5]^{2-}$ | $[Re(O)_2(CN)_4]^{3-}$ |
| $[RuCl_6]^{3-}$ | $[RuCl_4(H_2O)_2]^{1-}$ |
| $[RuCl_5(H_2O)]^{2-}$ | $[RuBr_5(NS)]^{2-}$ |
| $[Ru(CO)_3Cl_3]^{2-}$ | $[Ru(CO)Cl_5]^{2-}$ |
| $[Ru(CO)Br_5]^{2-}$ | $[OsCl_6]^{3-}$ |
| $[OsCl_5(NO)]^{2-}$ | $[Os(NO)(CN)_5]^{2-}$ |
| $[Os(NS)Br_5]^{2-}$ | $[Os(CN)_6]^{4-}$ |
| $[Os(O)_2(CN)_4]^{4-}$ | |

The amount of these compounds is preferably $1\times10^{-9}$ to $1\times10^{-5}$ mol, particularly preferably $1\times10^{-8}$ to $1\times10^{-6}$ mol, per mole of silver halide.

The iridium compounds used in the present invention include hexachloroiridium, hexabromoiridium, hexaammineiridium, pentachloronitrosyliridium and so forth. The iron compounds used in the present invention include potassium hexacyanoferrate(II) and ferrous thiocyanate.

The silver halide emulsion used for the present invention is preferably subjected to chemical sensitization. The chemical sensitization may be performed by using a known method such as sulfur sensitization, selenium sensitization, tellurium sensitization, noble metal sensitization or the like. These sensitization methods may be used each alone or in any combination. When these sensitization methods are used in combination, preferred combinations include sulfur and gold sensitizations, sulfur, selenium and gold sensitizations, sulfur, tellurium and gold sensitizations and so forth.

The sulfur sensitization used in the present invention is usually performed by adding a sulfur sensitizer and stirring the emulsion at a high temperature of 40° C. or above for a predetermined time. The sulfur sensitizer may be a known compound, and examples thereof include, in addition to the sulfur compounds contained in gelatin, various sulfur compounds such as thiosulfates, thioureas, thiazoles and rhodanines, among which thiosulfates and thioureas are preferred. As the thiourea compounds, the specifically tetra-substituted thiourea compounds described in U.S. Pat. No. 4,810,626 are particularly preferred. Although the amount of the sulfur sensitizer to be added varies depending on various conditions such as pH, temperature and grain size of silver halide at the time of chemical ripening, it is preferably $10^{-7}$ to $10^{-2}$ mol, more preferably $10^{-5}$ to $10^{-3}$ mol, per mol of silver halide.

As the selenium sensitizer used for the present invention, a known selenium compound may be used. That is, the selenium sensitization is usually performed by adding a labile and/or non-labile selenium compound and stirring the emulsion at a high temperature of 40° C. or above for a predetermined time. As the labile selenium compound, those compounds described in JP-B-44-15748, JP-B-43-13489, JP-A-4-109240 and JP-A-4-324855 can be used. Among these, particularly preferred are those compounds represented by formulas (VIII) and (IX) mentioned in JP-A-4-324855.

The tellurium sensitizer that can be used for the present invention is a compound capable of producing silver telluride, presumably serves as a sensitization nucleus, on surfaces or inside of silver halide grains. The rate of the formation of silver telluride in a silver halide emulsion can be examined according to the method described in JP-A-5-313284.

Specific examples of the tellurium sensitizer that can be used include the compounds described in U.S. Pat. Nos. 1,623,499, 3,320,069 and 3,772,031; British Patents Nos. 235,211, 1,121,496, 1,295,462 and 1,396,696; Canadian Patent No. 800,958; JP-A-4-204640, JP-A-4-271341, JP-A-4-333043, JP-A-5-303157; J. Chem. Soc. Chem. Commun., 635 (1980); ibid., 1102 (1979); ibid., 645 (1979); J. Chem. Soc. Perkin. Trans., 1, 2191 (1980); S. Patai (compiler), The Chemistry of Organic Selenium and Tellurium Compounds, Vol. 1 (1986); and ibid., Vol. 2 (1987). The compounds represented by the formulas (II), (III) and (IV) mentioned in JP-A-4-324855 are preferred.

The amount of the selenium or tellurium sensitizer used for the present invention varies depending on silver halide grains used, chemical ripening conditions etc. However, it is generally about $10^{-8}$ to about $10^{-2}$ mol, preferably about $10^{-7}$ to about $10^{-3}$ mol, per mol of silver halide. The conditions for chemical sensitization in the present invention are not particularly restricted. However, in general, pH is 5 to 8, pAg is 6 to 11, preferably 7 to 10, and temperature is 40 to 95° C., preferably 45 to 85° C.

Noble metal sensitizers that can be used for the present invention include gold, platinum, palladium, iridium etc., and gold sensitization is particularly preferred. Specific examples of the gold sensitizers used for the present invention include chloroauric acid, potassium chloroaurate, potassium aurithiocyanate, gold sulfide and so forth, which can be used in an amount of about $10^{-7}$ to about $10^{-2}$ mol per mol of silver halide.

As for the silver halide emulsion used for the present invention, production or physical ripening process for the silver halide grains may be performed in the presence of a cadmium salt, sulfite, lead salt, thallium salt or the like.

In the present invention, reduction sensitization may be used. Examples of the reduction sensitizer include a stannous salt, amine, formamidinesulfinic acid, silane compound and so forth.

To the silver halide emulsion used in the present invention, a thiosulfonic acid compound may be added according to the method described in European Unexamined Patent Publication EP293917A.

In the photographic light-sensitive material of the present invention, 1 to 3 kinds of silver halide emulsions are preferably used. When two or more kinds of silver halide emulsions are used, those different in average grain sizes, halogen compositions, kinds or contents of contained complexes, crystal habits, chemical sensitization conditions or sensitivities may be used in combination. In order to obtain high contrast, it is preferable to provide an emulsion layer having higher sensitivity as it becomes closer to a support as described in JP-A-6-324426.

Coated silver amount in the silver halide photographic light-sensitive material is preferably 3.0 g/m$^2$ or less, more preferably 3.0 to 2.0 g/m$^2$.

Examples of the support used for the present invention include, for example, baryta paper, polyethylene-laminated paper, polypropylene synthetic paper, glass plate, cellulose acetate, cellulose nitrate, polyester film such as polyethylene terephthalate film, supports comprising a styrene polymer having syndiotactic structure described in JP-A-7-234478 and U.S. Pat. No. 5,558,979, and supports comprising a polyester film coated with a vinylidene chloride copolymer described in JP-A-64-538, U.S. Pat. Nos. 4,645,731, 4,933,267 and 4,954,430. These supports are suitably selected depending on use of the silver halide photographic light-sensitive material.

As a binder for the silver halide emulsion layer and other hydrophilic colloid layers used in the present invention, gelatin is preferably used, but it is also possible to use a polymer described in JP-A-10-268464, paragraph 0025. The amount of binder present in the whole hydrophilic colloid layers on the side having the silver halide emulsion layer is 3 g/m$^2$ or less (preferably 1.0 to 3.0 g/m$^2$), and the total amount of binder present in the whole hydrophilic colloid layers on the side having the silver halide emulsion layer and the whole hydrophilic colloid layers on the opposite side is 7.0 g/m$^2$ or less, preferably 2.0 to 7.0 g/m$^2$.

In the present invention, in order to control the surface roughness of the outermost layers of the silver halide photographic light-sensitive material, inorganic and/or organic polymer fine particles (hereinafter, called a matting agent) are preferably used in a hydrophilic colloid layer. The surface roughness of the outermost layer on the side having the silver halide emulsion layer of the light-sensitive material and the surface roughness of the outermost layer on the opposite side can be controlled by variously changing the average particle size and amount of the matting agent. The layer to which the matting agent is added can be any of the layers constituting the light-sensitive material. However, with respect to the side having the silver halide emulsion layer, it is preferable to add it to a layer positioned remoter from the support in order to prevent pinholes, and the outermost layer is particularly preferred.

The matting agent used in the present invention can be of any type of solid particles so long as it does not adversely affect the various photographic characteristics. Specific examples include those described in JP-A-10-268464, paragraphs 0009 to 0013.

The average particle size of the matting agent used in the present invention is preferably in the range of 20 μm or less, particularly preferably 1 to 10 μm. In the present invention, the amount of matting agent is preferably 5 to 400 mg/m$^2$, particularly preferably 10 to 200 mg/m$^2$.

As for the surface roughness of the light-sensitive material of the present invention, at least one of the outermost surfaces of the side having the emulsion layer and the opposite side, preferably the both surfaces, have a Beck's smoothness of 4000 seconds or less, preferably 10 to 4000 seconds. The Beck's smoothness can be easily determined in accordance with Japanese Industrial Standard (JIS) P8119 and TAPPI Standard Method T479.

In the present invention, in order to improve settling of the matting agent during coating and drying of the silver halide photographic light-sensitive material and improve pressure-induced sensitivity fluctuation, curl balance, abrasion resistance and adhesion resistance during automatic transportation, exposure, development etc., colloidal inorganic particles can be used in the silver halide emulsion layer, intermediate layer, protective layer, back layer, back protective layer etc. Preferred examples of the colloidal inorganic particles include silica particles of elongated shape described in JP-A-10-268464, paragraphs 0008 and 0014, colloidal silica, the pearl-like (pearl necklace form) colloidal silica "Snowtex PS" manufactured by Nissan Chemical Industries, Ltd. and so forth.

The amount of colloidal inorganic particles used in the present invention is 0.01 to 2.0, preferably 0.1 to 0.6, in terms of a ratio based on dry weight relative to the binder (e.g. gelatin) in the layer to which they are added.

In the present invention, in order to improve the pressure-induced sensitivity fluctuation etc., the polyhydroxybenzene compounds described in JP-A-3-39948, page 10, lower right column, line 11 to page 12, lower left column, line 5 are preferably used. More specifically, Compounds (III)-1 to (III)-25 described in the same can be mentioned.

In the present invention, in order to improve brittleness, dimensional stability, pressure-induced sensitivity fluctuation etc., polymer latex can be used. Examples of the polymer latex include polymer latexes formed from various types of monomers such as an alkyl acrylate and an alkyl methacrylate described in U.S. Pat. Nos. 2,763,652, 2,852,382, JP-A-64-538, JP-A-62-115152, JP-A-5-66512, JP-A-5-80449, JP-B-60-15935, 6-64058, 5-45014 etc., polymer latexes formed by copolymerizing a monomer having an activated methylene group and a monomer such as an alkyl acrylate described in JP-B-45-5819, JP-B-46-22507, JP-A-50-73625, JP-A-7-152112, JP-A-8-137060 etc., and so forth. Particularly preferred are polymer latexes having a core/shell structure, in which the shell portion contains a repeating unit comprising an ethylenically unsaturated monomer having an active methylene group described in JP-A-8-248548, JP-A-8-208767, JP-A-8-220669 etc. These core/shell structure polymer latexes having an active methylene group in the shell portion can improve properties including brittleness, dimensional stability, adhesion resistance between photographic light-sensitive materials and so forth without degrading the wet film strength of the photographic light-sensitive material, and the latexes themselves have improved shear stability.

The amount of polymer latex is 0.01 to 4.0, preferably 0.1 to 2.0, in terms of a ratio based on dry weight relative to the binder (e.g. gelatin) in the layer to which the latex is added.

In the present invention, in order to decrease pH of the coated film for the purpose of improving storage stability, pressure-induced sensitivity fluctuation etc. of the silver halide photographic light-sensitive material, the acidic polymer latex described in JP-A-7-104413, page 14, left column, line 1 to right column, line 30 is preferably used. More specifically, Compounds II-1) to II-9) described on page 15 of the same and the compounds having an acid group described in JP-A-2-103536, page 18, lower right column, line 6 to page 19, upper left column, line 1 are preferably used.

pH of the coated film on the side having the silver halide emulsion layer is preferably 6 to 4.

In the present invention, at least one of the layers constituting the silver halide photographic light-sensitive material of the present invention can be an electroconductive layer having a surface resistivity of $10^{12}$ O or less in an atmosphere of 25° C. and 25% relative humidity (RH).

Examples of the electroconductive material used in the present invention include the electroconductive materials described in JP-A-2-18542, page 2, lower left column, line 13 to page 3, upper right column, line 7, more specifically, the metal oxides described on page 2, lower right column, line 2 to line 10 of the same, and electroconductive macromolecular compounds of P-1 to P-7 described in the same, acicular metal oxides described in U.S. Pat. No. 5,575,957, JP-A-10-142738, paragraphs 0034 to 0043, JP-A-11-23901, paragraphs 0013 to 0019 and so forth.

In the present invention, in addition to the aforementioned electroconductive materials, the fluorine-containing surfactants described in JP-A-2-18542, page 4, upper right column, line 2 to page 4, lower right column, line 3 from the bottom, and JP-A-3-39948, page 12, lower left column, line 6 to page 13, lower right column, line 5 can be used together to further improve the antistatic property.

In the present invention, the silver halide emulsion layer or other hydrophilic colloid layers can contain a coating aid, a dispersing and solubilizing agent for additives and various types of surfactants for the purposes of improvement of lubrication, prevention of adhesion, improvement of photographic characteristics (for example, acceleration of development, impartation of higher contrast, sensitization, storage stability) etc. For example, the surfactants described in JP-A-2-12236, page 9, upper right column, line 7 to lower right column, line 3, PEG type surfactants described in JP-A-2-103536, page 18, lower left column, lines 4 to 7, more specifically, Compounds VI-1 to VI-15 described in the same, and fluorine-containing surfactants described in JP-A-2-18542, page 4, upper right column, line 2 to lower right column, line 3 from the bottom and JP-A-3-39948, page 12, lower left column, line 6 to page 13, lower right column, line 5 can be mentioned.

In the present invention, various types of lubricants can be used in order to improve transportation property in an automatic transportation apparatus, abrasion resistance, pressure-induced sensitivity fluctuation etc. of the silver halide photographic light-sensitive material. For example, lubricants described in JP-A-2-103536, page 19, upper left column, line 15 to upper right column, line 15 and JP-A-4-214551, paragraphs 0006 to 0031 can be used.

In the present invention, as a plasticizer for coated films of the silver halide photographic light-sensitive material, the compounds described in JP-A-2-103536, page 19, upper left column, line 12 to upper right column, line 15 can be used.

In the present invention, as a cross-linking agent for the hydrophilic binders, the compounds described in JP-A-2-103536, page 18, upper right column, line 5 to line 17 and JP-A-5-297508, paragraphs 0008 to 0011 can be used.

The swelling ratio of the hydrophilic colloid layers including the emulsion layers and protective layers of the silver halide photographic light-sensitive material of the present invention is preferably in the range of 50 to 200%, more preferably 70 to 180%. The swelling ratio of the hydrophilic colloid layer can be determined in the following manner. The thickness ($d_0$) of the hydrophilic colloid layers including the emulsion layers and protective layers of the silver halide photographic light-sensitive material is measured and the swollen thickness ($\Delta d$) is measured after the silver halide photographic material is immersed in distilled water at 25° C. for one minute. Then, the swelling ratio is calculated from the following equation: Swelling ratio (%)= $(\Delta d/d_0)\times 100$.

Environment, processing, heat treatment and so forth of the silver halide photographic light-sensitive material of the present invention during drying after coating and rolling up the material into a roll after drying are preferably determined or performed according to the descriptions of JP-A-10-268464, paragraphs 0026 to 0032.

The light-sensitive material of the present invention is preferably subjected to a heat treatment at any time after coating and before development. Although the heat treatment can be successively carried out immediately after coating or carried out after a certain period of time has passed, it is preferably carried out after a short period of time, for example, within 1 day. The heat treatment is carried out mainly in order to promote film hardening reaction so as to obtain film strength sufficient to withstand development. The heat treatment conditions should be appropriately determined depending on the type of hardening agent, amount thereof, pH of the film, required film strength etc. The heat treatment is preferably carried out at 30 to 60° C., more preferably 35 to 50° C., preferably for 30 minutes to 10 days.

The light-sensitive material of the present invention preferably contains a hydrazine compound. It particularly preferably contains at least one compound represented by the formula (D) as a nucleating agent.

Formula (D)

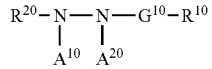

In the formula, $R^{20}$ represents an aliphatic group, an aromatic group or a heterocyclic group, $R^{10}$ represents hydrogen atom or a blocking group, and $G^{10}$ represents —CO—, —COCO—, —C(=S)—, —$SO_2$—, —SO—, —PO($R^{30}$)— group ($R^{30}$ is selected from the same range of groups defined for $R^{10}$, and $R^{30}$ may be different from $R^{10}$) or an iminomethylene group. $A^{10}$ and $A^{20}$ both represent a hydrogen atom, or one of them represents a hydrogen atom and the other represents a substituted or unsubstituted alkylsulfonyl group, a substituted or unsubstituted arylsulfonyl group or a substituted or unsubstituted acyl group.

In the formula (D), the aliphatic group represented by $R^{20}$ is preferably a substituted or unsubstituted straight, branched or cyclic alkyl, alkenyl or alkynyl group having 1 to 30 carbon atoms.

In the formula (D), the aromatic group represented by $R^{20}$ is a monocyclic or condensed-ring aryl group. Examples of the ring include benzene ring and naphthalene ring. The heterocyclic group represented by $R^{20}$ is a monocyclic or condensed-ring, saturated or unsaturated, aromatic or non-aromatic heterocyclic group. Examples of the ring include pyridine ring, pyrimidine ring, imidazole ring, pyrazole ring, quinoline ring, isoquinoline ring, benzimidazole ring, thiazole ring, benzothiazole ring, piperidine ring, triazine ring and so forth.

$R^{20}$ is preferably an aryl group, especially preferably a phenyl group.

The group represented by $R^{20}$ may be substituted with a substituent. Typical examples of the substituent include, for example, a halogen atom (fluorine, chlorine, bromine or iodine atom), an alkyl group (including an aralkyl group, a cycloalkyl group, an active methine group etc.), an alkenyl group, an alkynyl group, an aryl group, a heterocyclic group, a quaternized nitrogen atom-containing heterocyclic group (e.g., pyridinio group), an acyl group, an alkoxycarbonyl group, an aryloxycarbonyl group, a carbamoyl group, carboxyl group or a salt thereof, a sulfonylcarbamoyl group, an acylcarbamoyl group, a sulfamoylcarbamoyl group, a carbazoyl group, an oxalyl group, an oxamoyl group, cyano group, a thiocarbamoyl group, hydroxy group, an alkoxy group (including a group containing a repeating unit of ethyleneoxy group or propyleneoxy group), an aryloxy group, a heterocyclyloxy group, an acyloxy group, an (alkoxy or aryloxy)carbonyloxy group, a carbamoyloxy group, a sulfonyloxy group, amino group, an (alkyl, aryl or heterocyclyl)amino group, an N-substituted nitrogen-containing heterocyclic group, an acylamino group, a sulfonamido group, a ureido group, a thioureido group, an isothioureido group, an imido group, an (alkoxy or aryloxy) carbonylamino group, a sulfamoylamino group, a semicarbazido group, a thiosemicarbazido group, a hydrazino group, a quaternary ammonio group, an oxamoylamino group, an (alkyl or aryl)sulfonylureido group, an acylureido group, an N-acylsulfamoylamino group, nitro group, mercapto group, an (alkyl, aryl or heterocyclyl)thio group, an (alkyl or aryl)sulfonyl group, an (alkyl or aryl) sulfinyl group, sulfo group or a salt thereof, a sulfamoyl group, an N-acylsulfamoyl group, a sulfonylsulfamoyl group or a salt thereof, a group having phosphoric acid amide or phosphoric acid ester structure and so forth.

These substituents may be further substituted with any of these substituents.

Preferred examples of the substituent that $R^{20}$ may have include an alkyl group having 1 to 30 carbon atoms (including an active methylene group), an aralkyl group, a heterocyclic group, a substituted amino group, an acylamino group, a sulfonamido group, a ureido group, a sulfamoylamino group, an imido group, a thioureido group, a phosphoric acid amido group, hydroxyl group, an alkoxy group, an aryloxy group, an acyloxy group, an acyl group, an alkoxycarbonyl group, an aryloxycarbonyl group, a carbamoyl group, carboxyl group or a salt thereof, an (alkyl, aryl or heterocyclyl) thio group, sulfo group or a salt thereof, a sulfamoyl group, a halogen atom, cyano group, nitro group and so forth.

In the formula (D), $R^{10}$ represents hydrogen atom or a blocking group, and specific examples of the blocking group include an alkyl group, an alkenyl group, an alkynyl group, an aryl group, a heterocyclic group, an alkoxy group, an aryloxy group, an amino group and a hydrazino group.

The alkyl group represented by $R^{10}$ is preferably an alkyl group having 1 to 10 carbon atoms. Examples of the alkyl group include methyl group, trifluoromethyl group, difluoromethyl group, 2-carboxytetrafluoroethyl group, pyridiniomethyl group, difluoromethoxymethyl group, difluorocarboxymethyl group, 3-hydroxypropyl group, methanesulfonamidomethyl group, benzenesulfonamidomethyl group, hydroxymethyl group, methoxymethyl group, methylthiomethyl group, phenylsulfonylmethyl group, o-hydroxybenzyl group and so forth. The alkenyl group is preferably an alkenyl group having 1 to 10 carbon atoms. Examples of the alkenyl group include vinyl group, 2,2-dicyanovinyl group, 2-ethoxycarbonylvinyl group, 2-trifluoro-2-methoxycarbonylvinyl group and so forth. The alkynyl group is preferably an alkynyl group having 1 to 10 carbon atoms. Examples of the alkynyl group include ethynyl group, 2-methoxycarbonylethynyl group and so forth. The aryl group is preferably a monocyclic or condensed-ring aryl group, and especially preferably an aryl group containing a benzene ring. Examples of the aryl group include phenyl group, 3,5-dichlorophenyl group, 2-methanesulfonamidophenyl group, 2-carbamoylphenyl group, 4-cyanophenyl group, 2-hydroxymethylphenyl group and so forth.

The heterocyclic group is preferably a 5- or 6-membered, saturated or unsaturated, monocyclic or condensed-ring heterocyclic group that contains at least one nitrogen, oxygen or sulfur atom, and it may be a heterocyclic group containing a quaternized nitrogen atom. Examples of the heterocyclic group include a morpholino group, a piperidino group (N-substituted), a piperazino group, an imidazolyl group, an indazolyl group (e.g., 4-nitroindazolyl group etc.), a pyrazolyl group, a triazolyl group, a benzimidazolyl group, a tetrazolyl group, a pyridyl group, a pyridinio group (e.g., N-methyl-3-pyridinio group), a quinolinio group, a quinolyl group and so forth. Among these, especially preferred are a morpholino group, a piperidino group, a pyridyl group, a pyridinio group and so forth.

The alkoxy group is preferably an alkoxy group having 1 to 8 carbon atoms. Examples of the alkoxy group include methoxy group, 2-hydroxyethoxy group, benzyloxy group and so forth. The aryloxy group is preferably a phenyloxy group. The amino group is preferably unsubstituted amino group, an alkylamino group having 1 to 10 carbon atoms, an arylamino group or a saturated or unsaturated heterocyclylamino group (including a quaternized nitrogen atom-containing heterocyclic group). Examples of the amino group include 2,2,6,6-tetramethylpiperidin-4-ylamino group, propylamino group, 2-hydroxyethylamino group, anilino group, o-hydroxyanilino group, 5-benzotriazolylamino group, N-benzyl-3-pyridinioamino group and so forth. The hydrazino group is especially preferably a substituted or unsubstituted hydrazino group, a substituted or unsubstituted phenylhydrazino group (e.g., 4-benzenesulfonamidophenylhydrazino group) or the like.

The group represented by $R^{10}$ may be substituted with a substituent. Preferred examples of the substituent are the same as those exemplified as the substituent of $R^{20}$.

In the formula (D), $R^{10}$ may be a group capable of splitting the $G^{10}$-$R^{10}$ moiety from the residual molecule and subsequently causing a cyclization reaction that produces a cyclic structure containing atoms of the -$G^{10}$-$R^{10}$ moiety. Examples of such a group include those described in, for example, JP-A-63-29751.

The hydrazine derivatives represented by the formula (D) may contain an absorptive group capable of being absorbed onto silver halide. Examples of the absorptive group include an alkylthio group, an arylthio group, a thiourea group, a thioamido group, a mercaptoheterocyclic group, a triazole group and so forth, described in U.S. Pat. Nos. 4,385,108, 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246. Further, these groups capable of being absorbed onto silver halide may be modified into a precursor thereof. Examples of the precursor include those groups described in JP-A-2-285344.

$R^{10}$ or $R^{20}$ in the formula (D) may contain a ballast group or polymer that is usually used for immobile photographic additives such as couplers. The ballast group used in the present invention means a group having 6 or more carbon atoms including such a linear or branched alkyl group (or an alkylene group), an alkoxy group (or an alkyleneoxy group), an alkylamino group (or an alkyleneamino group), an alkylthio group or a group having any of these groups as a partial structure, more preferably a group having 7 to 24 carbon atoms including such a linear or branched alkyl group (or an alkylene group), an alkoxy group (or an alkyleneoxy group), an alkylamino group (or an alkyleneamino group), an alkylthio group or a group having any of these groups as a partial structure. Examples of the polymer include those described in, for example, JP-A-1-100530.

$R^{10}$ or $R^{20}$ in the formula (D) may contain a plurality of hydrazino groups as substituents. In such a case, the compound represented by the formula (D) is a multimer for hydrazino group. Specific examples of such a compound include those described in, for example, JP-A-64-86134, JP-A-4-16938, JP-A-5-197091, WO95/32452, WO95/32453, JP-A-9-179229, JP-A-9-235264, JP-A-9-235265, JP-A-9-235266, JP-A-9-235267 and so forth.

$R^{10}$ or $R^{20}$ in the formula (D) may contain a cationic group (specifically, a group containing a quaternary ammonio group, a group containing a quaternized phosphorus atom, a nitrogen-containing heterocyclic group containing a quaternized nitrogen atom etc.), a group containing repeating units of ethyleneoxy group or propyleneoxy group, an (alkyl, aryl or heterocyclyl)thio group, or a dissociating group (this means a group or partial structure having a proton of low acidity that can be dissociated with an alkaline developer or a salt thereof, specifically, for example, carboxyl group (—COOH), sulfo group (—$SO_3H$), phosphonic acid group (—$PO_3H$), phosphoric acid group (—$OPO_3H$), hydroxy group (—OH), mercapto group (—SH), —$SO_2NH_2$ group, N-substituted sulfonamido group (—$SO_2NH$—, —$CONHSO_2$— group, —$CONHSO_2NH$— group, —$NHCONHSO_2$— group, —$SO_2NHSO_2$— group), —CONHCO— group, active methylene group, —NH— group contained in a nitrogen-containing heterocyclic group, salts thereof etc.). Examples of the compounds containing these groups include those described in, for example, JP-A-7-234471, JP-A-5-333466, JP-A-6-19032, JP-A-6-19031, JP-A-5-45761, U.S. Pat. Nos. 4,994,365, 4,988,604, JP-A-7-259240, JP-A-7-5610, JP-A-7-244348, German Patent No. 4006032, JP-A-11-7093 and so forth.

In the formula (D), $A^{10}$ and $A^{20}$ each represent a hydrogen atom or an alkyl- or arylsulfonyl group having 20 or less carbon atoms (preferably, phenylsulfonyl group, or a phenylsulfonyl group substituted with substituent (s) so that the total of the Hammett's substituent constant of the substituent(s) should become −0.5 or more), or an acyl group having 20 or less carbon atoms (preferably, benzoyl group, a benzoyl group substituted with substituent(s) so that the total of the Hammett's substituent constant of the substituent(s) should become −0.5 or more, or a straight, branched or cyclic, substituted or unsubstituted, aliphatic acyl group (examples of the substituent include a halogen atom, an ether group, a sulfonamido group, a carbonamido group, hydroxyl group, carboxyl group, sulfo group etc.)). $A^{10}$ and $A^{20}$ each most preferably represent a hydrogen atom.

Hereafter, hydrazine derivatives especially preferably used for the present invention are explained.

$R^{20}$ is especially preferably a substituted phenyl group. Particularly preferred as the substituent are an alkyl group, an (alkyl, aryl or heterocyclyl)oxy group, an (alkyl, aryl or heterocyclyl)thio group, a sulfonamido group, an acylamino group, a ureido group, a carbamoyl group, a thioureido group, an isothioureido group, a sulfamoylamino group, an N-acylsulfamoylamino group and so forth, further preferred are an alkyl group, an (alkyl, aryl or heterocyclyl)oxy group, an (alkyl, aryl or heterocyclyl)thio group, an acylamino group, a sulfonamido group and a ureido group, and the most preferred are an alkyl group and a sulfonamido group.

The hydrazine derivatives represented by the formula (D) preferably have at least one substituent, directly or indirectly on $R^{20}$ or $R^{10}$, selected from the group consisting of a ballast group, a group that can be absorbed on silver halide, a group containing quaternary ammonio group, a nitrogen-containing heterocyclic group containing a quaternized nitrogen atom, a group containing repeating units of ethyleneoxy group, an (alkyl, aryl or heterocyclyl)thio group, a dissociating group capable of dissociating in an alkaline developer, and a hydrazino group capable of forming a multimer (group represented by —NHNH-$G^{10}$-$R^{10}$). Furthermore, $R^{20}$ preferably directly or indirectly has one group selected from the aforementioned groups as a substituent, and $R^{20}$ is most preferably a phenyl group substituted with a benzenesulfonamido group directly or indirectly having one of the aforementioned groups as a substituent on the benzene ring.

Among those groups represented by $R^{10}$, when $G^{10}$ is —CO— group, preferred are hydrogen atom, an alkyl group, an alkenyl group, an alkynyl group, an aryl group and a heterocyclic group, more preferred are hydrogen atom, an alkyl group and a substituted aryl group (the substituent is especially preferably an electron-withdrawing group or o-hydroxymethyl group), and the most preferred are hydrogen atom and an alkyl group.

When $G^{10}$ is —COCO— group, an alkoxy group, an aryloxy group, and an amino group are preferred, and a substituted amino group, specifically an alkylamino group, an arylamino group and a saturated or unsaturated heterocyclylamino group are especially preferred.

Further, when $G^{10}$ is —$SO_2$— group, $R^{10}$ is preferably an alkyl group, an aryl group or a substituted amino group.

In the formula (D), $G^{10}$ is preferably —CO— group or —COCO— group, especially preferably —CO— group.

Specific examples of the compounds represented by the formula (D) are illustrated below. However, the compounds represented by the formula (D) that can be used for the present invention are not limited to the following compounds.

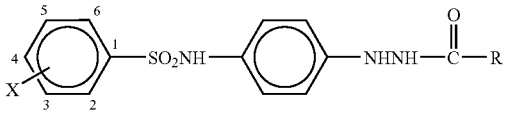
| | X = | R = —H | —$C_2F_4$ COOH (or —$C_2F_4$ $COO^{\ominus}$ $K^{\oplus}$) | 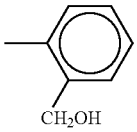 | 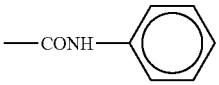 |
|---|---|---|---|---|---|
| D-1 | 3-$NHCOC_9H_{19}$(n) | 1a | 1b | 1c | 1d |
| D-2 | 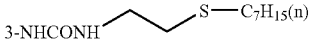 | 2a | 2b | 2c | 2d |
| D-3 | 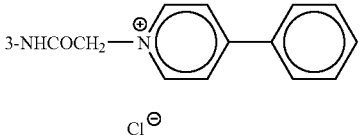 | 3a | 3b | 3c | 3d |
| D-4 | 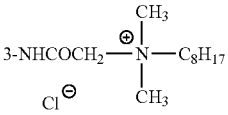 | 4a | 4b | 4c | 4d |
| D-5 | 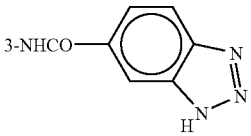 | 5a | 5b | 5c | 5d |
| D-6 | 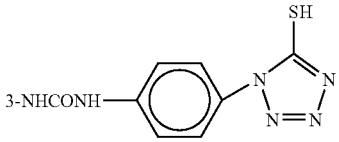 | 6a | 6b | 6c | 6d |
| D-7 | 2,4-$(CH_3)_2$ 3-$SC_2H_4$-$(OC_2H_4)_4$-$OC_8H_{17}$ | 7a | 7b | 7c | 7d |

-continued
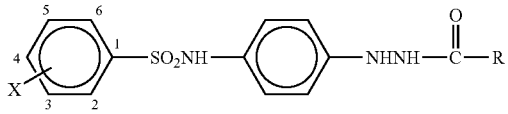
| | X = | R = —H | —$CF_2H$ | 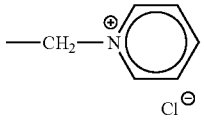 | 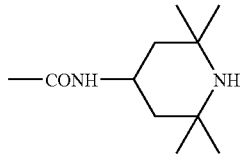 |
|---|---|---|---|---|---|
| D-8 | 3-$CONHCH_2CH(C_2H_5)C_4H_9$ | 8a | 8e | 8f | 8g |
| D-9 | 6-$OCH_3$-3-$C_5H_{11}$(t) | 9a | 9e | 9f | 9g |
| D-10 | 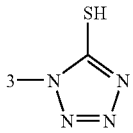 | 10a | 10e | 10f | 10g |
| D-11 | 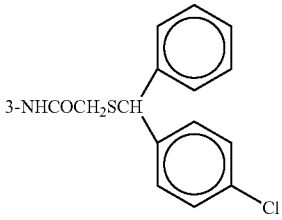 | 11a | 11e | 11f | 11g |
| D-12 | 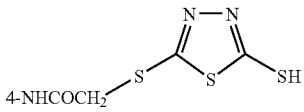 | 12a | 12e | 12f | 12g |
| D-13 | 3-$NHCOCH(CH_2COOH)C_8H_{17}$ | 13a | 13e | 13f | 13g |
| D-14 | 3,5-$(CONHCH_2CH(C_2H_5)C_4H_9)_2$ | 14a | 14e | 14f | 14g |

-continued
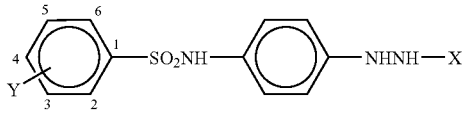
| | Y = | X = —CHO | —$COCF_3$ | —$SO_2CH_3$ | —$P(=O)(OC_2H_5)_2$ |
|---|---|---|---|---|---|
| D-15 | 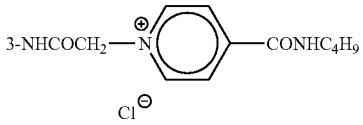 | 15a | 15h | 15i | 15j |
| D-16 | 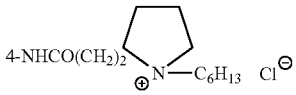 | 16a | 16h | 16i | 16j |
| D-17 | 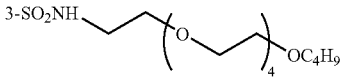 | 17a | 17h | 17i | 17j |
| D-18 | 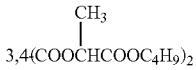 | 18a | 18h | 18i | 18j |
| D-19 | 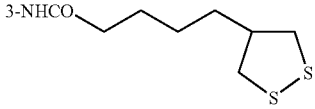 | 19a | 19h | 19i | 19j |
| D-20 | 3-$NHSO_2NH$—$C_8H_{17}$ | 20a | 20h | 20i | 20j |
| D-21 | 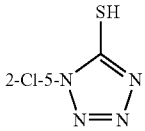 | 21a | 21h | 21i | 21j |
| | | R = —H | —$CF_2H$ | —$CH_2$— 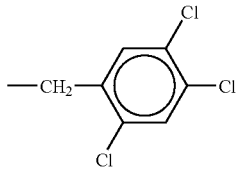 | —$CONHC_3H_7$ |
|---|---|---|---|---|---|
| D-22 | 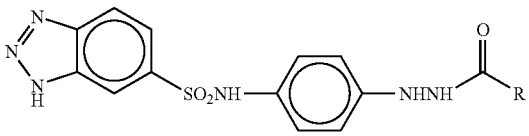 | 22a | 22e | 22k | 22l |

-continued
D-23 23a 23e 23k 23l
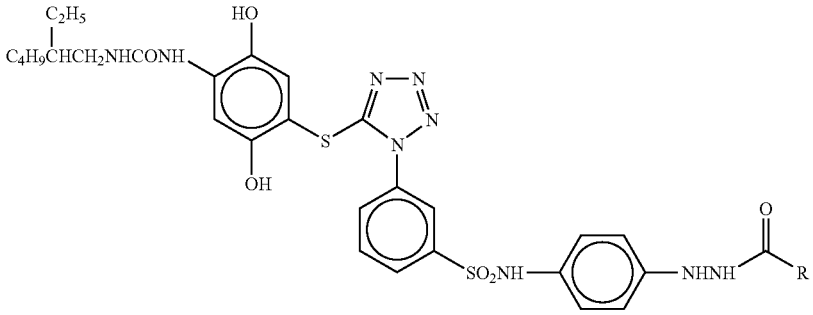
D-24 24a 24e 24k 24l
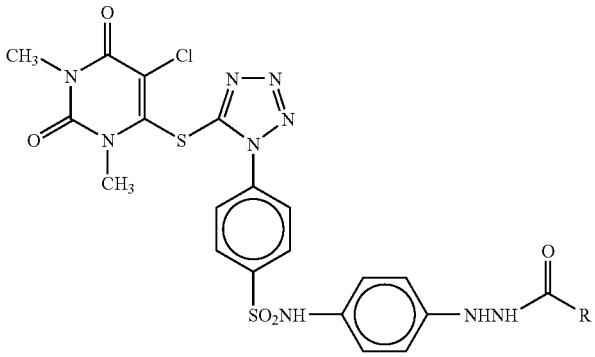
D-25 25a 25e 25k 25l
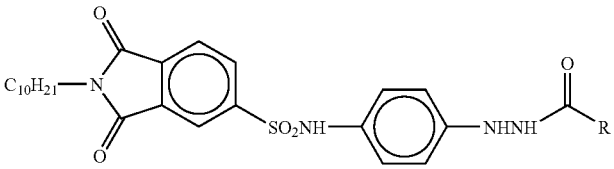
| | R = | | | |
|---|---|---|---|---|
| | —H | —$CF_2H$ | 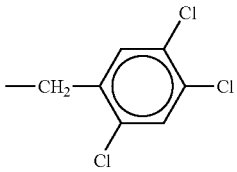 | —$CONHC_3H_7$ |
D-26 26a 26e 26k 26l
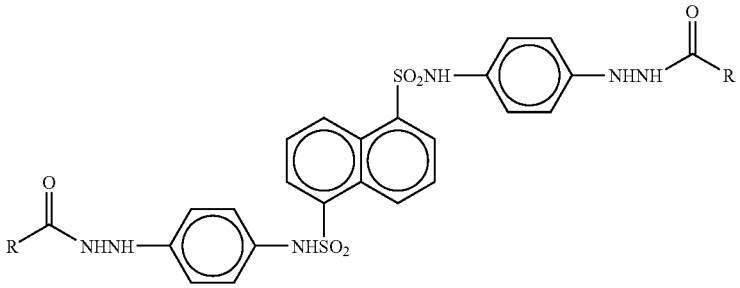

-continued
| | | | | | |
|---|---|---|---|---|---|
| D-27 | 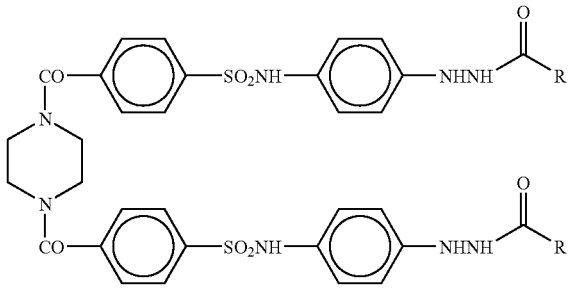 | 27a | 27e | 27k | 27l |
| D-28 | 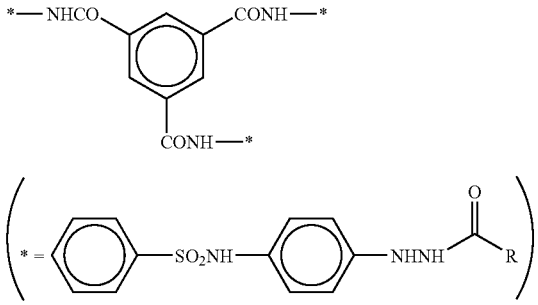 | 28a | 28e | 28k | 28l |
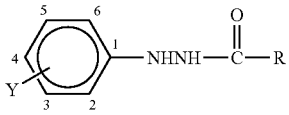
R =
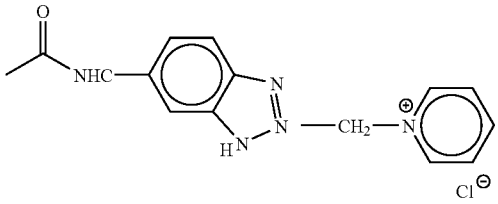
| Y = | | —H | —$CH_2OCH_3$ | | |
|---|---|---|---|---|---|
| D-29 | 4-NHCNH—$C_8H_{17}$(n) (S) | 29a | 29m | 29n | 29f |
| D-30 | 4-NHP(S)(OCH$_2$—C$_6$H$_5$)$_2$ | 30a | 30m | 30n | 30f |
| D-31 | 4-NHCONH—$(CH_2)_3O$—C$_6$H$_4$—C(CH$_3$)$_3$ | 31a | 31m | 31n | 31f |
| D-32 | 4-OH<br>3-NHCONHCH$_2$CH($C_2H_5$)—$C_4H_9$ | 32a | 32m | 32n | 32f |
| D-33 | 4-NHSO$_2$(CH$_2$)$_2$NHCO—C$_6$H$_4$—C$_2$N$_3$S (SH) | 33a | 33m | 33n | 33f |

-continued
| | | | | | |
|---|---|---|---|---|---|
| D-34 | 4-$OCH_2$— 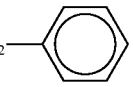 | 34a | 34m | 34n | 34f |
| D-35 | 4-NHCONHN— $CH_2$— 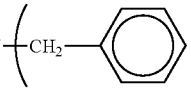 $)_2$ | 35a | 35m | 35n | 35f |
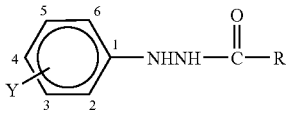
| | | R = | | | |
|---|---|---|---|---|---|
| | Y = | —H | —$C_3F_4$—COOH | —$CONHCH_2$ | 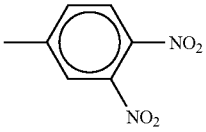 |
| D-36 | 2-$NHSO_2CH_3$— 4-$NHCONH(CH_2)_3S$— 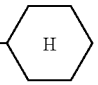 | 36a | 36o | 36p | 36q |
| D-37 | 2-$OCH_2$— 4-$NHSO_2C_{12}H_{25}$ | 37a | 37o | 37p | 37q |
| D-38 | 2-$NHCOC_{11}H_{23}$— 4-$NHSO_2CF_3$ | 38a | 38o | 38p | 38q |
| D-39 | 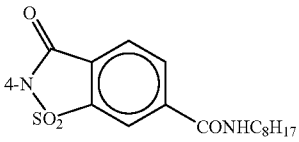 | 39a | 39o | 39p | 39q |
| D-40 | 4-$OCO(CH_2)_2COOC_6H_{13}$ | 40a | 40o | 40p | 40q |
| D-41 | 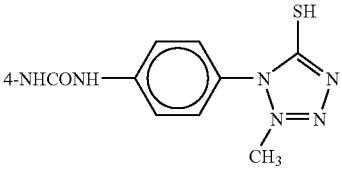 | 41a | 41o | 41p | 41q |
| D-42 | 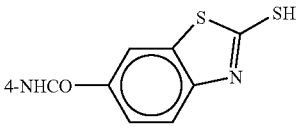 | 42a | 42o | 42p | 42q |

-continued
D-43
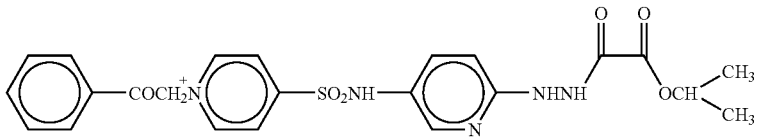
D-44
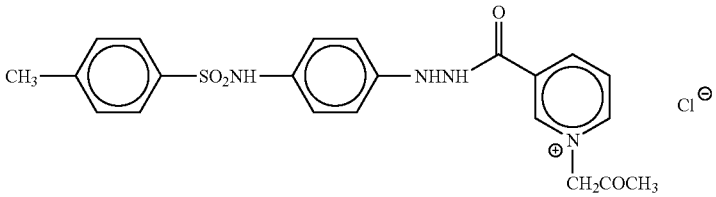
D-45
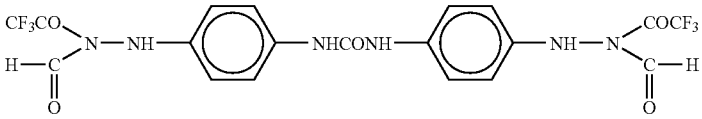
D-46
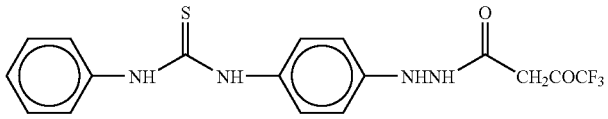
D-47
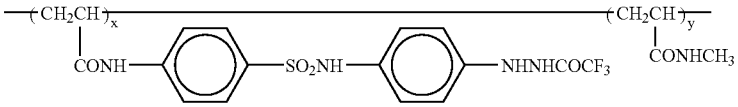
Average molecular weight
x:y = 3:97 ≈100,000
D-48
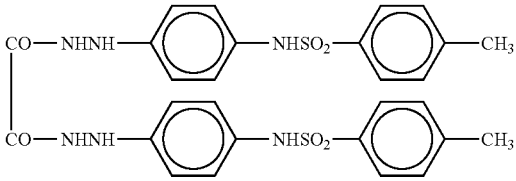
D-49
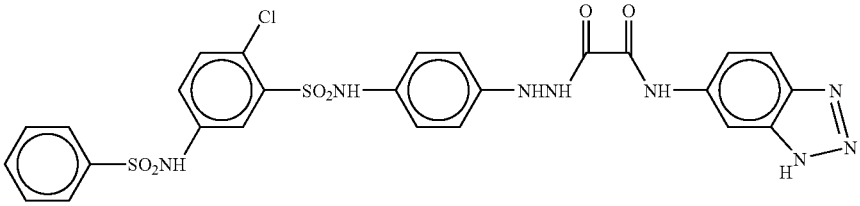
No.
D-50
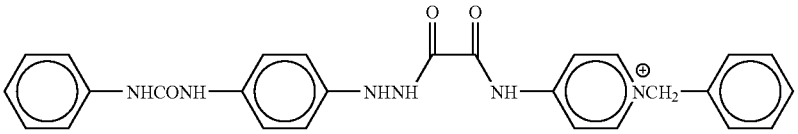
D-51
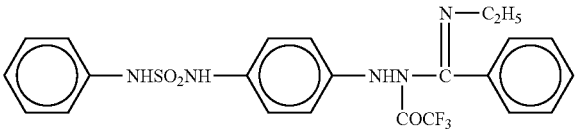

-continued
D-52
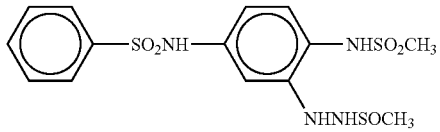
D-53
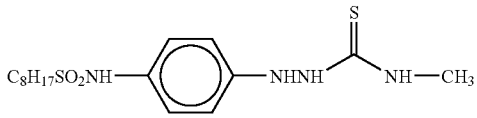
D-54
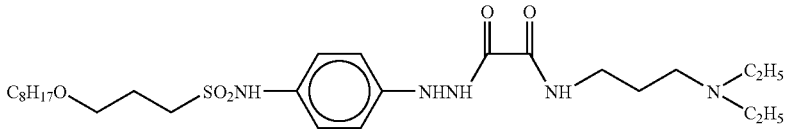
D-55
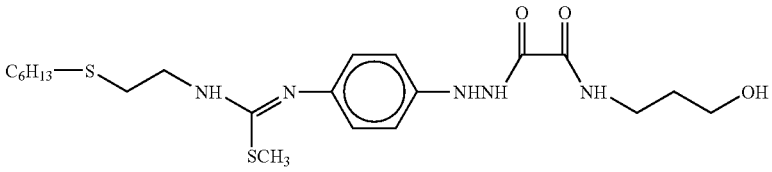
D-56
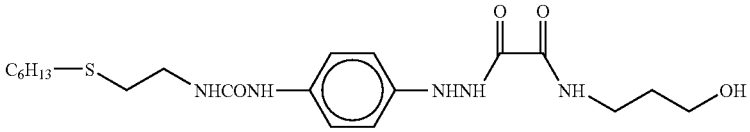
D-57
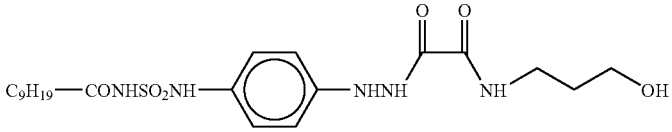
D-58
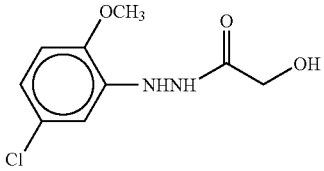
D-59
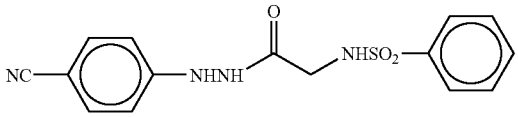
D-60
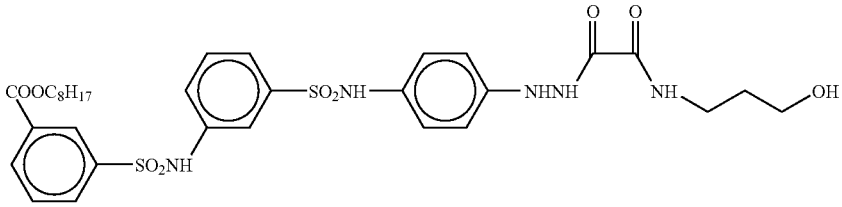
D-61
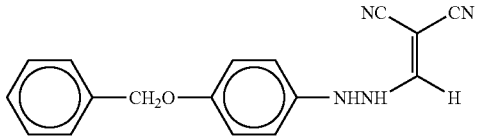

-continued
D-62
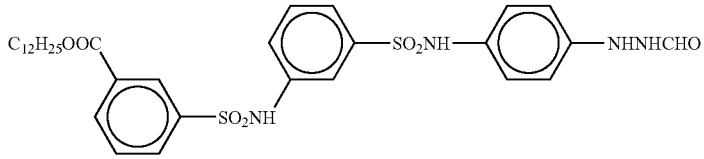
D-63
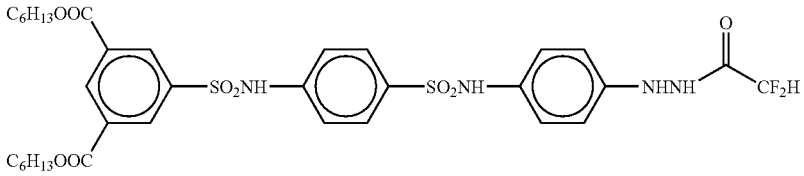
D-64
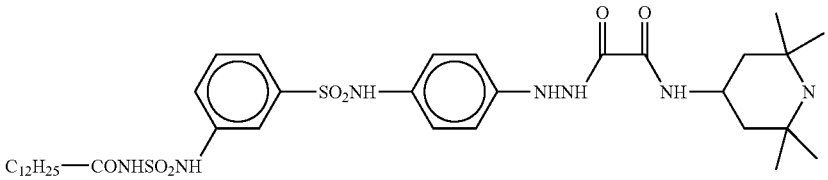
D-65
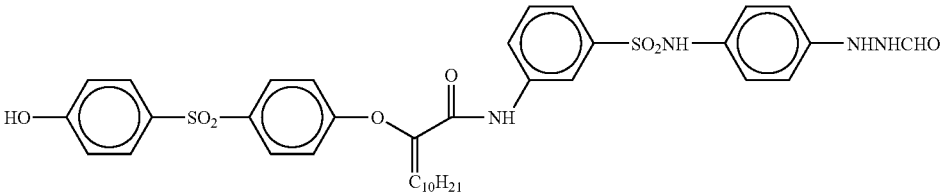
D-66
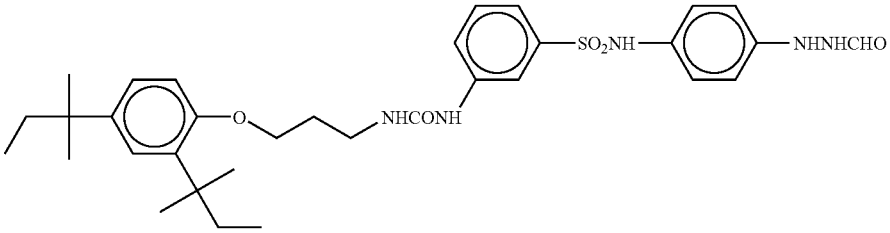
D-67
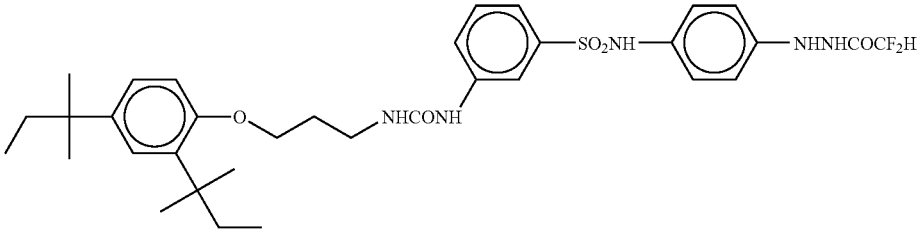
D-68
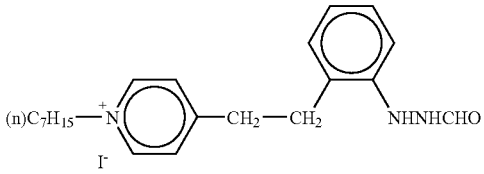

-continued

D-69

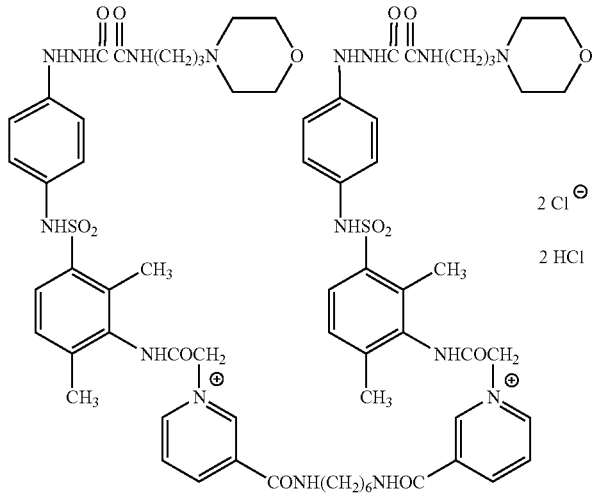

As the hydrazine derivatives used in the present invention, in addition to the above, the following hydrazine derivatives can also be preferably used. Further, the hydrazine derivatives used in the present invention can be synthesized by the various methods described in the patent documents mentioned below.

The compounds represented by (Chemical formula 1) described in JP-B-6-77138, specifically, compounds described on pages 3 and 4 of the same; compounds represented by formula (I) described in JP-B-693082, specifically, Compounds 1 to 38 described on pages 8 to 18 of the same; compounds represented by formulas (4), (5), and (6) described in JP-A-6-230497, specifically, Compound 4-1 to Compound 4-10 described on pages 25 and 26, Compound 5-1 to Compound 5-42 described on pages 28 to 36 and Compound 6-1 to Compound 6-7 described on pages 39 and 40 of the same, respectively; compounds represented by formulas (1) and (2) described in JP-A-6-289520, specifically, Compounds 1-1) to 1-17) and 2-1) described on pages 5 to 7 of the same; compounds represented by (Chemical formula 2) and (Chemical formula 3) described in JP-A-6-313936, specifically, compounds described on pages 6 to 19 of the same; compounds represented by (Chemical formula 1) described in JP-A-6-313951, specifically, compounds described on pages 3 to 5 of the same; compounds represented by formula (I) described in JP-A-7-5610, specifically, Compounds I-1 to I-38 described on pages 5 to 10 of the same; compounds represented by formula (II) described in JP-A-7-77783, specifically, Compounds II-1 to II-102 described on pages 10 to 27 of the same; compounds represented by formulas (H) and (Ha) described in JP-A-7-104426, specifically, Compounds H-1 to H-44 described on pages 8 to 15 of the same; compounds that have an anionic group or nonionic group that forms an intramolecular hydrogen bond with the hydrogen atom of the hydrazine in the vicinity of the hydrazine group described in JP-A-9-22082, especially compounds represented by formulas (A), (B), (C), (D), (E) and (F), specifically, Compounds N-1 to N-30 described in the same; compounds represented by formula (1) described in JP-A-9-22082, specifically, Compounds D-1 to D-55 described in the same; the compounds represented by the formula (I) described in JP-A-10-232456, specifically Compounds N-I to N-XVIII described in the same; the compounds represented by the formula (I) described in JP-A-11-190887, specifically Compounds N-I to N-XI described in the same; the compounds represented by the formula (I) described in JP-A-2001-109094, specifically Compounds II to X described in the same; the compounds represented by the formula (I) described in JP-A-2001-100351, specifically Compounds II to XV described in the same; as well as the hydrazine derivatives described in W095/32452, W095/32453, JP-A-9-179229, JP-A-9-235264, JP-A-9-235265, JP-A-9-235266, JP-A-9-235267, JP-A-9-319019, JP-A-9-319020, JP-A-10-130275, JP-A-11-7093, JP-A-6-332096, JP-A-7-209789, JP-A-8-6193, JP-A-8-248549, JP-A-8-248550, JP-A-8-262609, JP-A-8-314044, JP-A-8-328184, JP-A-9-80667, JP-A-9-127632, JP-A-9-146208, JP-A-9-160156, JP-A-10-161260, JP-A-10-221800, JP-A-10-213871, JP-A-10-254082, JP-A-10-254088, JP-A-7-120864, JP-A-7-244348, JP-A-7-333773, JP-A-8-36232, JP-A-8-36233, JP-A-8-36234, JP-A-8-36235, JP-A-8-272022, JP-A-9-22083, JP-A-9-22084, JP-A-9-54381 and JP-A-10-175946.

In the present invention, the hydrazine nucleating agents may be dissolved in an appropriate water-miscible organic solvent, such as an alcohol (e.g., methanol, ethanol, propanol, fluorinated alcohol), ketone (e.g., acetone, methyl ethyl ketone), dimethylformamide, dimethyl sulfoxide, methyl cellosolve or the like, before use.

The hydrazine nucleating agents may also be dissolved in an oil such as dibutyl phthalate, tricresyl phosphate, glyceryl triacetate or diethyl phthalate using an auxiliary solvent such as ethyl acetate or cyclohexanone and mechanically processed into an emulsion dispersion by a conventionally well-known emulsion dispersion method before use. Alternatively, powder of hydrazine nucleating agents may be dispersed in water by means of ball mill, colloid mill or ultrasonic waves according to a method known as solid dispersion method and used.

In the present invention, the hydrazine nucleating agents may be added to any of a silver halide emulsion layer and other hydrophilic colloid layers on the silver halide emulsion layer side with respect to the support. However, it is preferably added to a silver halide emulsion layer or a hydrophilic colloid layer adjacent thereto. Two or more kinds of hydrazine nucleating agents may be used in combination.

The addition amount of the nucleating agent in the present invention is preferably $1\times10^{-4}$ mol or more, more preferably $1\times10^{-4}$ to $1\times10^{-2}$ mol, most preferably $1\times10^{-4}$ to $5\times10^{-3}$ mol, per mol of silver halide.

The silver halide photographic light-sensitive material utilizing a hydrazine nucleating agent preferably exhibits a dot % fluctuation of 15% or less and a γ value of 10 or more.

In the present invention, the light-sensitive material may contain an amine derivative, onium salt, disulfide derivative or hydroxymethyl derivative as a nucleation accelerator. Examples of the nucleation accelerator used in the present invention include compounds described in JP-A-7-77783, page 48, lines 2 to 37, specifically, Compounds A-1) to A-73) described on pages 49 to 58 of the same; compounds represented by (Chemical formula 21), (Chemical formula 22) and (Chemical formula 23) described in JP-A-7-84331, specifically, compounds described on pages 6 to 8 of the same; compounds represented by formulas [Na] and [Nb] described in JP-A-7-104426, specifically, Compounds Na-1 to Na-22 and Compounds Nb-1 to Nb-12 described on pages 16 to 20 of the same; compounds represented by the formulas (1), (2), (3), (4), (5), (6) and (7) described in JP-A-8-272023, specifically, Compounds 1-1 to 1-19, Compounds 2-1 to 2-22, Compounds 3-1 to 3-36, Compounds 4-1 to 4-5, Compounds 5-1 to 5-41, Compounds 6-1 to 6-58 and Compounds 7-1 to 7-38 mentioned in the same; and nucleation accelerators described in JP-A-9-297377, p.55, column 108, line 8 to p.69, column 136, lines 44.

Specific examples of the nucleating agent used for the present invention are illustrated below. However, nucleating agents that can be used for the present invention are not limited to these.

A-1)

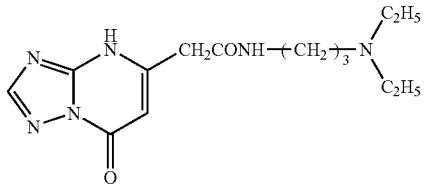

A-2)

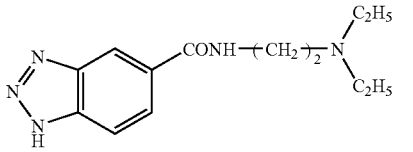

A-3)

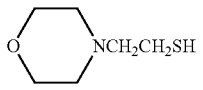

A-4)

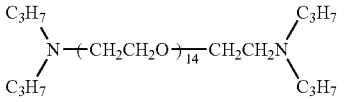

A-5)

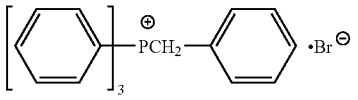

A-6)

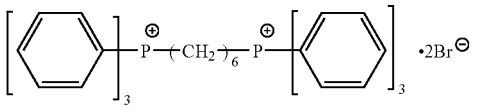

-continued

A-7)

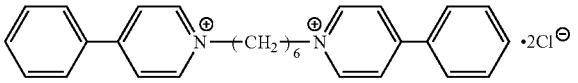

A-8)

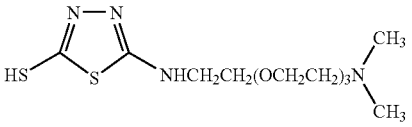

A-9)

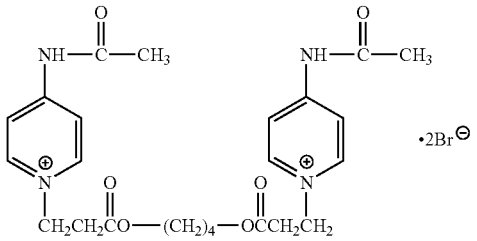

A-10)

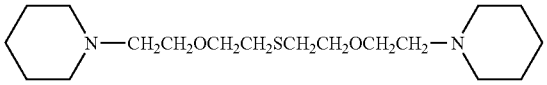

A-11)

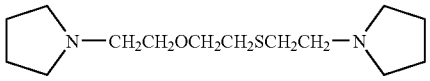

A-12)

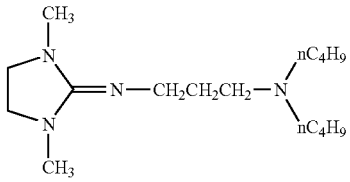

A-13)

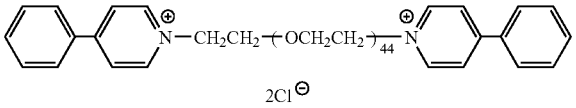

The nucleation accelerators that can be used in the present invention may be dissolved in an appropriate water-miscible organic solvent such as an alcohol (e.g., methanol, ethanol, propanol or a fluorinated alcohol), ketone (e.g., acetone or methyl ethyl ketone), dimethylformamide, dimethylsulfoxide or methyl cellosolve and used.

Alternatively, the nucleation accelerator may also be dissolved in an oil such as dibutyl phthalate, tricresyl phosphate, glyceryl triacetate or diethyl phthalate using an auxiliary solvent such as ethyl acetate or cyclohexanone and mechanically processed into an emulsion dispersion by a conventionally well-known emulsion dispersion method before use. Alternatively, powder of the nucleation accelerators may be dispersed in water by means of ball mill, colloid mill or ultrasonic waves according to a method known as solid dispersion method and used.

The nucleation accelerator may be added to any of a silver halide emulsion layer and other hydrophilic colloid layers on the silver halide emulsion layer side with respect to the support. However, it is preferably added to a hydrophilic colloid layer adjacent to the silver halide emulsion layer.

The amount of the nucleation accelerator (mol/mol Ag) is preferably 1 to 8 times, more preferably 1 to 6 times, as much as the amount of the nucleating agent (mol/mol Ag). It is also possible to use two or more kinds of nucleation accelerators in combination.

There are no particular limitations on various additives used in the silver halide photographic light-sensitive material of the present invention and, for example, those described below can be used: polyhydroxybenzene compounds described in JP-A-3-39948, page 10, right lower column, line 11 to page 12, left lower column, line 5, specifically, Compounds (III)-1 to (III)-25 described in the same; compounds that substantially do not have an absorption maximum in the visible region represented by the formula (I) described in JP-A-1-118832, specifically, Compounds I-1 to I-26 described in the same; antifoggants described in JP-A-2-103536, page 17, right lower column, line 19 to page 18, right upper column, line 4; polymer latexes described in JP-A-2-103536, page 18, left lower column, line 12 to line 20, polymer latexes having an active methylene group represented by formula (I) described in JP-A-9-179228, specifically, Compounds I-1 to I-16 described in the same, polymer latexes having core/shell structure described in JP-A-9-179228, specifically, Compounds P-1 to P-55 described in the same, and acidic polymer latexes described in JP-A-7-104413, page 14, left column, line 1 to right column, line 30, specifically, Compounds II-1) to II-9) described on page 15 of the same; matting agents, lubricants and plasticizers described in JP-A-2-103536, page 19, left upper column, line 15 to right upper column, line 15; hardening agents described in JP-A-2-103536, page 18, right upper column, line 5 to line 17; compounds having an acid radical described in JP-A-2-103536, page 18, right lower column, line 6 to page 19, left upper column, line 1; conductive materials described in JP-A-2-18542, page 2, left lower column, line 13 to page 3, right upper column, line 7, specifically, metal oxides described in page 2, right lower column, line 2 to line 10 of the same, and conductive polymer compounds P-1 to P-7 described in the same; water-soluble dyes described in JP-A-2-103536, page 17, right lower column, line 1 to 18; solid dispersion dyes represented by the formulas (FA), (FA1), (FA2) and (FA3) described in JP-A-7-179243, specifically, Compounds F1 to F34 described in the same; Compounds (II-2) to (II-24), Compounds (III-5) to (III-18) and Compounds (IV-2) to (IV-7) described in JP-A-7-152112, and solid dispersion dyes described in JP-A-2-294638 and JP-A-5-11382; surfactants described in JP-A-2-12236, page 9, upper right column, line 7 to lower right column, line 3, PEG type surfactants described in JP-A-2-103536, page 18, lower left column, lines 4 to 7, fluorine-containing surfactants described in JP-A-3-39948, page 12, lower left column, line 6 to page 13, lower right column, line 5, specifically Compounds I-1 to I-15 described in the same; redox compounds capable of releasing a development inhibitor by oxidation described in JP-A-5-274816, preferably redox compounds represented by the formulas (R-1), (R-2) and (R-3) described in the same, specifically, Compounds R-1 to R-68 described in the same; and binders described in JP-A-2-18542, page 3, right lower column, line 1 to line 20.

The silver halide photographic light-sensitive material of the present invention is developed in the presence of a benzotriazole compound. Although a benzotriazole compound may be generally added to a light-sensitive material or developer, it is added to at least the light-sensitive material in the present invention. The benzotriazole compound may be added to the silver halide emulsion layer side or the side opposite to the silver halide emulsion layer side with respect to the support. It is preferably added to the silver halide emulsion layer side.

The benzotriazole compound used for the present invention may have any structure. Preferred benzotriazole compounds are the compounds shown below.

(1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chlorobenzotriazole
(10) 4,5,6-trichlorobenzotriazole
(11) 5-Carboxybenzotriazole
(12) 5-Sulfobenzotriazole
(13) 5-Methoxycarbonylbenzotriazole
(14) 5-Aminobenzotriazole
(15) 5-Butoxybenzotriazole
(16) 5-Ureidobenzotriazole
(17) Benzotriazole The most preferred benzotriazole compounds are benzotriazole and 5-methylbenzotriazole.

The amount of the benzotriazole compound is, in the case of the silver halide photographic light-sensitive material, preferably $1\times10^{-4}$ to $1\times10^{-1}$ mol/mol of silver halide, particularly preferably $1\times10^{-3}$ to $7\times10^{-2}$ mol/mol of silver halide.

When it is added to the developer, it is preferably $7.5\times10^{-5}$ to $7.5\times10^{-3}$ mol/liter, particularly preferably $7.5\times10^{-5}$ to $5.0\times10^{-3}$ mol/liter.

Further, two or more kinds of benzotriazole compounds may be used together, or addition to the silver halide photographic light-sensitive material and addition to the developer may be used in combination.

Processing chemicals such as developing solution (developer) and fixing solution (fixer) and processing methods that can be used for the silver halide photographic light-sensitive material according to the present invention are described below, but of course the present invention should not be construed as being limited to the following description and specific examples.

For the development of the silver halide photographic light-sensitive material of the present invention, any of known methods can be used, and known developers can be used.

A developing agent for use in developer (hereinafter, starter developer and replenisher developer are collectively referred to as developer) used for the present invention is not particularly limited, but it is preferable to add a dihydroxybenzene compound, ascorbic acid derivative or hydroquinonemonosulfonate, and they can be used each alone or in combination. In particular, a dihydroxybenzene type developing agent and an auxiliary developing agent exhibiting superadditivity are preferably contained in combination, and combinations of a dihydroxybenzene compound or an ascorbic acid derivative with a 1-phenyl-3-pyrazolidone compound, or combinations of a dihydroxybenzene compound or ascorbic acid compound with a p-aminophenol compound can be mentioned.

Examples of the dihydroxybenzene developing agent as a developing agent used for the present invention includes hydroquinone, chlorohydroquinone, isopropylhydroquinone, methylhydroquinone and so forth, and hydroquinone is particularly preferred. Examples of the ascorbic acid derivative developing agent include ascorbic acid, isoascorbic acid and salts thereof. Sodium erythorbate is particularly preferred in view of material cost.

Examples of the 1-phenyl-3-pyrazolidones or derivatives thereof as the developing agent used for the present invention include 1-phenyl-3-pyrazolidone, 1-phenyl-4,4-dimethyl-3-pyrazolidone, 1-phenyl-4-methyl-4-hydroxymethyl-3-pyrazolidone and so forth.

Examples of the p-aminophenol type developing agent that can be used for the present invention include N-methyl-p-aminophenol, p-aminophenol, N-(β-hydroxyphenyl)-p-aminophenol, N-(4-hydroxyphenyl)glycine, o-methoxy-p-(N,N-dimethylamino)phenol, o-methoxy-p-(N-methylamino)phenol etc., and N-methyl-p-aminophenol and aminophenols described in JP-A-9-297377 and JP-A-9-297378 are preferred.

The dihydroxybenzene type developing agent is preferably used in an amount of generally 0.05 to 0.8 mol/L. When a dihydroxybenzene compound and a 1-phenyl-3-pyrazolidone compound or a p-aminophenol compound are used in combination, the former is preferably used in an amount of 0.05 to 0.6 mol/L, more preferably 0.10 to 0.5 mol/L, and the latter is preferably used in an amount of 0.06 mol/L or less, more preferably 0.003 to 0.03 mol/L.

The ascorbic acid derivative developing agent is preferably used in an amount of generally 0.01 to 0.5 mol/L, more preferably 0.05 to 0.3 mol/L. When an ascorbic acid derivative and a 1-phenyl-3-pyrazolidone compound or a p-aminophenol compound are used in combination, the ascorbic acid derivative is preferably used in an amount of from 0.01 to 0.5 mol/L, and the 1-phenyl-3-pyrazolidone compound or p-aminophenol compound is preferably used in an amount of 0.005 to 0.2 mol/L.

The developer used in processing the silver halide photographic light-sensitive material of the present invention may contain usually used additives (e.g., a developing agent, alkali agent, pH buffer, preservative, chelating agent etc.). Specific examples thereof are described below, but the present invention is by no means limited to them.

Examples of the buffer for use in the developer used in development of the light-sensitive material according to the present invention include carbonates, boric acids described in JP-A-62-186259, saccharides (e.g., saccharose) described in JP-A-60-93433, oximes (e.g., acetoxime), phenols (e.g., 5-sulfosalicylic acid), tertiary phosphates (e.g., sodium salt and potassium salt) etc., and carbonates and boric acids are preferably used. The buffer, in particular the carbonate, is preferably used in an amount of 0.05 mol/L or more, particularly preferably 0.08 to 1.0 mol/L.

Examples of the preservative that can be used for the present invention include sodium sulfite, potassium sulfite, lithium sulfite, ammonium sulfite, sodium bisulfite, sodium methabisulfite, formaldehyde-sodium bisulfite and so forth. The sulfites are used in an amount of preferably 0.2 mol/L or more, particularly preferably 0.3 mol/L or more. However, if it is added in an unduly large amount, silver staining in the developer is caused. Accordingly, the upper limit is preferably 1.2 mol/L. The amount is particularly preferably 0.35 to 0.7 mol/L.

As the preservative for a dihydroxybenzene type developing agent, a small amount of the aforementioned ascorbic acid derivative may be used together with the sulfite. Sodium erythorbate is particularly preferably used in view of material cost. It is preferably added in an amount of 0.03 to 0.12, particularly preferably 0.05 to 0.10, in terms of molar ratio with respect to the dihydroxybenzene type developing agent. When an ascorbic acid derivative is used as the preservative, the developer preferably does not contain a boron compound.

Examples of additives to be used other than those described above include a development inhibitor such as sodium bromide and potassium bromide, an organic solvent such as ethylene glycol, diethylene glycol, triethylene glycol and dimethylformamide, a development accelerator such as an alkanolamine including diethanolamine, triethanolamine etc. and an imidazole and derivatives thereof, and an agent for preventing uneven physical development such as a heterocyclic mercapto compound (e.g., sodium 3-(5-mercaptotetrazol-1-yl)benzenesulfonate, 1-phenyl-5-mercaptotetrazole etc.) and the compounds described in JP-A-62-212651.

Further, a mercapto compound, indazole compound or benzimidazole compound may be added as an antifoggant or a black spot (black pepper) inhibitor. Specific examples thereof include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-((2-mercapto-1,3,4-thiadiazol-2-yl)thio)butanesulfonate, 5-amino-1,3,4-thiadiazole-2-thiol and so forth. The addition amount thereof is generally 0.01 to 10 mmol, preferably 0.1 to 2 mmol, per liter of the developer.

Further, various kinds of organic or inorganic chelating agents can be used individually or in combination in the developer.

As the inorganic chelating agents, sodium tetrapolyphosphate, sodium hexametaphosphate and so forth can be used.

As the organic chelating agents, organic carboxylic acid, aminopolycarboxylic acid, organic phosphonic acid, aminophosphonic acid and organic phosphonocarboxylic acid can be mainly used.

Examples of the organic carboxylic acid include acrylic acid, oxalic acid, malonic acid, succinic acid, glutaric acid, gluconic acid, adipic acid, pimelic acid, azelaic acid, sebacic acid, nonanedicarboxylic acid, decanedicarboxylic acid, undecanedicarboxylic acid, maleic acid, itaconic acid, malic acid, citric acid, tartaric acid etc.

Examples of the aminopolycarboxylic acid include iminodiacetic acid, nitrilotriacetic acid, nitrilotripropionic acid, ethylenediaminemonohydroxyethyltriacetic acid, ethylenediaminetetraacetic acid, glycol ether-tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether-diaminetetraacetic acid, and compounds described in JP-A-52-25632, JP-A-55-67747, JP-A-57-102624 and JP-B-53-40900.

Examples of the organic phosphonic acid include hydroxyalkylidene-diphosphonic acids described in U.S. Pat. Nos. 3,214,454, 3,794,591 and West German Patent Publication No. 2,227,369, and the compounds described in Research Disclosure, Vol. 181, Item 18170 (May, 1979) and so forth.

Examples of the aminophosphonic acid include aminotris(methylenephosphonic acid), ethylenediaminetetramethylenephosphonic acid, aminotrimethylenephosphonic acid and so forth, and the compounds described in Research Disclosure, No. 18170 (supra), JP-A-57-208554, JP-A-54-61125, JP-A-55-29883, JP-A-56-97347 and so forth can also be mentioned.

Examples of the organic phosphonocarboxylic acid include the compounds described in JP-A-52-102726, JP-A-53-42730, JP-A-54-121127, JP-A-55-4024, JP-A-55-4025, JP-A-55-126241, JP-A-55-65955, JP-A-55-65956, Research Disclosure, No. 18170 (supra) and so forth.

Among these chelating agents, diethylenetriamines are particularly preferred. Among the diethylenetriamines, diethylenetriaminepentaacetic acid and metal salts thereof are particularly preferred.

The organic and/or inorganic chelating agents are not limited to those described above. The organic and/or inorganic chelating agents may be used in the form of an alkali metal salt or an ammonium salt. The amount of the chelating agent is preferably $1\times10^{-4}$ to $1\times10^{-1}$ mol, more preferably $1\times10^{-3}$ to $1\times10^{-2}$ mol, per liter of the developer.

Further, a silver stain inhibitor may be added to the developer, and examples thereof include, for example, the compounds described in JP-A-56-24347, JP-B-56-46585, JP-B-62-2849, JP-A-4-362942 and JP-A-8-6215; triazines having one or more mercapto groups (for example, the compounds described in JP-B-6-23830, JP-A-3-282457 and JP-A-7-175178); pyrimidines having one or more mercapto groups (e.g., 2-mercaptopyrimidine, 2,6-dimercaptopyrimidine, 2,4-dimercaptopyrimidine, 5,6-diamino-2,4-dimercaptopyrimidine, 2,4,6-trimercaptopyrimidine, the compounds described in JP-A-9-274289 etc.); pyridines having one or more mercapto groups (e.g., 2-mercaptopyridine, 2,6-dimercaptopyridine, 3,5-dimercaptopyridine, 2,4,6-trimercaptopyridine, compounds described in JP-A-7-248587 etc.); pyrazines having one or more mercapto groups (e.g., 2-mercaptopyrazine, 2,6-dimercaptopyrazine, 2,3-dimercaptopyrazine, 2,3,5-trimercaptopyrazine etc.); pyridazines having one or more mercapto groups (e.g., 3-mercaptopyridazine, 3,4-dimercaptopyridazine, 3,5-dimercaptopyridazine, 3,4,6-trimercaptopyridazine etc.); the compounds described in JP-A-7-175177, polyoxyalkylphosphonic acid esters described in U.S. Pat. No. 5,457,011 and so forth. These silver stain inhibitors may be used individually or in combination of two or more of these. The addition amount thereof is preferably 0.05 to 10 mmol, more preferably 0.1 to 5 mmol, per liter of the developer.

The developer may also contain the compounds described in JP-A-61-267759 as a dissolution aid.

Further, the developer may also contain a toning agent, surfactant, defoaming agent, hardening agent or the like, if necessary.

The developer preferably has a pH of 9.0 to 11.0, more preferably 9.2 to 11.0, particularly preferably 9.5 to 11.0. The alkali agent used for adjusting pH may be a usual water-soluble inorganic alkali metal salt (e.g., sodium hydroxide, potassium hydroxide, sodium carbonate, potassium carbonate etc.).

It is preferred that the developer exhibits pH increase of 0.4 or more, preferably 0.4 to 1.0, when 0.1 mol of sodium hydroxide is added to 1 L of the developer.

As for the cation of the developer, potassium ion less inhibits development and causes less indentations, called fringes, on peripheries of blackened portions, compared with sodium ion. Further, when the developer is stored as a concentrated solution, a potassium salt shows higher solubility, and,thus potassium salt is generally preferred. However, since, in the fixer, potassium ion causes fixing inhibition on the same level as silver ion, a high potassium ion concentration in the developer disadvantageously causes increase of the potassium ion concentration in the fixer due to carrying over of the developer by the light-sensitive material. In view of the above, the molar ratio of potassium ion to sodium ion in the developer is preferably between 20:80 and 80:20. The ratio of potassium ion to sodium ion can be freely controlled within the above-described range by a counter cation such as those derived from a pH buffer, pH adjusting agent, preservative, chelating agent or the like.

The replenishing amount of the developer is generally 323 mL or less, preferably 30 to 323 mL, most preferably 120 to 323 mL, per $m^2$ of the light-sensitive material. The replenisher developer may have the same composition and/or concentration as those of the starter developer, or it may have a different composition and/or concentration from those of the starter developer.

Examples of the fixing agent in the fixing processing agent that can be used for the present invention include ammonium thiosulfate, sodium thiosulfate and ammonium sodium thiosulfate. The amount of the fixing agent may be varied appropriately, but it is generally about 0.7 to 3.0 mol/L.

The fixer that can be used for the present invention may contain a water-soluble aluminum salt or a water-soluble chromium salt, which acts as a hardening agent, and among these salts, a water-soluble aluminum salt is preferred. Examples thereof include aluminum chloride, aluminum sulfate, potassium alum, ammonium aluminum sulfate, aluminum nitrate, aluminum lactate and so forth. These are preferably contained in an amount of 0.01 to 0.15 mol/L in terms of aluminum ion concentration in the solution used.

When the fixer is stored as a concentrated solution or a solid agent, it may be constituted by a plurality of parts including a hardening agent or the like as a separate part, or it may be constituted as a one-part agent containing all components.

The fixing processing agent may contain, if desired, a preservative (e.g., sulfite, bisulfite, metabisulfite etc. in an amount of 0.015 mol/L or more, preferably 0.02 to 0.3 mol/L), pH buffer (e.g., acetic acid, sodium acetate, sodium carbonate, sodium hydrogencarbonate, phosphoric acid, succinic acid, adipic acid etc. in an amount of generally 0.1 to 1 mol/L, preferably 0.2 to 0.7 mol/L), and a compound having aluminum-stabilizing ability or hard water-softening ability (e.g., gluconic acid, iminodiacetic acid, 5-sulfosalicylic acid, glucoheptanoic acid, malic acid, tartaric acid, citric acid, oxalic acid, maleic acid, glycolic acid, benzoic acid, salicylic acid, Tiron, ascorbic acid, glutaric acid, aspartic acid, glycine, cysteine, ethylenediaminetetraacetic acid, nitrilotriacetic acid, derivatives and salts thereof, saccharides etc. in an amount of 0.001 to 0.5 mol/L, preferably 0.005 to 0.3 mol/L). However, in view of environmental protection recently concerned, it is preferred that a boron compound is not contained.

In addition, the fixing processing agent may contain a compound described in JP-A-62-78551, pH adjusting agent (e.g., sodium hydroxide, ammonia, sulfuric acid etc.), surfactant, wetting agent, fixing accelerator etc. Examples of the surfactant include anionic surfactants such as sulfated products and sulfonated products, polyethylene surfactants and amphoteric surfactants described in JP-A-57-6840. Known deforming agents may also be used. Examples of the wetting agent include alkanolamines and alkylene glycols. Examples of the fixing accelerator include alkyl- or aryl-substituted thiosulfonic acids and salts thereof described in JP-A-6-308681; thiourea derivatives described in JP-B-45-35754, JP-B-58-122535 and JP-B-58-122536; alcohols having a triple bond within the molecule; thioether compounds described in U.S. Pat. No. 4,126,459; mercapto compounds described in JP-A-64-4739, JP-A-1-4739, JP-A-1-159645 and JP-A-3-101728; mesoionic compounds and thiocyanates described in JP-A-4-170539.

pH of the fixer used for the present invention is preferably 4.0 or more, more preferably 4.5 to 6.0. pH of the fixer rises with processing by the contamination of developer. In such a case, pH of a hardening fixer is preferably 6.0 or less, more preferably 5.7 or less, and that of a non-hardening fixer is preferably 7.0 or less, more preferably 6.7 or less.

The replenishing rate of the fixer is preferably 500 mL or less, more preferably 390 mL or less, still more preferably 320 to 80 mL, per $m^2$ of the light-sensitive material. The composition and/or the concentration of the replenisher fixer may be the same as or different from those of the starter fixer.

The fixer can be reclaimed for reuse according to known fixer reclaiming methods such as electrolytic silver recovery. As reclaiming apparatuses, there are FS-2000 produced by Fuji Photo Film Co., Ltd. and so forth.

Further, removal of dyes and so forth using an adsorptive filter such as those comprising activated carbon is also preferred.

When the developing and fixing processing chemicals used in the present invention are solutions, they are preferably preserved in packaging materials of low oxygen permeability as disclosed in JP-A-61-73147. Further, when these solutions are concentrated solutions, they are diluted with water to a predetermined concentration in the ratio of 0.2 to 3 parts of water to one part of the concentrated solutions.

Even if the developing processing chemicals and fixing processing chemicals used in the present invention are made as solids, the same effects as solutions can be obtained. Solid processing chemicals are described below.

Solid chemicals that can be used for the present invention may be made into known shapes such as powders, granular powders, granules, lumps, tablets, compactors, briquettes, plates, bars, paste or the like. These solid chemicals may be covered with water-soluble coating agents or films to separate components that react with each other on contact, or they may have a multilayer structure to separate components that react with each other, or both types may be used in combination.

Although known coating agents and auxiliary granulating agents can be used, polyvinylpyrrolidone, polyethylene glycol, polystyrenesulfonic acid and vinyl compounds are preferably used. Further, JP-A-5-45805, column 2, line 48 to column 3, line 13 can be referred to.

When a multilayer structure is used, components that do not react with each other on contact may be sandwiched with components that react with each other and made into tablets and briquettes, or components of known shapes may be made into a similar layer structure and packaged. Methods therefor are disclosed in JP-A-61-259921, JP-A-4-16841, JP-A-4-78848, JP-A-5-93991 and so forth.

The bulk density of the solid processing chemicals is preferably 0.5 to 6.0 g/$cm^3$, in particular, the bulk density of tablets is preferably 1.0 to 5.0 g/$cm^3$, and that of granules is preferably 0.5 to 1.5 g/$cm^3$.

Solid processing chemicals used for the present invention can be produced by using any known method, and one can refer to, for example, JP-A-61-259921, JP-A-4-15641, JP-A-4-16841, JP-A-4-32837, JP-A-4-78848, JP-A-5-93991, JP-A-4-85533, JP-A-4-85534, JP-A-4-85535, JP-A-5-134362, JP-A-5-197070, JP-A-5-204098, JP-A-5-224361, JP-A-6-138604, JP-A-6-138605, JP-A-8-286329 and so forth.

More specifically, the rolling granulating method, extrusion granulating method, compression granulating method, cracking granulating method, stirring granulating method, spray drying method, dissolution coagulation method, briquetting method, roller compacting method and so forth can be used.

The solubility of the solid chemicals used in the present invention can be adjusted by changing state of surface (smooth, porous, etc.) or partially changing the thickness, or making the shape into a hollow doughnut type. Further, it is also possible to provide different solubilities to a plurality of granulated products, or it is also possible for materials having different solubilities to use various shapes to obtain the same solubilities. Multilayer granulated products having different compositions between the inside and the surface can also be used.

Packaging materials of solid chemicals preferably have low oxygen and water permeabilities, and those of known shapes such as bag-like, cylindrical and box-like shapes can be used. Packaging materials of foldable shapes are preferred for saving storage space of waste packaging materials as disclosed in JP-A-6-242585 to JP-A-6-242588, JP-A-6-247432, JP-A-6-247448, JP-A-6-301189, JP-A-7-5664, and JP-A-7-5666 to JP-A-7-5669. Takeout ports of processing chemicals of these packaging materials may be provided with a screw cap, pull-top or aluminum seal, or packaging materials may be heat-sealed, or other known types may be used, and there are no particular limitations. Waste packaging materials are preferably recycled or reused in view of environmental protection.

Methods of dissolution and replenishment of the solid processing chemicals used for the present invention are not particularly limited, and known methods can be used. Examples of these known methods include a method in which a certain amount of processing chemicals are dissolved and replenished by a dissolving apparatus having a stirring function, a method in which processing chemicals are dissolved by a dissolving apparatus having a dissolving zone and a zone where a finished solution is stocked and the solution is replenished from the stock zone as disclosed in JP-A-9-80718, and methods in which processing chemicals are fed to a circulating system of an automatic processor and dissolved and replenished, or processing chemicals are fed to a dissolving tank provided in an automatic processor with progress of the processing of light-sensitive materials as disclosed in JP-A-5-119454, JP-A-6-19102 and JP-A-7-261357. In addition to the above methods, any of known methods can be used. The charge of processing chemicals may be conducted manually, or automatic opening and automatic charge may be conducted by using a dissolving apparatus or automatic processor provided with an opening mechanism as disclosed in JP-A-9-138495. The latter is preferred in view of the working environment. Specifically, there are methods of pushing through, unsealing, cutting off and bursting a takeout port of package, methods disclosed in JP-A-6-19102 and JP-A-6-95331 and so forth.

The light-sensitive material is subjected to washing or stabilizing processing after being developed and fixed (hereinafter washing includes stabilization processing, and a solution used therefor is called water or washing water unless otherwise indicated). The water used for washing may be any of tap water, ion exchange water, distilled water and stabilized solution. The replenishing rate therefor is, in general, about 8 to 17 liters per $m^2$ of the light-sensitive material, but washing can be carried out with a replenishing rate less than the above. In particular, with a replenishing rate of 3 liters or less (including zero, i.e., washing in a reservoir), not only water saving processing can be carried out, but also piping for installation of an automatic processor becomes unnecessary. When washing is carried out with a reduced replenishing amount of water, it is more preferable to use a washing tank equipped with a squeegee roller or a crossover roller disclosed in JP-A-63-18350, JP-A-62-287252 or the like. The addition of various kinds of oxidizing agents (e.g., ozone, hydrogen peroxide, sodium hypochlorite, activated halogen, chlorine dioxide, sodium carbonate hydrogen peroxide salt etc.) and filtration through filters may be combined to reduce load on environmental pollution which becomes a problem when washing is carried out with a small amount of water and to prevent generation of scale.

As a method of reducing the replenishing amount of the washing water, a multistage countercurrent system (e.g., two stages or three stages) has been known for a long time. The replenishing amount of the washing water in this system is preferably 50 to 200 mL per $m^2$ of the light-sensitive material. This effect can also similarly be obtained in an independent multistage system (a method in which a countercurrent is not used and fresh solution is separately replenished to multistage washing tanks).

Further, means for preventing generation of scale may be included in a washing process used for the present invention. Means for preventing generation of scale is not particularly limited, and known methods can be used. There are, for example, a method of adding an antifungal agent (so-called scale preventive), a method of using electroconduction, a method of irradiating ultraviolet ray, infrared ray or far infrared ray, a method of applying a magnetic field, a method of using ultrasonic wave processing, a method of applying heat, a method of emptying tanks when they are not used and so forth. These scale preventing means may be used with progress of the processing of light-sensitive materials, may be used at regular intervals irrespective of usage conditions, or may be conducted only during the time when processing is not conducted, for example, during night. In addition, washing water previously subjected to a treatment with such means may be replenished. It is also preferable to use different scale preventing means for every given period of time for inhibiting proliferation of resistant fungi.

As a water-saving and scale-preventing apparatus, an apparatus AC-1000 produced by Fuji Photo Film Co., Ltd. and a scale-preventing agent AB-5 produced by Fuji Photo Film Co., Ltd. may be used, and the method disclosed in JP-A-11-231485 may also be used.

The antifungal agent is not particularly restricted, and a known antifungal agent may be used. Examples thereof include, in addition to the above-described oxidizing agents, glutaraldehyde, chelating agent such as aminopolycarboxylic acid, cationic surfactant, mercaptopyridine oxide (e.g., 2-mercaptopyridine-N-oxide) and so forth, and a sole antifungal agent may be used, or a plurality of antifungal agents may be used in combination.

The electricity may be applied according to the methods described in JP-A-3-224685, JP-A-3-224687, JP-A-4-16280, JP-A-4-18980 and so forth.

In addition, a known water-soluble surfactant or defoaming agent may be added so as to prevent uneven processing due to bubbling, or to prevent transfer of stains. Further, the dye adsorbent described in JP-A-63-163456 may be provided in the washing with water system, so as to prevent stains due to a dye dissolved out from the light-sensitive material.

Overflow solution from the washing with water step may be partly or wholly used by mixing it with the processing solution having fixing ability, as described in JP-A-60-235133. In view of protection of the natural environment, it is also preferable to reduce the biochemical oxygen demand (BOD), chemical oxygen demand (COD), iodine consumption or the like in waste water before discharge by subjecting the solution to microbial treatment (for example, activated sludge treatment, treatment with a filter comprising a porous carrier such as activated carbon or ceramic carrying microorganisms such as sulfur-oxidizing bacteria etc.) or oxidation treatment with electrification or an oxidizing agent before discharge, or to reduce the silver concentration in waste water by passing the solution through a filter using a polymer having affinity for silver, or by adding a compound that forms a hardly soluble silver complex, such as trimercaptotriazine, to precipitate silver, and then passing the solution through a filter.

In some cases, stabilization may be performed after the washing with water, and as an example thereof, a bath containing the compounds described in JP-A-2-201357, JP-A-2-132435, JP-A-1-102553 and JP-A-46-44446 may be used as a final bath of the light-sensitive material. This stabilization bath may also contain, if desired, an ammonium compound, metal compound such as Bi or Al, fluorescent brightening agent, various chelating agents, layer pH-adjusting agent, hardening agent, bactericide, antifungal agent, alkanolamine or surfactant.

The additives such as antifungal agent and the stabilizing agent added to the washing with water or stabilization bath may be formed into a solid agent like the aforementioned developing and fixing processing agents.

Waste solutions of the developer, fixer, washing water or stabilizing solution used for the present invention are preferably burned for disposal. The waste solutions can also be concentrated or solidified by a concentrating apparatus such as those described in JP-B-7-83867 and U.S. Pat. No. 5,439,560, and then disposed.

When the replenishing amount of the processing agents is reduced, it is preferable to prevent evaporation or air oxidation of the solution by reducing the opening area of the processing tank. A roller transportation-type automatic developing machine is described in, for example, U.S. Pat. Nos. 3,025,779 and 3,545,971, and in the present specification, it is simply referred to as a roller transportation-type automatic processor. This automatic processor performs four steps of development, fixing, washing with water and drying, and it is most preferable to follow this four-step processing also in the present invention, although other steps (e.g., stopping step) are not excluded. Further, a rinsing bath (tank for washing) may be provided between development and fixing and/or between fixing and washing with water.

In the development of the silver halide photographic light-sensitive material of the present invention, the dry-to-dry time from the start of processing to finish of drying is preferably 25 to 160 seconds, the development time and the fixing time are each generally 40 seconds or less, preferably 6 to 35 seconds, and the temperature of each solution is preferably 25 to 50° C., more preferably 30 to 40° C. The temperature and the time of washing with water are preferably 0 to 50° C. and 40 seconds or less, respectively. According to such a method, the light-sensitive material after development, fixing and washing with water may be passed between squeeze rollers for squeezing washing water, and then dried. The drying is generally performed at a temperature of about 40° C. to about 100° C. The drying time may be appropriately varied depending on the ambient conditions. The drying method is not particularly limited, and any known method may be used. Hot-air drying and drying by a heat roller or far infrared rays as described in JP-A-4-15534, JP-A-5-2256 and JP-A-5-289294 may be used, and a plurality of drying methods may also be used in combination.

As the image setter and automatic developing machine used for the present invention, any combination of them may be used so long as any problem is not caused concerning transportation. As the image setter, any of F9000 and Lux Setter RC-5600V produced by Fuji Photo Film Co., Ltd, Image setter FT-R$^{5055}$ produced by Dainippon Screen Mfg. Co., Ltd., Select Set 5000, Avantra 25 and Acuset 1000 produced by Agfa Gevaert AG, Dolev 450 and Dolev 800 produced by Scitex, Lino 630, Quasar, Herkules ELITE and Signasetter produced by Heidelberg Co., Luxel F-9000, and Panther Pro 62 produced by PrePRESS Inc. may be used.

The present invention will be specifically explained with reference to the following examples and comparative examples. The materials, amounts, ratios, types and procedures of processes and so forth shown in the following examples can be optionally changed so long as such change does not depart from the spirit of the present invention. Therefore, the scope of the present invention should not be construed in any limitative way based on the following examples.

EXAMPLE 1

Preparation of Emulsion A

Solution 1

| | |
|---|---|
| Water | 750 mL |
| Gelatin | 20 g |
| Sodium chloride | 3 g |
| 1,3-Dimethylimidazolidine-2-thione | 20 mg |
| Sodium benzenethiosulfonate | 10 mg |
| Citric acid | 0.7 g |

Solution 2

| | |
|---|---|
| Water | 300 mL |
| Silver nitrate | 150 g |

Solution 3

| | |
|---|---|
| Water | 300 mL |
| Sodium chloride | 34 g |
| Potassium bromide | 32 g |
| Potassium hexachloroiridate(III) (0.005 weight % in 20 weight % KCl aqueous solution) | 5 mL |
| Ammonium hexachlororhodate (0.001 weight % in 20 weight % NaCl aqueous solution) | 7 mL |

The potassium hexachloroiridate(III) (0.005 weight % in 20 weight % KCl aqueous solution) and ammonium hexachlororhodate (0.001 weight % in 20 weight % NaCl aqueous solution) used for Solution 3 were prepared by dissolving powder of each in 20 weight % aqueous solution of KCl and 20 weight % aqueous solution of NaCl, respectively, and heating each solution at 40° C. for 120 minutes.

Solution 2 and Solution 3 in amounts corresponding to 90% of each were simultaneously added to Solution 1 maintained at 38° C. and pH 4.5 over 20 minutes with stirring to form nucleus grains having a diameter of 0.16 μm. Subsequently, Solution 4 and Solution 5 shown below were added over 8 minutes. Further, the remaining 10% of Solution 2 and Solution 3 were added over 2 minutes to allow growth of the grains to a diameter of 0.21 μm. Further, 0.15 g of potassium iodide was added and ripening was allowed for 5 minutes to complete the grain formation.

Solution 4

| | |
|---|---|
| Water | 100 mL |
| Silver nitrate | 50 g |

Solution 5

| | |
|---|---|
| Water | 100 mL |
| Sodium chloride | 13 mg |
| Potassium bromide | 11 mg |
| Potassium ferrocyanide | 50 mg |

The resulting grains were washed according to a conventional flocculation method. Specifically, after the temperature of the mixture was lowered to 35° C., 3 g of Anionic precipitating agent 1 shown below was added to the mixture, and pH was lowered by using sulfuric acid until the silver halide was precipitated (lowered to the range of pH 3.2±0.2). Then, about 3 L of the supernatant was removed (first washing with water). Furthermore, the emulsion was added with 3 L of distilled water and then with sulfuric acid until the silver halide was precipitated. In a volume of 3 L of the supernatant was removed again (second washing with water). The same procedure as the second washing with water was repeated once more (third washing with water) to complete the washing with water and desalting processes. The emulsion after the washing with water and desalting was added with 45 g of gelatin, and after pH was adjusted to 5.6 and pAg was adjusted to 7.5, added with 10 mg of sodium benzenethiosulfonate, 3 mg of sodium benzenethiosulfinate, 15 mg of sodium thiosulfate and 10 mg of chloroauric acid to perform chemical sensitization at 55° C. for obtaining optimal sensitivity, and then added with 100 mg of 4-hydroxy-6-methyl-1,3,3a,7-tetrazaindene as a stabilizer and 100 mg of Proxcel (trade name, ICI Co., Ltd.) as an antiseptic.

There was finally obtained an emulsion of cubic silver iodochlorobromide grains containing 30 mol % of silver bromide and 0.08 mol % of silver iodide and having an average grain size of 0.22 μm and a variation coefficient of 9%. The emulsion finally showed pH of 5.7, pAg of 7.5, electric conductivity-of 40 μS/m, density of $1.2\times10^3$ kg/m$^3$ and viscosity of 50 mPa·s.

Anionic Precipitating Agent 1

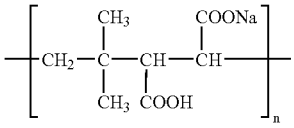

Average molecular weight: 120,000

Preparation of Coated Samples

On a polyethylene terephthalate film support having moisture proof layers comprising vinylidene chloride mentioned below on the both surfaces, UL layer, emulsion layer, lower protective layer and upper protective layer were coated in this order to prepare a sample.

The preparation methods, coated amounts and coating method of the layers are shown below.

<Emulsion Layer>

Emulsion A was spectrally sensitized by addition of a sensitizing dye mentioned in Table 1 in an amount of $5.7\times10^{-4}$ mol/mol Ag. Further, $3.4\times10^{-4}$ mol/mol Ag of KBr, $2.0\times10^{-4}$ mol/mol Ag of Compound (Cpd-1), $2.0\times10^{-4}$ mol/mol Ag of Compound (Cpd-2) and $8.0\times10^{-4}$ mol/mol Ag of Compound (Cpd-3) were added, and the mixture was sufficiently mixed. Then, $1.2\times10^{-4}$mol/mol Ag of 4-hydroxy-6-methyl-1,3,3a,7-tetrazaindene, $1.2\times10^{-2}$ mol/mol Ag of hydroquinone, $8\times10^{-4}$ mol/mol Ag of a benzotriazole compound mentioned in Table 1, $3.0\times10^{-4}$ mol/mol Ag of citric acid, $2\times10^{-4}$ mol/mol Ag of hydrazine type nucleating agent (Cpd-4), 90 mg/m$^2$ of 2,4-dichloro-6-hydroxy-1,3,5-triazine sodium salt, 15 weight % relative to gelatin of colloidal silica having a particle size of 10 nm, 100 mg/m$^2$ of aqueous latex (aqL-6), 150 mg/m$^2$ of polyethyl acrylate latex, 150 mg/m$^2$ of latex of copolymer of methyl acrylate, 2-acrylamido-2-methypropanesulfonic acid sodium salt and 2-acetoxyethyl methacrylate (weight ratio=88:5:7), 150 mg/m$^2$ of core/shell type latex (core: styrene/butadiene copolymer (weight ratio=37/63), shell: styrene/2-acetoxyethyl acrylate copolymer (weight ratio=84/16), core/shell ratio=50/50) and 4 weight % relative to gelatin of Compound (Cpd-7) were added, and the coating solution were adjusted to pH 5.6 by using citric acid. The coating solution for emulsion layer prepared as described above was coated on the support mentioned below so that the coated silver amount and coated gelatin amount should become 2.9 g/m$^2$ and 1.5 g/m$^2$, respectively.

| | |
|---|---|
| <Upper protective layer > | |
| Gelatin | 0.3 g/m$^2$ |
| Amorphous silica matting agent (average particle size: 3.5 μm) | 25 mg/m$^2$ |
| Compound (Cpd-8) (gelatin dispersion) | 20 mg/m$^2$ |
| Colloidal silica (particle size: 10 to 20 μm, Snowtex C, Nissan Chemical) | 30 mg/m$^2$ |
| Compound (Cpd-9) | 50 mg/m$^2$ |
| Sodium dodecylbenzenesulfonate | 20 mg/m$^2$ |
| Compound (Cpd-10) | 20 mg/m$^2$ |
| Compound (Cpd-11) | 20 mg/m$^2$ |
| Antiseptic (Proxcel, ICI Co., Ltd.) | 1 mg/m$^2$ |
| <Lower protective layer > | |
| Gelatin | 0.5 g/m$^2$ |
| Nucleation accelerator (Cpd-12) | 15 mg/m$^2$ |
| 1,5-Dihydroxy-2-benzaldoxime | 10 mg/m$^2$ |
| Polyethyl acrylate latex | 150 mg/m$^2$ |
| Compound (Cpd-13) | 3 mg/m$^2$ |
| Antiseptic (Proxcel) | 1.5 mg/m$^2$ |
| <UL layer> | |
| Gelatin | 0.5 g/m$^2$ |
| Polyethyl acrylate latex | 150 mg/m$^2$ |
| Compound (Cpd-7) | 40 mg/m$^2$ |
| Compound (Cpd-14) | 10 mg/m$^2$ |
| Antiseptic (Proxcel) | 1.5 mg/m$^2$ |

Viscosity of the coating solutions for the layers was adjusted by adding a thickener represented by the following structure (Z).

Cpd-1

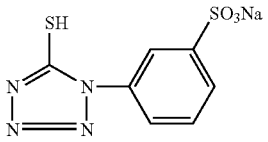

Cpd-2

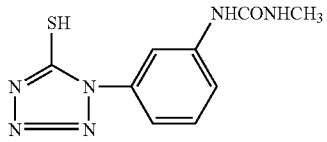

Cpd-3

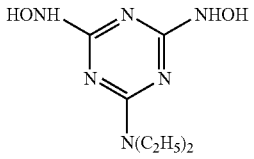

Cpd-4

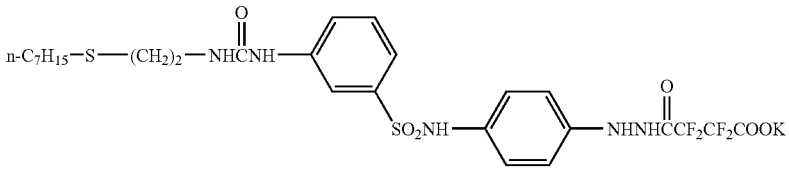

-continued

Cpd-5

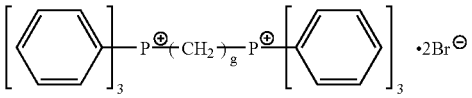

aqL-6

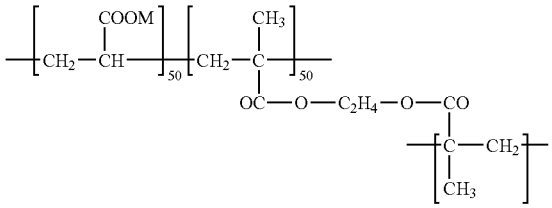

M = H or Na

Cpd-7

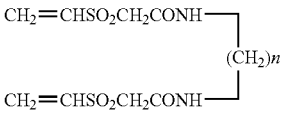

(n = 2):(n = 3) = 3:1

Cpd-8

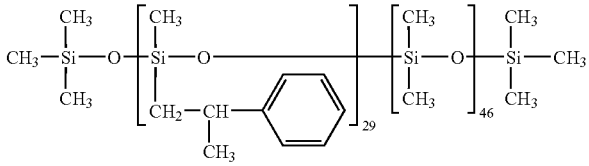

Cpd-9

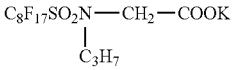

Cpd-10

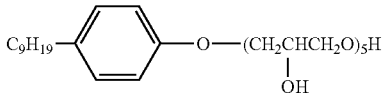

Cpd-11

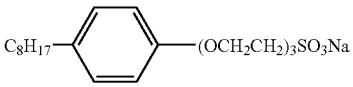

Cpd-12

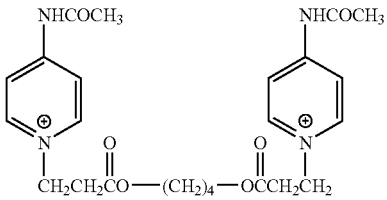

Cpd-13

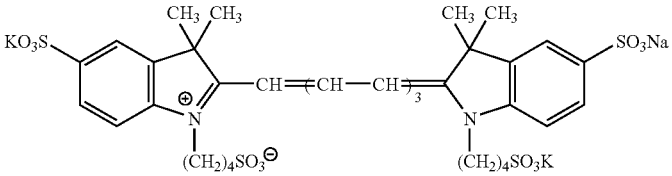

Cpd-14

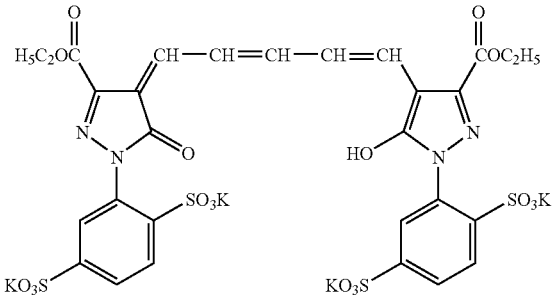

Thickener Z

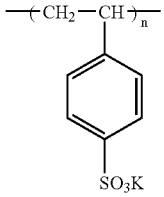

The samples used in the examples had a back layer and electroconductive layer having the following compositions.

<Back Layer>

| | |
|---|---|
| Gelatin | 3.3 g/m$^2$ |
| Compound (Cpd-15) | 40 mg/m$^2$ |
| Compound (Cpd-16) | 20 mg/m$^2$ |
| Compound (Cpd-17) | 90 mg/m$^2$ |
| Compound (Cpd-18) | 40 mg/m$^2$ |
| Compound (Cpd-19) | 26 mg/m$^2$ |

-continued

| | |
|---|---|
| Compound (Cpd-22) | 5 mg/m$^2$ |
| Compound (Cpd-9) | 10 mg/m$^2$ |
| 1,3-Divinylsulfonyl-2-propanol | 60 mg/m$^2$ |
| Polymethyl methacrylate microparticles (mean particle sizes: 6.5 μm) | 30 mg/m$^2$ |
| Liquid paraffin | 78 mg/m$^2$ |
| Compound (Cpd-7) | 120 mg/m$^2$ |
| Calcium nitrate | 20 mg/m$^2$ |
| Antiseptic (Proxcel) | 12 mg/m$^2$ |

-continued

| <Electroconductive layer> | |
|---|---|
| Gelatin | 0.1 g/m$^2$ |
| Sodium dodecylbenzenesulfonate | 20 mg/m$^2$ |
| $SnO_2$/Sb (weight ratio = 9:1, average particle size: 0.25 μm) | 200 mg/m$^2$ |
| Antiseptic (Proxcel) | 0.3 mg/m$^2$ |

Cpd-15

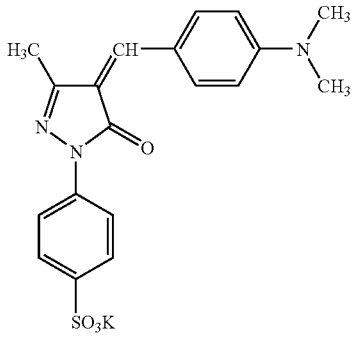

Cpd-16

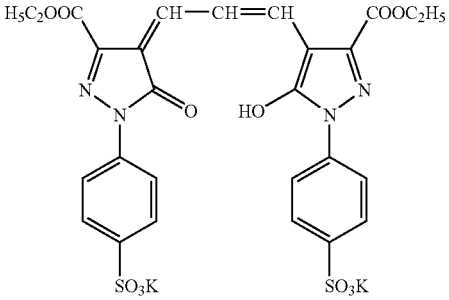

Cpd-17

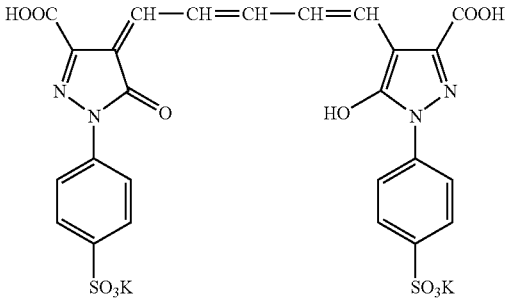

Cpd-18

$CH_3(CH_2)_{11}—CH═CHSO_3Na$

Cpd-19

$CH_3(CH_2)_{11}—CH_2—CH_2SO_3Na$

Cpd-22

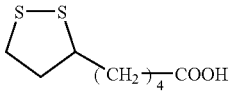

<Support>

On both surfaces of a biaxially stretched polyethylene terephthalate support (thickness: 100 μm), a first undercoat layer and second undercoat layer having the following compositions were coated.

<First Undercoat Layer>

| | |
|---|---|
| Core/shell type vinylidene chloride copolymer (i) | 15 g |
| 2,4-Dichloro-6-hydroxy-s-triazine | 0.25 g |
| Polystyrene microparticles (mean particle size: 3 μm) | 0.05 g |
| Compound (Cpd-20) | 0.20 g |
| Colloidal silica (particle size: 70 to 100 nm Snowtex ZL, Nissan Chemical,) | 0.12 g |
| Water | To total amount of 100 g |

The coating solution further added with 10 weight % of KOH to be adjusted to pH 6 was coated so that a dry thickness of 0.9 μm should be obtained after drying at a drying temperature of 180° C. for 2 minutes.

<Second Undercoat Layer>

| | |
|---|---|
| Gelatin | 1 g |
| Methylcellulose | 0.05 g |
| Compound (Cpd-21) | 0.02 g |
| $C_{12}H_{25}O(CH_2CH_2O)_{10}H$ | 0.03 g |
| Proxcel | $3.5 \times 10^{-3}$ g |
| Acetic acid | 0.2 g |
| Water | To total amount of 100 g |

This coating solution was coated so that a dry thickness of 0.1 μm should be obtained after drying at a drying temperature of 170° C. for 2 minutes.

Core/Shell Type Vinylidene Chloride Copolymer (i)

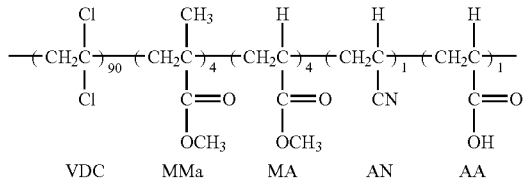

VDC MMa MA AN AA

Core: VDC/MMA/MA (80 weight %)

Shell: VDC/AN/AA (20 weight %)

Average particle size: 70 nm

Compound (Cpd-20)

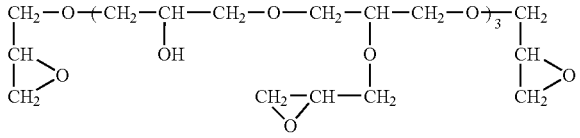

Compound (Cpd-21)

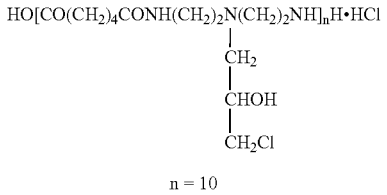

n = 10

<Coating Method>

First, on the aforementioned support coated with the undercoat layers, as the emulsion layer side, four layers of UL layer, emulsion layer, lower protective layer and upper protective layer were simultaneously coated as stacked layers in this order from the support at 35° C. by the slide bead coating method and passed through a cold wind setting zone (5° C.). Then, on the side opposite to the emulsion layer side, an electroconductive layer and a back layer were simultaneously coated as stacked layers in this order from the support by the curtain coating method with adding a hardening agent solution, and passed through a cold wind setting zone (5° C.). When the coated support was passed through each setting zone, the coating solutions showed sufficient setting. Subsequently, the support coated with the layers was dried for the both surfaces in a drying zone of the drying conditions mentioned below. The coated support was transported without any contact with rollers and the other members after the coating of the back surface until it was rolled up. The coating speed was 200 m/min.

<Drying Conditions>

After the setting, the coated layers were dried with a drying wind at 30° C. until the water/gelatin weight ratio became 800%, and then with a drying wind at 35° C. and 30% RH for the period where the ratio became 200% from 800%. The coated layers were further blown with the same wind, and 30 second after the point where the surface temperature became 34° C. (regarded as completion of drying), the layers were dried with air at 48° C. and 2% RH for 1 minute. In this operation, the drying time was 50 seconds from the start of the drying to the point that the water/gelatin ratio became 800%, 35 seconds for a period that the ratio changed from 800% to 200% of the ratio, and 5 seconds from the point that the ratio was 200% to the end of the drying.

This silver halide photographic light-sensitive material was rolled up at 25° C. and 55% RH and subjected to a heat treatment at 35° C. and 30% RH for 72 hours. Then, the light-sensitive material was cut at 25° C. and 55% RH, conditioned for moisture content at 25° C. and 50% RH for 8 hours and then sealed in a barrier bag conditioned for moisture content for 6 hours together with a cardboard conditioned for moisture content at 25° C. and 50% RH for 2 hours to prepare a sample.

Humidity in the barrier bag was measured and found to be 45%. The obtained samples had a film surface pH of 5.5 to 5.8 for the emulsion layer side and 6.0 to 6.5 for the back side.

The light-sensitive material numbers are shown in Table 1

In the processing utilizing an automatic developing machine performed in this example, the following fixer was used.

Composition of Fixer (B) (Composition Per Liter of Concentrated Solution)

| | |
|---|---|
| Ammonium thiosulfate | 360 g |
| Disodium ethylenediaminetetraacetate dihydrate | 0.09 g |
| Sodium thiosulfate pentahydrate | 33.0 g |
| Sodium metasulfite | 57.0 g |
| Sodium hydroxide | 37.2 g |
| Acetic acid (100%) | 90.0 g |
| Tartaric acid | 8.7 g |
| Sodium gluconate | 5.1 g |
| Aluminum sulfate | 25.2 g |

pH 4.85

One part of the above concentrated solution was diluted with two parts of water upon use. pH of the solution used was 4.8.

A running test was performed with a combination of each of the light-sensitive materials mentioned in Table 1 and Developer (A) mentioned below.

Developer (A) (Composition Per Liter of Concentrated Solution)

| | |
|---|---|
| Water | 600 mL |
| Potassium hydroxide | 105.0 g |
| Diethylenetriaminepentaacetic acid | 6.0 g |
| Potassium carbonate | 120.0 g |
| Sodium metabisulfite | 120.0 g |
| Potassium bromide | 9.0 g |
| Hydroquinone | 75.0 g |
| 5-Methylbenzotriazole | 0.24 g |
| 4-Hydroxymethyl-4-methyl-1-phenyl-3-pyrazolidone | 1.35 g |
| Sodium 2-mercaptobenzimidazole-5-sulfonate | 0.432 g |
| 4-(N-carboxymethyl-N-methylamino)-2,6-dimercaptopyrimidine | 0.18 g |
| 2-(N-carboxymethyl-N-methylamino)-4,6-dimercaptopyrimidine | 0.06 g |
| Sodium erysorbate | 9.0 g |
| Diethylene glycol | 60.0 g |

The volume was made 1 L and pH was adjusted to 10.7 by adding potassium hydroxide and water.

One part of the above solution added with 3 parts of water was used as a starter solution (mother solution, pH 10.40). One part of the above solution added with 2 parts of water was used as a replenisher (pH 10.45). The replenishing amount was 100 mL per one sheet of Daizen (large sheet) size (50.8×61.0 cm) or 323 mL per $m^2$.

[Evaluation of Practice Density and Dot % ]

On the light-sensitive materials prepared in this example, test steps were outputted by using an image setter RC5600V produced by Fuji Photo Film Co., Ltd. at 175 lines/inch with changing the light quantity and developed by using AP-560 produced by Fuji Photo Film Co., Ltd. as an automatic developing machine and the developer mentioned above with the conditions of development temperature of 35° C. and development time of 30 seconds. Density of a Dmax portion obtained by exposure at an LV value giving 50% of medium half tone dots was measured as practice density. The dot % and the practice density were measured by using a densitometer (Macbeth TD904). Considering the subsequent processes, a practice density of 4.0 or more is necessary, and it is preferably 4.0 to 5.0. As for the dot %, the dot % fluctuation is preferably ±3% after running with 50% fresh solution (Fr).

[Evaluation of Running Property]

The light-sensitive material subjected to exposure giving 50% of medium half tone dots used in the evaluation of practice density was processed in an amount of 5 $m^2$ per day with replenishing amount of 323 mL/$m^2$ for the developer and fixer, and this running was continued for one month. Then, practice Dm and dot % were evaluated.

[Evaluation of Residual Color]

Evaluation was performed by visual inspection for 5 sheets of stacked unexposed areas of samples after the processing of the final day of the running. The residual color was evaluated according to 5-stage criteria. Score 1 means a level of extremely bad residual color property, and Score 5 means a level of no residual color. Score 3 means a scarcely usable level in spite of presence of residual color. The results of the experiment are shown in Table 1.

TABLE 1

| Light-sensitive material No. | Sensitizing dye No. | Benzotriazole compound | Fresh solution Photographic property Dm | Fresh solution Photographic property Dot % | After running Photographic property Dm | After running Photographic property Dot % | Residual color | Note |
|---|---|---|---|---|---|---|---|---|
| 1 | Comparative dye | — | 4.35 | 50 | 3.88 | 54 | 2 | Comparative |
| 2 | Comparative dye | (3) | 4.28 | 50 | 4.30 | 52 | 2 | Comparative |
| 3 | I-1 | — | 4.31 | 50 | 3.91 | 53 | 3 | Comparative |
| 4 | I-1 | (3) | 4.29 | 50 | 4.40 | 51 | 4 | Invention |
| 5 | I-1 | (17) | 4.30 | 50 | 4.32 | 51 | 5 | Invention |
| 6 | II-14 | — | 4.29 | 50 | 3.95 | 53 | 3 | Comparative |
| 7 | II-14 | (3) | 4.25 | 50 | 4.31 | 51 | 5 | Invention |
| 8 | III-2 | — | 4.35 | 50 | 3.90 | 54 | 4 | Comparative |
| 9 | III-2 | (3) | 4.38 | 50 | 4.21 | 51 | 4 | Invention |
| 10 | III-2 | (17) | 4.36 | 50 | 4.19 | 50 | 5 | Invention |
| 11 | IV-21 | — | 4.35 | 50 | 3.88 | 53 | 4 | Comparative |
| 12 | IV-21 | (3) | 4.29 | 50 | 4.21 | 50 | 5 | Invention |

Comparative dye

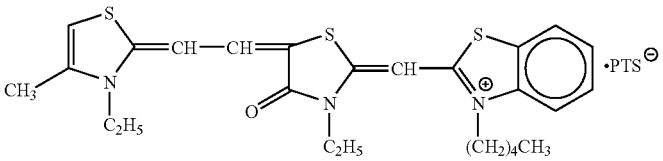

From the results shown in Table 1, it was found that the light-sensitive materials of the present invention exhibited favorable photographic properties (practice Dm and dot % fluctuation) and favorable residual color after running.

In the step of washing with water in the automatic developing machine, AC-1000 produced by Fuji Photo Film Co., Ltd. was used as a water-saving and scale-preventing apparatus, and AB-5 produced by Fuji Photo Film Co., Ltd. was used as a chemical in combination. The replenishing amount was 1 L per one sheet of Daizen size (50.8×61.0 cm).

EXAMPLE 2

The same experiment as that of Example 1 was performed by using the same solutions as those used in Example 1 as fresh solutions (start solutions) and reprenishers prepared from a solid developer and solid fixer having compositions based on those used in Example 1 except for DEG and densely filled in a polyethylene container in the following layer structures. As a result, the samples having the characteristics of the present invention showed favorable performances as in Example 1.

| Developer | |
|---|---|
| First layer | Hydroquinone |
| Second layer | Other ingredients |
| Third layer | KBr |
| Fourth layer | $Na_2S_2O_5$ |
| Fifth layer | Potassium carbonate |
| Sixth layer | KOH pellets |

This composition was dissolved to a volume of 3 L and used.

As for the fixer, the following composition filled in the same manner as the developer was used.

| Fixer | | |
|---|---|---|
| First layer | $(NH_4)_2S_2O_3/Na_2S_2O_3$/SS | 160.0 g |
| Second layer | $Na_2S_2O_5$ | 15.0 g |
| Third layer | Anhydrous sodium acetate | 32.7 g |
| Fourth layer | Ethylenediaminetetraacetic acid | 0.03 g |
| | Succinic acid | 3.3 g |
| | Tartaric acid | 3.0 g |
| | Sodium gluconate | 1.8 g |
| Fifth layer | Ammonium alum | 23.0 g |
| pH in 1 L of the used solution | | 4.80 |

EXAMPLE 3

The same experiment as Example 1 was performed by using Light-sensitive material Nos. 2 and 4 prepared in Example 1 and Developers (B), (C), (D) and (E) mentioned below.

Developer (B): Composition of Used Solution (Composition of Developer)

| | |
|---|---|
| Water | 600 ml |
| Potassium hydroxide | 96.0 g |
| Diethylenetriaminepentaacetic acid | 6.0 g |
| Potassium carbonate | 48.0 g |
| Sodium metabisulfite | 120.0 g |
| Potassium bromide | 9.0 g |
| Hydroquinone | 70.0 g |
| 5-Methylbenzotriazole | 0.24 g |
| 1-Phenyl-3-pyrazolidone | 1.7 g |
| 2-Mercaptobenzothiazole | 0.18 g |
| 1-Phenyl-5-mercaptotetrazole | 0.06 g |
| Sodium erythorbate | 9.0 g |
| Diethylene glycol | 40.0 g |

Potassium hydroxide and water were added to a volume of 1L so that pH should become 10.8.

The solution used was prepared by adding 2 parts by volume of water to 1 part by volume of the aforementioned solution (pH was 10.45). The replenishing amount was 100 ml per one sheet of Daizen size (50.8×61.0 cm) or 323 ml per 1 $m^2$.

Developer (C): Composition of Used Solution

| | |
|---|---|
| Water | 600 ml |
| Potassium hydroxide | 6.0 g |
| N-(2-Hydroxyethyl)-ethylenediaminetriacetate 3Na | 2.0 g |
| Potassium carbonate | 23.0 g |
| Potassium sulfite | 65.0 g |
| Potassium bromide | 10.0 g |
| Hydroquinone | 21.0 g |

-continued

| | |
|---|---|
| 1-Phenyl-5-mercaptotetrazole | 0.03 g |
| 1-Phenyl-3-pyrazolidone | 0.4 g |
| Diethylene glycol | 25.0 g |

Water was added to a volume of 1 L, and pH was adjusted to 10.48.

Developer (D): Composition of Used Solution

| | |
|---|---|
| Water | 600 ml |
| Potassium hydroxide | 22.0 g |
| Diethylenetriaminepentaacetic acid | 3.0 g |
| Potassium carbonate | 22.0 g |
| Sodium metabisulfite | 45.0 g |
| Boric acid | 5.6 g |
| Potassium bromide | 4.4 g |
| Hydroquinone | 25.0 g |
| 4-Hydroxymethyl-4-methyl-1-phenyl-3-pyrazolidone | 0.8 g |
| 1-Phenyl-5-mercaptotetrazole | 0.02 g |
| Benzotriazole | 0.2 g |
| Diethylene glycol | 40.0 g |

Water was added to a volume of 1 L, and pH was adjusted to 10.41.

Developer (E): Composition of Used Solution

| | |
|---|---|
| Water | 600 ml |
| Potassium hydroxide | 17.0 g |
| Disodium ethylenediaminetetraacetate dihydrate | 2.0 g |
| Potassium carbonate | 15.0 g |
| Potassium metabisulfite | 25.0 g |
| Potassium bromide | 5.0 g |
| Hydroquinone | 12.0 g |
| 1-Phenyl-3-pyrazolidone | 0.2 g |

Water was added to a volume of 1 L, and pH was adjusted to 10.05.

The results of the test are shown in Table 2.

TABLE 2

| Light-sensitive | | Fresh solution | | After running | | | |
|---|---|---|---|---|---|---|---|
| | | Photographic property | | Photographic property | | Residual | |
| material No. | Developer | Dm | Dot % | Dm | Dot % | color | Note |
| 2 | B | 4.26 | 50 | 4.02 | 53 | 2 | Comparative |
| 2 | C | 4.21 | 50 | 4.1 | 52 | 2 | Comparative |
| 2 | D | 4.33 | 50 | 4.08 | 53 | 2 | Comparative |
| 2 | E | 4.19 | 50 | 4.06 | 52 | 2 | Comparative |
| 4 | B | 4.32 | 50 | 4.32 | 51 | 5 | Invention |
| 4 | C | 4.41 | 50 | 4.31 | 52 | 4 | Invention |
| 4 | D | 4.36 | 50 | 4.24 | 51 | 5 | Invention |
| 4 | E | 4.33 | 50 | 4.18 | 51 | 4 | Invention |

From the results shown in Table 2, it was found that the light-sensitive materials of the present invention exhibited favorable photographic properties (practice Dm and dot % fluctuation) and favorable residual color after running.

EXAMPLE 4

The same experiments as those of Examples 1 to 3 were performed except that a development temperature of 38° C., fixing temperature of 37° C. and developing time of 20 seconds were used. The results were similar to those obtained in Examples 1 to 3, and thus the effect of the present invention was not degraded.

EXAMPLE 5

The same experiments as those of Examples 1 to 4 were performed except that FG-680AS produced by Fuji Photo Film Co., Ltd. was used as an automatic developing machine, and the transportation speed of the light-sensitive materials was adjusted to 1500 mm/minute as a linear speed. As a result, similar results were obtained.

EXAMPLE 6

The same evaluation of practice density as in Examples 1 to 5 was performed after the same running as described above by using, instead of Lux Setter RC-5600V produced by Fuji Photo Film Co., Ltd, any one of Image setter FT-R$^{5055}$ produced by Dainippon Screen Mfg. Co., Ltd., Select Set 5000, Avantra 25 and Acuset 1000 produced by Agfa Gevaert AG, Dolev 450 and Dolev 800 produced by Scitex, Lino 630, Quasar, Herkules ELITE and Signasetter produced by Heidelberg, Luxel F-9000, and Panther Pro 62 produced by PrePRESS Inc. As a result, similar effect was provided by the light-sensitive materials of the present invention.

EXAMPLE 7

The same experiment as in Example 1 was performed except that the hydrazine compounds contained in the light-sensitive materials were changed to D-68or D-69. The same effect as that observed in Example 1 was obtained.

According to the present invention, there could be provided a silver halide photographic light-sensitive material that can provide superior residual color property and stable photograph performance even with a low silver content of the silver halide photographic light-sensitive material even after a long term running in processing utilizing an automatic developing machine following exposure utilizing an image setter.

The present disclosure relates to the subject matter contained in Japanese Patent Application No. 287243/2002 filed on Sep. 30, 2002, which is expressly incorporated herein by reference in its entirety.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

What is claimed is:

1. A silver halide photographic light-sensitive material comprising at least one silver halide emulsion layer and at least one hydrophilic colloid layer on a support, wherein the silver halide emulsion layer and/or the hydrophilic colloid layer contains at least one hydrazine derivative, a silver halide emulsion in the silver halide photographic light-sensitive material is spectrally sensitized with at least one dye selected from dyes represented by any one of the following formulas (I) to (IV), and further the silver halide photographic light-sensitive material contains a benzotriazole compound:

Formula I

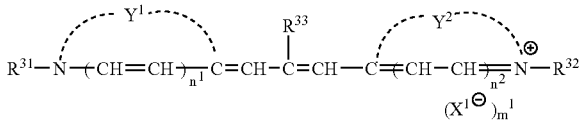

wherein, in the formula (I), $Y^1$ and $Y^2$ each independently represents a nonmetallic atom group required to form a benzothiazole ring, benzoselenazole ring, naphthothiazole ring, naphthoselenazole ring or quinoline ring, wherein these heterocyclic rings are optionally substituted with a lower alkyl group, an alkoxyl group, an aryl group, hydroxyl group, an alkoxycarbonyl group or a halogen atom, $R^{31}$ and $R^{32}$ each independently represents a lower alkyl group or an alkyl group having a sulfo group or carboxyl group, $R^{33}$ represents methyl group, ethyl group or propyl group, $X^1$ represents an anion, $n^1$ and $n^2$ each independently represents 0 or 1, $m^1$ represents 1 or 2, and $m^1$ is 0 when an intramolecular salt is formed;

Formula II

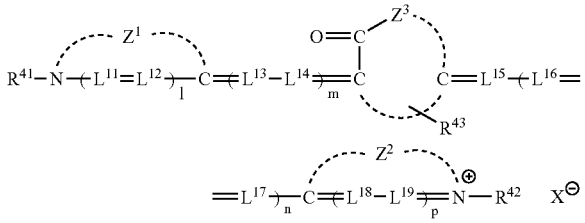

wherein, in the formula (II), $Z^1$ and $Z^2$ each independently represents an atomic group required to form a 5- or 6-membered heterocyclic ring, $Z^3$ represents an atomic group required to form a 5- or 6-membered nitrogen-containing heterocyclic ring, which has a substituent ($R^{43}$) on a nitrogen atom in $Z^3$, $R^{41}$ and $R^{42}$ each independently represents an alkyl group, an alkenyl group, an aralkyl group or an aryl group, $R^{43}$ represents a substituent having the same meaning as that of $R^{41}$ or $R^{42}$, a substituted amino group, amido group, imino group, an alkoxyl group or a heterocyclic group, wherein at least one of $R^{41}$, $R^{42}$ and $R^{43}$ represents a water-soluble group, $L^{11}$ to $L^{19}$ each independently represents a methine group, m and n each independently represent 0, 1 or 2, p represents 0 or 1, and X represents a counter ion;

Formula III

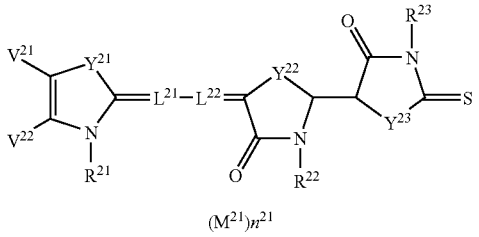

wherein, in the formula (III), $Y^{21}$, $Y^{22}$ and $Y^{23}$ each independently represents a —N($R^{24}$)-group, oxygen atom, sulfur atom or selenium atom, $R^{21}$ represents an aliphatic group having 10 or less carbon atoms and a water-solubilizing group, $R^{22}$, $R^{23}$ and $R^{24}$ each independently represents an aliphatic group, an aryl group or a heterocyclic group, where at least two of $R^{22}$, $R^{23}$ and $R^{24}$ have a water-solubilizing group, $V^{21}$ and $V^{22}$ each independently represents a hydrogen atom, an alkyl group, an alkoxyl group or an aryl group, or $V^{21}$ and $V^{22}$ bind together to represents a group forming a condensed ring with the azole ring, $L^{21}$ and $L^{22}$ each independently represents a substituted or unsubstituted methine group, $M^{21}$ represents an ion required to offset the total intramolecular charge, and $n^{21}$ represents the number of ions required to offset the total intramolecular charge;

Formula IV

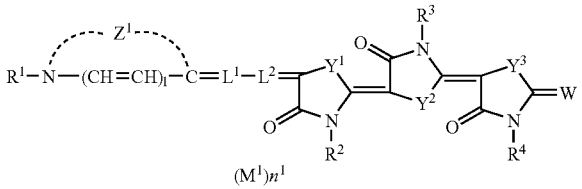

wherein, in the formula (IV), $Y^1$, $Y^2$ and $Y^3$ each independently represents —N($R^5$)—, oxygen atom, sulfur atom, selenium atom or tellurium atom, $Z^1$ represents a nonmetallic atom group required to form a 5- or 6-membered nitrogen-containing heterocyclic group, optionally forming a condensed ring, $R^1$ represents an aliphatic group having 8 or less carbon atoms and a water-solubilizing group, $R^2$, $R^3$, $R^4$ and $R^5$ each independently represents an aliphatic group, an aryl group or a heterocyclic group, wherein at least two of $R^2$, $R^3$, $R^4$ and $R^5$ have a water-solubilizing group, W represents an oxygen atom, sulfur atom or =C($E^1$)-($E^2$) wherein $E^1$ and $E^2$ each independently represents an electron-withdrawing group, and $E^1$ and $E^2$ optionally bind together to form a keto ring or an acidic heterocyclic ring, $L^1$ and $L^2$ each independently represents a substituted or unsubstituted methine group, 1 represents 0 or 1, $M^1$ represents an ion required to offset the total intramolecular charge, and $n^1$ represents the number of ion required to offset the total intramolecular charge;

wherein a coated silver amount in the silver halide photographic light-sensitive material is 3.0 g/$m^2$ or less.

2. The silver halide photographic light-sensitive material according to claim 1, wherein the silver halide emulsion is spectrally sensitized with a dye represented by the formula (I).

3. The silver halide photographic light-sensitive material according to claim 1, wherein the silver halide emulsion is spectrally sensitized with a dye represented by the formula (II).

4. The silver halide photographic light-sensitive material according to claim 1, wherein the silver halide emulsion is spectrally sensitized with a dye represented by the formula (III).

5. The silver halide photographic light-sensitive material according to claim 1, wherein the silver halide emulsion is spectrally sensitized with a dye represented by the formula (IV).

6. The silver halide photographic light-sensitive material according to claim 1, wherein the dye for spectral sensitization can be dissolved in water at a concentration of 0.05 weight % or more.

7. The silver halide photographic light-sensitive material according to claim 1, wherein the addition amount of the dye for spectral sensitization is $4\times10^{-6}$ to $8\times10^{-3}$ mol per mol of silver halide.

8. The silver halide photographic light-sensitive material according to claim 1, wherein the grain size of the silver halide is 0.2 to 1.3 μm and the addition amount of the dye for spectral sensitization is $2\times10^{-7}$ to $3.5\times10^{-6}$ per $m^2$ of the surface area of the silver halide grains.

9. The silver halide photographic light-sensitive material according to claim 1, wherein the hydrazine derivative is represented by the following formula (D):

Formula (D)

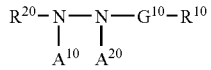

wherein $R^{20}$ represents an aliphatic group, an aromatic group or a heterocyclic group, $R^{10}$ represents hydrogen atom or a blocking group, and $G^{10}$ represents —CO—, —COCO—, —C(=S)—, —$SO_2$—, —SO—, —PO($R^{30}$)— group or an iminomethylene group, $R^{30}$ is selected from the same range of groups defined for $R^{10}$, $R^{30}$ is optionally different from $R^{10}$, and $A^{10}$ and $A^{20}$ both represents a hydrogen atom, or one of them represents a hydrogen atom and the other represents a substituted or unsubstituted alkylsulfonyl group, a substituted or unsubstituted arylsulfonyl group or a substituted or unsubstituted acyl group.

10. The silver halide photographic light-sensitive material according to claim 9, wherein $R^{20}$ in the formula (D) represents a substituted phenyl group.

11. The silver halide photographic light-sensitive material according to claim 9, wherein the hydrazine derivative represented by the formula (D) have at least one substituent, directly or indirectly on $R^{20}$ or $R^{10}$, selected from the group consisting of a ballast group, a group that can be absorbed on silver halide, a group containing quaternary ammonio group, a nitrogen-containing heterocyclic group containing a quaternized nitrogen atom, a group containing repeating units of ethyleneoxy group, an (alkyl, aryl or heterocyclyl) thio group, a dissociating group capable of dissociating in an alkaline developer, and a hydrazino group capable of forming a multimer.

12. The silver halide photographic light-sensitive material according to claim 9, wherein $G^{10}$ in the formula (D) is —CO— group, and $R^{10}$ in the formula (D) is hydrogen atom, an alkyl group, an alkenyl group, an alkynyl group, an aryl group or a heterocyclic group.

13. The silver halide photographic light-sensitive material according to claim 9, wherein $G^{10}$ in the formula (D) is —COCO— group, and $R^{10}$ in the formula (D) is an alkoxy group, an aryloxy group or an amino group.

14. The silver halide photographic light-sensitive material according to claim 1, wherein the hydrazine derivative is contained in an amount of $1.0\times10^{-4}$ mol/mol Ag or more.

15. The silver halide photographic light-sensitive material according to claim 1, wherein the benzotriazole compound is contained in the silver halide emulsion layer.

16. The silver halide photographic light-sensitive material according to claim 1, wherein the benzotriazole compound is benzotriazole or 5-methylbenzotriazole.

17. The silver halide photographic light-sensitive material according to claim 1, wherein the benzotriazole compound is contained in an amount of $1\times10^{-4}$ to $1\times10^{-1}$ mol/mol of silver halide.

18. The silver halide photographic light-sensitive material according to claim 1, wherein the benzotriazole compound is contained in an amount of $1\times10^{-3}$ to $7\times10^{-2}$ mol/mol of silver halide.

19. The silver halide photographic light-sensitive material according to claim 1, which has a gelatin layer between the silver halide emulsion layer and the support.

* * * * *